US009141031B2

(12) United States Patent
Yamabe et al.

(10) Patent No.: US 9,141,031 B2
(45) Date of Patent: Sep. 22, 2015

(54) TONER HOUSING CONTAINER AND IMAGE FORMING APPARATUS

(71) Applicants: Junji Yamabe, Shizuoka (JP); Seiji Terazawa, Shizuoka (JP); Shinji Tamaki, Tokyo (JP); Kenji Kikuchi, Kanagawa (JP); Hiroshi Hosokawa, Kanagawa (JP); Shunji Katoh, Kanagawa (JP); Ryoichi Teranishi, Shizuoka (JP); Hiroshi Ikeguchi, Saitama (JP); Michiharu Suzuki, Kanagawa (JP)

(72) Inventors: Junji Yamabe, Shizuoka (JP); Seiji Terazawa, Shizuoka (JP); Shinji Tamaki, Tokyo (JP); Kenji Kikuchi, Kanagawa (JP); Hiroshi Hosokawa, Kanagawa (JP); Shunji Katoh, Kanagawa (JP); Ryoichi Teranishi, Shizuoka (JP); Hiroshi Ikeguchi, Saitama (JP); Michiharu Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/277,518

(22) Filed: May 14, 2014

(65) Prior Publication Data

US 2014/0348551 A1 Nov. 27, 2014

(30) Foreign Application Priority Data

May 21, 2013 (JP) ..... 2013-107060

(51) Int. Cl.
*G03G 15/08* (2006.01)
*G03G 9/08* (2006.01)

(52) U.S. Cl.
CPC ..... *G03G 15/0872* (2013.01); *G03G 9/0821* (2013.01); *G03G 15/0886* (2013.01)

(58) Field of Classification Search
CPC ..... G03G 15/0865; G03G 15/0872; G03G 15/0886
See application file for complete search history.

(56) References Cited

U.S. PATENT DOCUMENTS 5,576,816 A 11/1996 Staudt et al.
6,169,864 B1 * 1/2001 Baxendell et al. ..... 399/106

(Continued)

FOREIGN PATENT DOCUMENTS

JP 2012-133349 7/2012
WO WO 2012/074139 A1 6/2012
WO WO2013/077474 5/2013

OTHER PUBLICATIONS

Extended European Search Report issued Sep. 26, 2014 in Patent Application No. 14166283.3.

(Continued)

*Primary Examiner* — Gregory H Curran
(74) *Attorney, Agent, or Firm* — Oblon, McClelland, Maier & Neustadt, L.L.P.

(57) ABSTRACT

A toner housing container includes: container body; conveying portion; pipe receiving port; and uplifting portion. Container body includes; protruding portion protruding from container body interior side of container opening portion to one end of container body; and shutter member moving between closing and opening positions to close and open container opening portion. Uplifting portion includes: uplifting wall surface extending from container body internal wall surface toward protruding portion; and curving portion curving to conform to protruding portion. Shutter member moves from closing to opening position upon push by conveying pipe. When toner housing container is mounted on toner conveying device, protruding portion is present between curving portion and toner receiving port of conveying pipe inserted and extends along shutter member moving region. Toner has bulk density of ≤0.399 g/cm$^3$ when toner housing container is shaken up-and-down 10 times at 25° C., 50% RH, and put such that container opening portion faces downward.

16 Claims, 28 Drawing Sheets

(56) References Cited

U.S. PATENT DOCUMENTS

| | | | | |
|---|---|---|---|---|
| 6,969,574 | B1 * | 11/2005 | Tosaka et al. | 430/137.18 |
| 2007/0122205 | A1 | 5/2007 | Taguchi et al. | |
| 2007/0140747 | A1 | 6/2007 | Kita et al. | |
| 2007/0147900 | A1 | 6/2007 | Taguchi et al. | |
| 2007/0154243 | A1 | 7/2007 | Taguchi et al. | |
| 2007/0160393 | A1 | 7/2007 | Taguchi et al. | |
| 2009/0263146 | A1 | 10/2009 | Pearce et al. | |
| 2010/0003055 | A1 | 1/2010 | Kikuchi et al. | |
| 2010/0129118 | A1 | 5/2010 | Kimura et al. | |
| 2011/0008075 | A1 | 1/2011 | Taguchi et al. | |
| 2011/0058857 | A1 | 3/2011 | Hori et al. | |
| 2011/0222871 | A1 | 9/2011 | Suzuki et al. | |
| 2012/0033998 | A1 | 2/2012 | Hori et al. | |
| 2012/0163877 | A1 | 6/2012 | Kikuchi et al. | |
| 2012/0195645 | A1 | 8/2012 | Takami et al. | |
| 2012/0213555 | A1 | 8/2012 | Komatsu et al. | |
| 2012/0219330 | A1 | 8/2012 | Kikuchi et al. | |
| 2012/0251188 | A1 | 10/2012 | Matsuura | |
| 2012/0321341 | A1 | 12/2012 | Hori et al. | |
| 2013/0272750 | A1 | 10/2013 | Matsumoto et al. | |

OTHER PUBLICATIONS

U.S. Appl. No. 14/186,417, filed Feb. 21, 2014.

* cited by examiner

TONER HOUSING CONTAINER AND IMAGE FORMING APPARATUS

BACKGROUND OF THE INVENTION

1. Field of the Invention

The present invention relates to a toner housing container and an image forming apparatus.

2. Description of the Related Art

In electrophotographic image forming apparatuses, a powder conveying device supplies (or replenishes) a toner serving as a developer from a toner container, which is a powder housing container housing the developer in the powder form, into a developing device.

For example, there is proposed a toner housing container that includes a rotatable tubular powder housing member, a conveying pipe receiving member fixed to the powder housing member, an opening provided in the conveying pipe receiving member, and an uplifting portion configured to uplift the toner upward in the container along with rotation of the container body (e.g., see Japanese Patent Application Laid-Open (JP-A) No. 2012-133349). According to this proposed technique, the toner is uplifted by the uplifting portion along with rotation of the container body, and the toner falls from the uplifting portion during the rotation and is supplied into the conveying pipe.

Further, according to this proposed technique, there is also provided an opening/closing member (a so-called shutter member) configured to open or close the opening by making a sliding move along with the conveying pipe being inserted into the conveying pipe receiving member. The opening/closing member prevents leakage or scatter of the toner.

However, when a shutter member is used in a system that employs the mechanism of uplifting the toner by the uplifting portion and supplying the toner into the conveying pipe, the conveying pipe receiving member may be clogged with the toner depending on the type of the toner filled in the toner housing container, which causes a problem that the shutter member cannot be opened.

Accordingly, it is currently requested to provide a toner housing container that is free from the problem that a shutter member cannot be opened.

SUMMARY OF THE INVENTION

The present invention aims to solve the conventional problems described above, and achieve the following object. That is, an object of the present invention is to provide a toner housing container that is free from a problem that a shutter member cannot be opened.

Means for solving the problems described above is as follows.

A toner housing container according to the present invention includes:

a container body mountable on a toner conveying device and housing a toner to be supplied to the toner conveying device;

a conveying portion provided in the container body and configured to convey the toner from one end of the container body in a longer direction thereof to the other end thereof at which a container opening portion is provided;

a pipe receiving port provided at the container opening portion and capable of receiving a conveying pipe fixed to the toner conveying device; and an uplifting portion configured to uplift the toner conveyed by the conveying portion from a lower side of the container body to an upper side thereof and move the toner into a toner receiving port of the conveying pipe, wherein the container body includes a protruding portion protruding from a container body interior side of the container opening portion toward the one end, and a shutter member capable of moving between a closing position to close the container opening portion and an opening position to open the container opening portion, wherein the uplifting portion includes an uplifting wall surface extending from an internal wall surface of the container body toward the protruding portion, and a curving portion curving so as to conform to the protruding portion, wherein the shutter member moves from the closing position to the opening position by being pushed by the conveying pipe, wherein the protruding portion is provided such that when the toner housing container is mounted on the toner conveying device, the protruding portion is present between the curving portion and the toner receiving port of the conveying pipe being inserted, and extends along a region in which the shutter member moves, and wherein the toner has a bulk density of 0.399 g/cm$^3$ or less when the toner housing container is shaken up and down 10 times under conditions of a temperature of 25° C. and a humidity of 50% RH and put such that the container opening portion faces downward.

The present invention can provide a toner housing container that can solve the conventional problems described above and is free from a problem that the shutter member cannot be opened.

Figure 1:
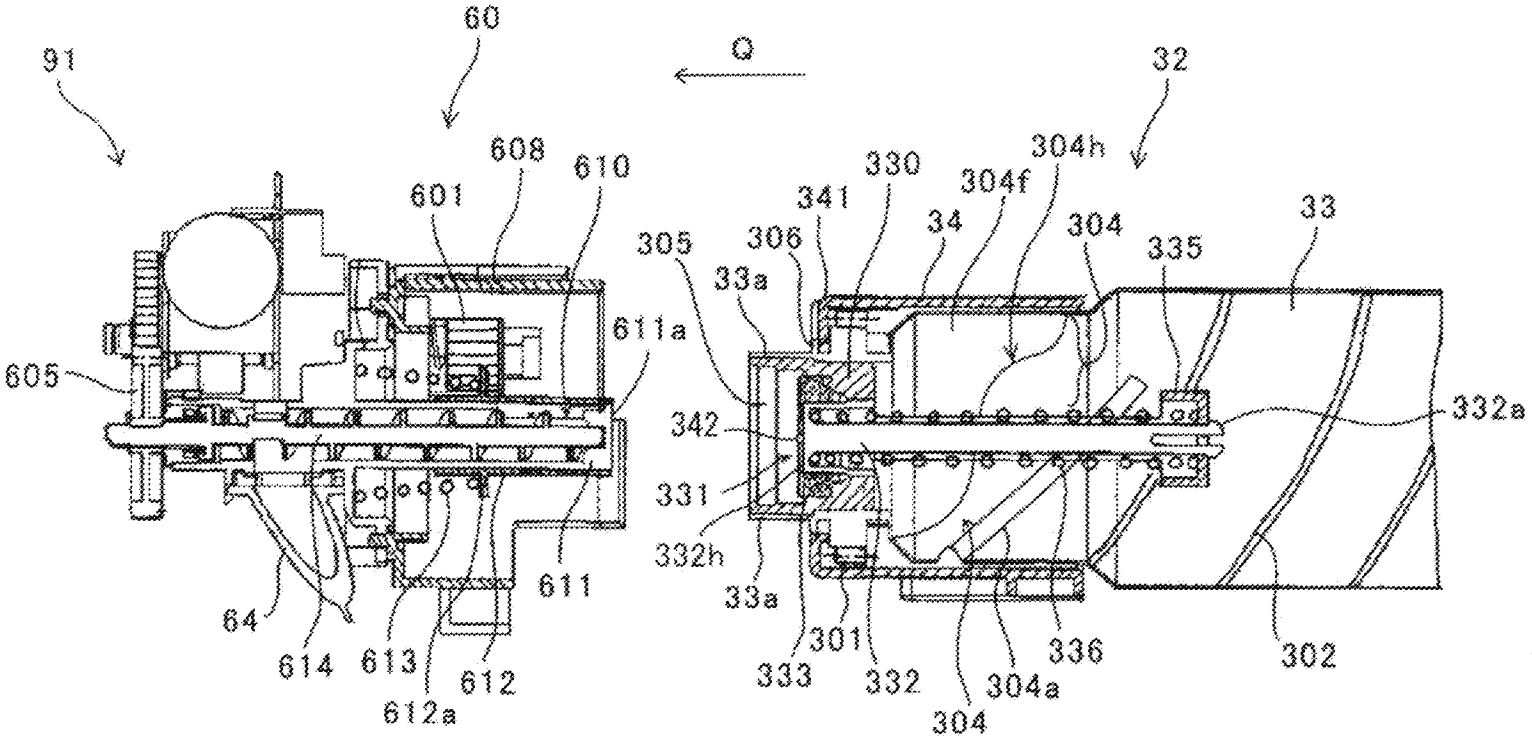
FIG. 1 is a cross-sectional explanatory diagram of a toner conveying device before mounted with a toner housing container according to an example of the present invention and of the toner housing container.

DETAILED DESCRIPTION OF THE INVENTION (Toner Housing Container)

A toner housing container of the present invention includes at least a toner, a container body, a conveying portion, a pipe receiving port, and an uplifting portion, and further includes other members according to necessity.

The container body is mountable on a toner conveying device, and houses the toner to be supplied to the toner conveying device.

The conveying portion is provided in the container body, and conveys the toner from one end of the container body in a longer direction thereof to the other end thereof at which a container opening portion is provided.

The pipe receiving port is provided at the container opening portion, and is capable of receiving a conveying pipe fixed to the toner conveying device.

The uplifting portion (also referred to as toner delivering unit) uplifts the toner conveyed by the conveying portion from a lower side of the container body to the upper side thereof, and moves the toner to a toner receiving port of the conveying pipe.

The container body includes a protruding portion protruding from a container body interior side of the container opening portion to the one end.

The container body includes a shutter member capable of moving between a closing position to close the container opening portion and an opening position to open the container opening portion.

The uplifting portion includes an uplifting wall surface extending from an internal wall surface of the container body toward the protruding portion, and a curving portion curving so as to conform to the protruding portion.

The shutter member moves from the closing position to the opening position by being pushed by the conveying pipe.

The protruding portion is provided such that when the toner housing container is mounted on the toner conveying device, the protruding portion is present between the curving portion and the toner receiving port of the conveying pipe being inserted, and extends along a region in which the shutter member moves.

The toner has a bulk density of 0.399 g/cm$^3$ or less, when the toner housing container is shaken up and down 10 times under conditions of a temperature of 25° C. and a humidity of 50% RH and put such that the container opening portion faces downward.

The protruding portion is preferably a plate-shaped member and provided such that a flat side surface of the plate-shaped member is present between the curving portion and the toner receiving port of the toner conveying pipe being inserted. This makes it easier for the flat side surface of the plate-shaped member to receive the toner, and facilitates passing of the toner from the uplifting portion into the toner conveying pipe.

The flat side surface is a side surface intersecting approximately perpendicularly with such a surface of the plate-shaped member as facing the uplifting portion.

The uplifting portion includes a rising portion rising from an internal wall surface of the container body toward the protruding portion.

The rising portion includes a curving portion curving so as to conform to the protruding portion.

The protruding portion is provided such that when the toner housing container is mounted on the toner conveying device, the protruding portion is present between the curving portion and the toner receiving port of the conveying pipe being inserted.

It is preferable that the toner housing container include two uplifting portions, and that when the toner housing container is mounted on the toner conveying device, the protruding portion be present between the curving portions of the respective ones of the two uplifting portions and the toner receiving port of the conveying pipe being inserted. This leads to efficient uplifting of the toner, and facilitates passing of the toner from the uplifting portions into the toner conveying pipe.

The two uplifting portions may or may not be provided to face each other by sandwiching therebetween a longer direction center axis of the toner housing container.

(Image Forming Apparatus)

In an image forming apparatus of the present invention, the toner housing container is demountably set in the body of the image forming apparatus.

Figure 2:
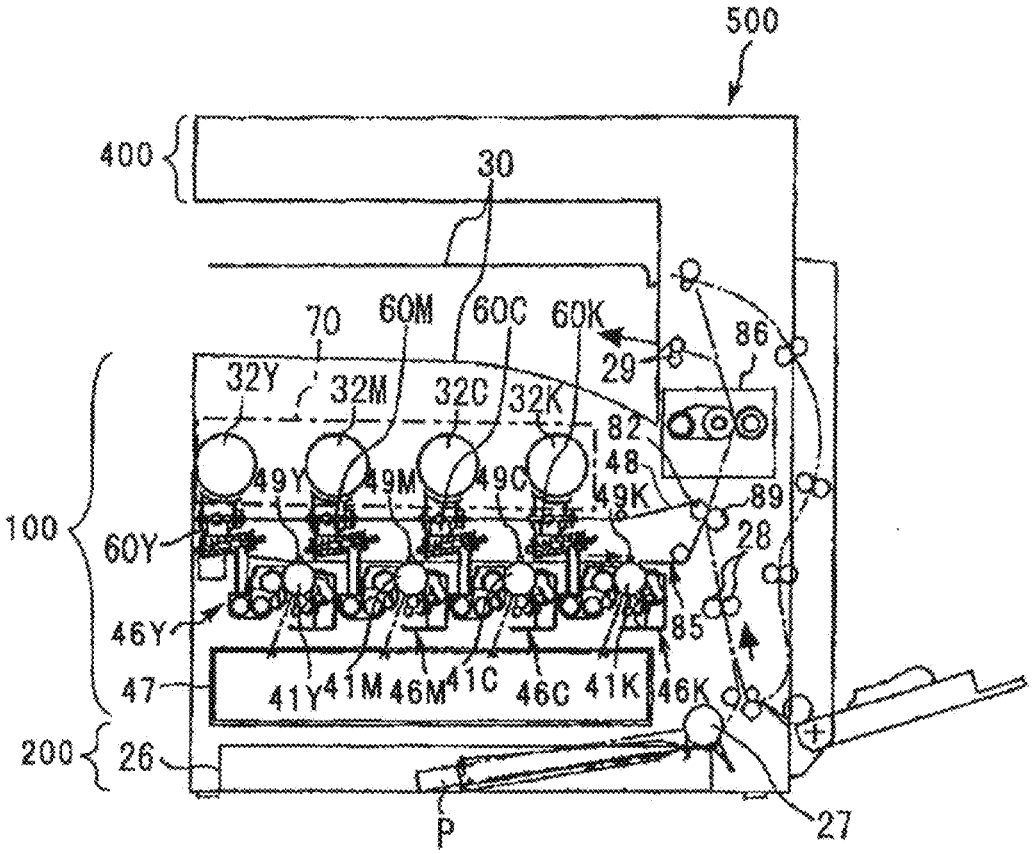
FIG. 2 is a schematic configuration diagram showing an example image forming apparatus of the present invention.

An embodiment of the present invention will be explained below with reference to the drawings. FIG. 2 explains one embodiment of the present invention applied to a copier (hereinafter referred to as copier 500) as the image forming apparatus.

FIG. 2 is a schematic configuration diagram of the copier 500 of the present embodiment. The copier 500 includes a copier body (hereinafter referred to as printer section 100), a sheet feeding table (hereinafter referred to as sheet feeding section 200), and a scanner (hereinafter referred to as scanner section 400) mounted on the printer section 100.

Four toner housing containers 32 (Y, M, C, and K) corresponding to respective colors (yellow, magenta, cyan, and black) are demountably (replaceably) set in a toner housing container accommodating section 70 provided in an upper portion of the printer section 100. An intermediate transfer unit 85 is provided below the toner housing container accommodating section 70.

The intermediate transfer unit 85 includes an intermediate transfer belt 48 as an intermediate transfer member, four first transfer bias rollers 49 (Y, M, C, and K), a second transfer backup roller 82, a plurality of tension rollers, an unillustrated intermediate transfer cleaning device, and the like. The intermediate transfer belt 48 is tensed and supported by a plurality of roller members, and endlessly moves in the arrow direction of FIG. 2 by being rotatably driven by the second transfer backup roller 82, which is one of these plurality of roller members.

In the printer section 100, four image forming units (Y, M, C, and K) corresponding to the respective colors are provided side by side so as to face the intermediate transfer belt 48. Four toner replenishing devices 60 (Y, M, C, and K) as toner conveying devices corresponding to the toner housing containers of the respective colors are provided below the four toner housing containers 32 (Y, M, C, and K). Toners, which are powder developers housed in the toner housing containers 32 (Y, M, C, and K), are supplied (replenished) by corresponding ones of the toner replenishing devices 60 (Y, M, C, and K) into developing devices of the image forming units 46 (Y, M, C, and K) corresponding to the respective colors.

As shown in FIG. 2, the printer section 100 includes an exposing device 47 as a latent image forming unit below the four image forming units 46. The exposing device 47 scans the surface of photoconductors 41 (Y, M, C, and K) by exposing the surface to light based on image information of a document image captured with the scanner section 400, and forms an electrostatic latent image on the surface of the respective photoconductors. Image information may be image information not captured through the scanner section 400 but input from an external device such as a personal computer connected to the copier 500.

In the present embodiment, a laser beam scanner system using a laser diode is employed as the exposing device 47. However, other systems such as one using a LED array may be used as an exposing unit.

Figure 3:
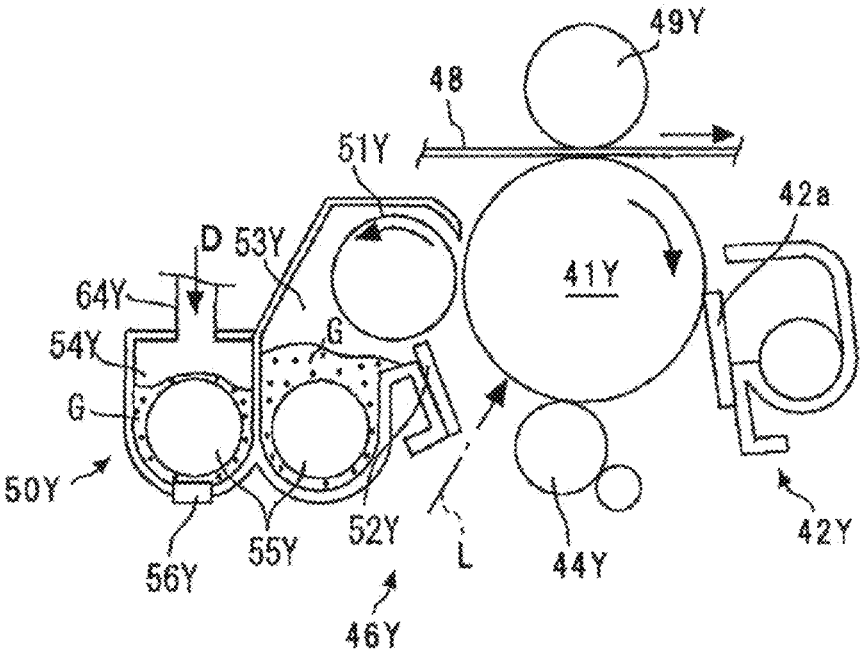
FIG. 3 is an exemplary diagram showing one configuration of an image forming unit of the image forming apparatus shown in FIG. 2.

FIG. 3 is an exemplary diagram showing one configuration of the image forming unit 46Y corresponding to yellow.

The image forming unit 46Y includes a drum-shaped photoconductor 41Y as an image bearing member. The image forming unit 46Y is configured such that a charging roller 44Y as a charging unit, a developing device 50Y as a developing unit, a photoconductor cleaning device 42Y, an unillustrated charge eliminating device, and the like are provided around the photoconductor 41Y. Through an image forming process (a charging step, an exposing step, a developing step, a transfer step, and a cleaning step) performed on the photoconductor 41Y, a yellow toner image is formed on the photoconductor 41Y.

The other three image forming units 46 (M, C, and K) have substantially the same configuration as the image forming unit 46Y corresponding to yellow, except for using different colors of toners.

Toner images corresponding to the respective colors of toners are formed on the photoconductors 41 (M, C, and K). In the following, the image forming unit 46Y corresponding to yellow will only be explained, by appropriately skipping explanation of the other three image forming units 46 (M, C, and K).

The photoconductor 41Y is driven to rotate in the clockwise direction of FIG. 3 by an unillustrated driving motor. The surface of the photoconductor 41Y is electrically charged uniformly at a position facing the charging roller 44Y (charging step). After this, the surface of the photoconductor 41Y reaches a position at which it is irradiated with laser light L emitted by the exposing device 47, and has an electrostatic latent image corresponding to yellow formed thereon by being scanned and exposed at this position (exposing step). After this, the surface of the photoconductor 41 reaches a position at which it faces the developing device 50Y, and has the electrostatic latent image developed with the yellow toner at this position and a yellow toner image formed thereon (developing step).

Each of the four first transfer bias rollers 49 (Y, M, C, and K) of the intermediate transfer unit 85 forms a first transfer nip by sandwiching the intermediate transfer belt 48 between itself and the photoconductor 41 (Y, M, C, and K). A transfer bias inverse to the polarity of the toner is applied to the first transfer bias rollers 49 (Y, M, C, and K).

The surface of the photoconductor 41Y on which a toner image is formed through the developing step reaches the first transfer nip facing the first transfer bias roller 49Y across the intermediate transfer belt 48, and has the toner image on the photoconductor 41Y transferred onto the intermediate transfer belt 48 by this first transfer nip (first transfer step).

At this time, although slightly, the toner remains un-transferred on the photoconductor 41Y. The surface of the photoconductor 41Y having transferred the toner image onto the intermediate transfer belt 48 by the first transfer nip reaches a position facing the photoconductor cleaning device 42Y. The un-transferred toner remained on the photoconductor 41Y is mechanically collected by a cleaning blade 42*a* of the photoconductor cleaning device 42Y at this facing position (cleaning step).

Finally, the surface of the photoconductor 41Y reaches a position facing the unillustrated charge eliminating device, and has a residual potential on the photoconductor 41Y eliminated at this position. In this way, the series of image forming process performed on the photoconductor 41Y is completed.

Such an image forming process is performed in the other image forming units 46 (M, C, and K) in the same manner as in the yellow image forming unit 46Y. That is, the exposing device 47 provided below the image forming units 46 (M, C, and K) emits laser light L based on image information to the photoconductors 41 (M, C, and K) of the image forming units 46 (M, C, and K). Specifically, the exposing device 47 emits laser light L from a light source, and irradiates the photoconductors 41 (M, C, and K) with the laser light through a plurality of optical elements while scanning the laser light L with a polygon mirror being driven to rotate. After this, toner images of the respective colors formed on the photoconductors 41 (M, C, and K) through the developing step are transferred onto the intermediate transfer belt 48.

At this time, the intermediate transfer belt 48 passes through the first transfer nips of the respective first transfer bias rollers 49 (Y, M, C, and K) sequentially by running in the arrow direction of FIG. 2. Through this, the toner images of the respective colors on the photoconductors 41 (Y, M, C, and K) are first-transferred onto the intermediate transfer belt 48 and overlaid, and thereby a color toner image is formed on the intermediate transfer belt 48.

The intermediate transfer belt 48 on which the color toner image is formed with the toner images of the respective colors transferred and overlaid reaches a position facing the second transfer roller 89. At this position, the second transfer backup roller 82 forms a second transfer nip by sandwiching the intermediate transfer belt 48 between itself and the second transfer roller 89. Then, the color toner image formed on the intermediate transfer belt 48 is transferred by the effect of, for example, a transfer bias applied to the second transfer backup roller 82 onto a recording medium P such as a transfer sheet transferred to the position of the second transfer nip. At this time, un-transferred toner that has not been transferred onto the recording medium P remains on the intermediate transfer belt 48. The intermediate transfer belt 48 having passed through the second transfer nip reaches the position of the unillustrated intermediate transfer cleaning device, and has the un-transferred toner on the surface thereof collected. In this way, the series of transfer process performed on the intermediate transfer belt 48 is completed.

Next, the behavior of the recording medium P will be explained.

The recording medium P conveyed to the second transfer nip described above is transferred thereto via a sheet feeding roller 27, a registration roller pair 28, etc., from a sheet feeding tray 26 provided in the sheet feeding section 200 provided below the printer section 100.

Specifically, a plurality of sheets of recording media P are overlaid and stocked in the sheet feeding tray 26. When the sheet feeding roller 27 is driven to rotate in the counterclockwise direction in FIG. 2, the topmost recording medium P is conveyed to a roller nip formed by the two rollers of the registration roller pair 28.

The recording medium P conveyed to the registration roller pair 28 stops once at the position of the roller nip of the registration roller pair 28 stopped from being driven to rotate. Then, by the registration roller pair 28 being started to rotate so as to be in time for the color toner image on the intermediate transfer belt 48 to arrive at the second transfer nip, the recording medium P is conveyed to the second transfer nip. In this way, a desired color toner image is transferred onto the recording medium P.

The recording medium P onto which the color toner image is transferred at the second transfer nip is conveyed to the position of a fixing device 86. Through the fixing device 86, the color toner image transferred onto the surface is fixed on the recording medium P with heat and pressure applied by a fixing belt and a pressurizing roller. The recording medium P passed through the fixing device 86 is discharged to the outside of the apparatus through the gap between the rollers of a sheet discharging roller pair 29. The recording medium P discharged to the outside of the apparatus by the sheet discharging roller pair 29 is stacked sequentially on a stacking section 30 as an output image. In this way, the series of image forming process in the copier 500 is completed.

Next, the configuration and operation of the developing device 50 in the image forming unit 46 will be explained in greater detail. The explanation will be given by taking the image forming unit 46Y corresponding to yellow for example. However, the image forming units 46 (M, C, and K) corresponding to the other colors have also the same configuration and operation.

As shown in FIG. 3, the developing device 50Y includes a developing roller 51Y as a developer bearing member, a doctor blade 52Y as a developer regulating plate, two developer conveying screws 55Y, a toner concentration detecting sensor 56Y, etc. The developing roller 51Y faces the photoconductor 41Y, and the doctor blade 52Y faces the developing roller 51Y. The two developer conveying screws 55Y are provided in two developer receptacles (53Y and 54Y). The developing roller 51Y is constituted by a magnet roller fixed thereinside, a sleeve rotating along the circumference of the magnet roller, etc. The first developer receptacle 53 and the second developer receptacle 54Y contain a two-component developer G composed of a carrier and a toner. The second developer receptacle 54Y communicates with a toner fall-down conveying path 64Y through an opening formed at the top thereof. The toner concentration detecting sensor 56Y detects the toner concentration in the developer G in the second developer receptacle 54Y.

The developer G in the developing device 50 circulates to and from the first developer receptacle 53Y and the second developer receptacle 54Y while being stirred by the two developer conveying screws 55Y. The developer G in the first developer receptacle 53Y is conveyed by one of the developer conveying screws 55Y, and supplied onto and borne by the surface of the sleeve of the developing roller 51Y by the effect of a magnetic field formed by the magnet roller in the developing roller 51Y. The sleeve of the developing roller 51Y is driven to rotate in the counterclockwise direction as indicated by an arrow in FIG. 3, and the developer G borne on the developing roller 51Y moves over the developing roller 51Y along with the rotation of the sleeve. At this time, the toner in the developer G is frictioned with the carrier in the developer G to be electrically charged to a potential of an opposite polarity to the carrier and electrostatically adsorbed to the carrier, to be thereby borne on the developing roller 51Y together with the carrier attracted to the magnetic field formed on the developing roller 51Y.

The developer G borne on the developing roller 51Y is conveyed in the arrow direction of FIG. 3 and reaches a doctor region at which the doctor blade 52Y and the developing roller 51Y face each other. When the developer G on the developing roller 51Y passes the doctor region, the amount of the developer is regulated and optimized. After this, the developer G is conveyed to a developing region, which is a position at which the developer faces the photoconductor 41Y. In the developing region, the toner in the developer G is adsorbed to a latent image that is formed on the photoconductor 41Y by a developing electric field formed between the developing roller 51Y and the photoconductor 41Y. The developer G remained on the surface of the developing roller 51Y passed through the developing region reaches above the first developer receptacle 53Y along with the rotation of the sleeve, and is detached from the developing roller 51Y at this position.

The toner concentration of the developer G in the developing device 50Y is adjusted to a certain range. Specifically, the toner housed in a toner housing container 32Y is replenished into the second developer receptacle 54Y through the toner replenishing device 60Y according to the amount of consumption of the toner contained in the developer G in the developing device 50Y along with development. The toner replenished into the second developer receptacle 54Y is mixed and stirred with the developer G by the two developer conveying screws 55Y, and circulates to and from the first developer receptacle 53Y and the second developer receptacle 54Y.

Next, the toner replenishing device 60 (Y, M, C, and K) will be explained.

Figure 4:
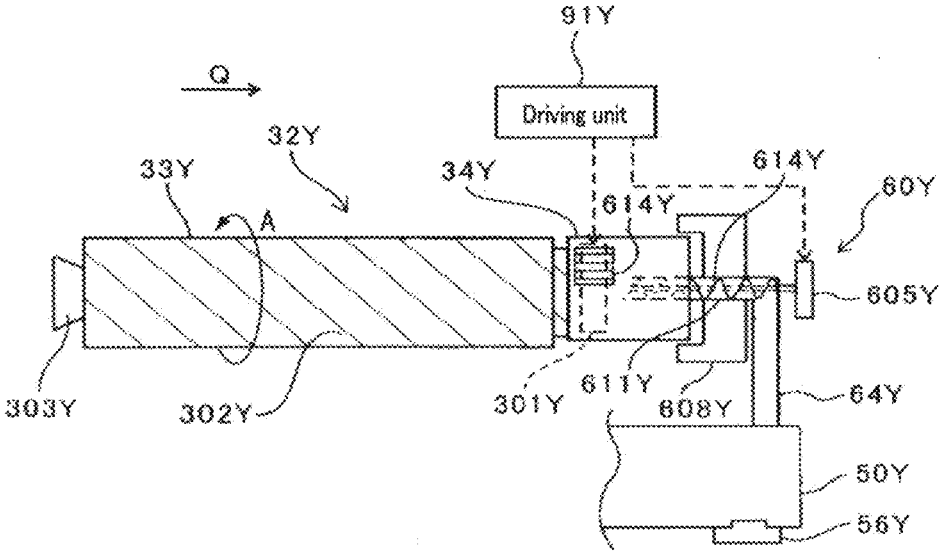
FIG. 4 is an exemplary diagram showing a state that a toner housing container is set in a toner replenishing device of the image forming apparatus shown in FIG. 2.

FIG. 4 is an exemplary diagram showing a state that the toner housing container 32Y is mounted on the toner replenishing device 60Y.

Figure 5:
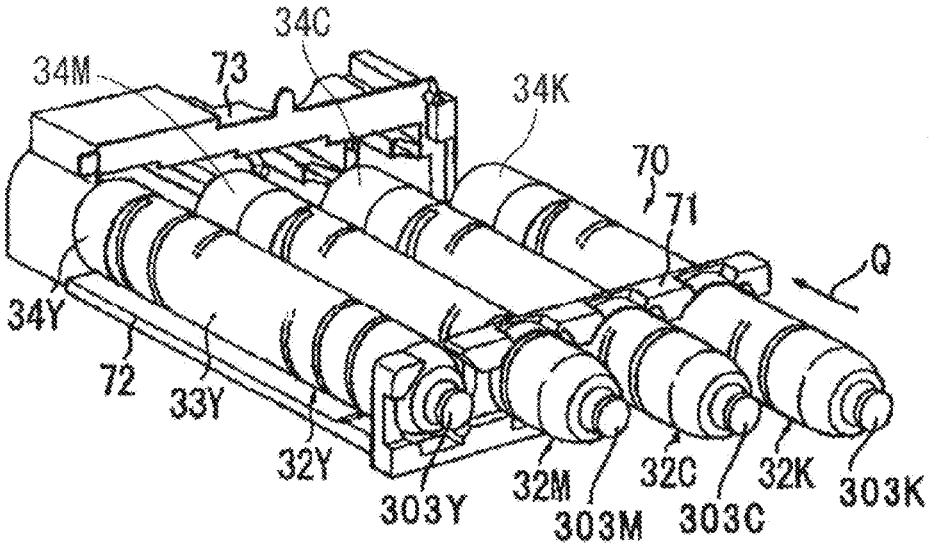
FIG. 5 is a schematic perspective diagram showing an example state that a toner housing container is set in a toner replenishing device.

FIG. 5 is a schematic perspective diagram showing a state that four toner housing containers 32 (Y, M, C, and K) are mounted in the toner housing container accommodating section 70.

The toners in the toner housing containers 32 (Y, M, C, and K) mounted in the toner housing container accommodating section 70 of the printer section 100 are appropriately replenished into the developing devices 50 (Y, M, C, and K) according to the consumption of the toners in the developing devices 50 (Y, M, C, and K) for the respective colors, as shown in FIG. 4. At this time, the toners in the toner housing containers 32 (Y, M, C, and K) are replenished by the corresponding toner replenishing devices 60 (Y, M, C, and K) provided per toner color. The four toner replenishing devices 60 (Y, M, C, and K) and four toner housing containers 32 (Y, M, C, and K) have substantially the same configuration, except for using toners of different colors for the image forming process. Therefore, in the following, explanation will be given only on the toner replenishing device 60Y and toner housing container 32Y corresponding to yellow, and explanation on the toner replenishing devices 60 (M, C, and K) and toner housing containers 32 (M, C, and K) corresponding to the other three colors will be skipped appropriately.

The toner replenishing device 60 (Y, M, C, and K) is constituted by the toner housing container accommodating section 70, a conveying nozzle 611 (Y, M, C, and K) as a conveying pipe, a conveying screw 614 (Y, M, C, and K) as a conveying member, a toner fall-down conveying path 64 (Y, M, C, and K), a container rotation driving unit 91 (Y, M, C, and K), etc.

For the expediency of explanation, a later-described container opening portion 33*a* side of a container body 33 of the toner housing container 32Y is defined as the container leading end side, and the side opposite to the container opening portion 33*a* (i.e., a later-described gripping portion 303 side) is defined as a container rear end side, based on the direction in which the toner housing container 32Y is mounted onto the toner replenishing device 60Y. When the toner housing container 32Y is moved in the direction of an arrow Q in FIG. 4 and mounted in the toner housing container accommodating section 70 of the printer section 100, in conjunction with this mounting motion, the conveying nozzle 611Y of the toner replenishing device 60Y is inserted into the toner housing container 32Y through the container leading end side thereof. As a result, the interior of the toner housing container 32Y and the interior of the conveying nozzle 611Y come into communication with each other. The mechanism of this establishment of communication in conjunction with the mounting motion will be described later in detail.

As for the form of the toner housing container, the toner housing container 32Y is an approximately cylindrical toner bottle. The toner housing container 32Y is mainly constituted by a container leading end side cover 34Y held non-rotatably on the toner housing container accommodating section 70, and a container body 33Y as a toner housing member with which a container gear 301Y is formed integrally. The container body 33Y is held rotatably relative to the container leading end side cover 34Y.

As shown in FIG. 5, the toner housing container accommodating section 70 is mainly constituted by a container cover receiving section 73, a container receiving section 72, and an insertion port forming section 71.

The container cover receiving section 73 is a section in which the container leading end side cover 34Y of the toner housing container 32Y is held. The container receiving section 72 is a section on which the container body 33Y of the toner housing container 32Y is supported. The insertion port forming section 71 is a section that constitutes an insertion port for an operation of mounting the toner housing container 32Y onto the container receiving section 72. When an unillustrated body cover provided at the front side (i.e., a front side in the direction perpendicular to the sheet in which FIG. 2 is drawn) of the copier 500 is opened, the insertion port forming section 71 of the toner housing container accommodating section 70 appears. Then, while keeping the longer direction of the toner housing containers 32 (Y, M, C, and K) extending in the horizontal direction, an operation of mounting or demounting the toner housing containers 32 (Y, M, C, and K) (i.e., a mounting/demounting operation oriented in the longer direction of the toner housing containers 32 as a mounting/demounting direction) is performed from the front side of the copier 500. A set cover 608Y in FIG. 4 is part of the container cover receiving section 73 of the toner housing container accommodating section 70.

The container receiving section 72 is formed such that the length thereof in the longer direction is substantially the same as the length of the container body 33Y in the longer direction. The container cover receiving section 73 is provided at the container leading end side of the container receiving section 72 in the longer direction (mounting/demounting direction) thereof, and the insertion port forming section 71 is provided at one end side of the container receiving section 72 in the longer direction thereof. In FIG. 5, grooves, of which longer direction extends in the axial direction of the container bodies 33, are formed immediately below the four toner housing containers 32 so as to extend from the insertion port forming section 71 to the container cover receiving section 73. A pair of slide guides 361 (FIG. 7) are provided at the lower portion of the container leading end side cover 34 on both sides of the container leading end side cover, in order to allow the container body to fit with the groove and make a sliding move. The groove of the container receiving section 72 is provided with a pair of slide rails that protrude from both sides thereof. So as to sandwich the pair of slide rails from above and below respectively, slide grooves 361*a* are formed in the slide guides 361 in parallel with the axis of rotation of the container body 33. The container leading end side cover 34 includes a container locking portion 339 that engages with a replenishing device side locking member provided on the set cover 608 upon mounting on the toner replenishing device 60.

Hence, along with the operation of mounting the toner housing container 32Y, the container leading end side cover 34Y slides over the container receiving section 72 for a while after passing through the insertion port forming section 71, and after this, gets mounted on the container cover receiving section 73.

Figure 6:
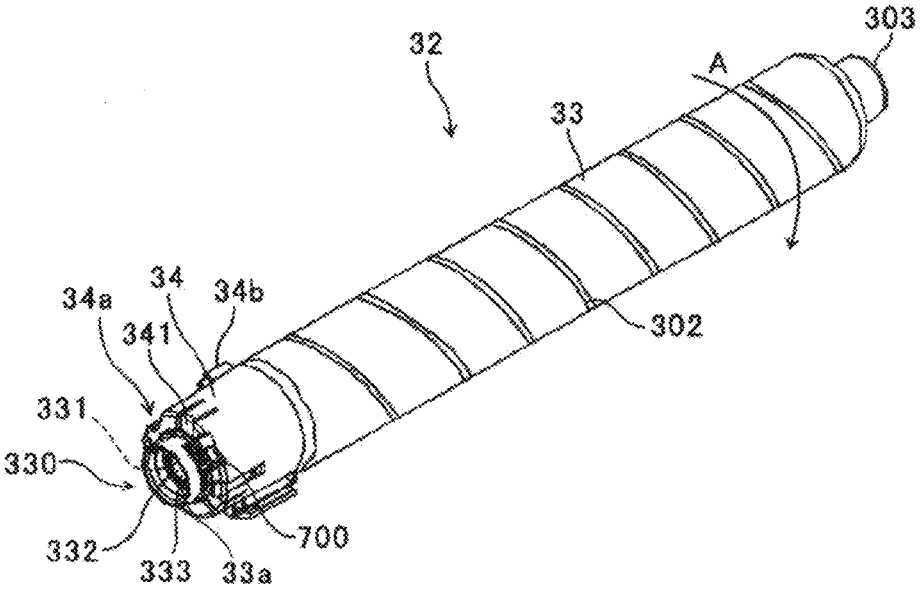
FIG. 6 is a perspective explanatory diagram showing an example configuration of a toner housing container of the present invention.

As shown in FIG. 6, the container leading end side cover 34 is provided with an ID tag (ID chip) 700 in which usage context of the toner housing container 32 and such data are recorded. The container leading end side cover 34 is also provided with a color-incompatible rib 34*b* that prevents a toner housing container 32 housing a toner of a given color from being mounted on the set cover 608 for a different color. The posture of the container leading end side cover 34 on the replenishing device 60 is determined when the slide guides 361 engage with the slide rails of the container receiving section 72 in the mounting operation.

This allows the container locking portion 339 to be positionally aligned with the replenishing device side locking member 609 smoothly and the ID tag 700 to be positionally aligned with a connector on the apparatus body smoothly. The ID tag is an electronic substrate provided with a memory element for storing information of the toner housing container (the color of the toner housed, how many times the container is used, etc.), and is not limited to as described in the present embodiment. The system may not include the ID tag.

Figure 8:
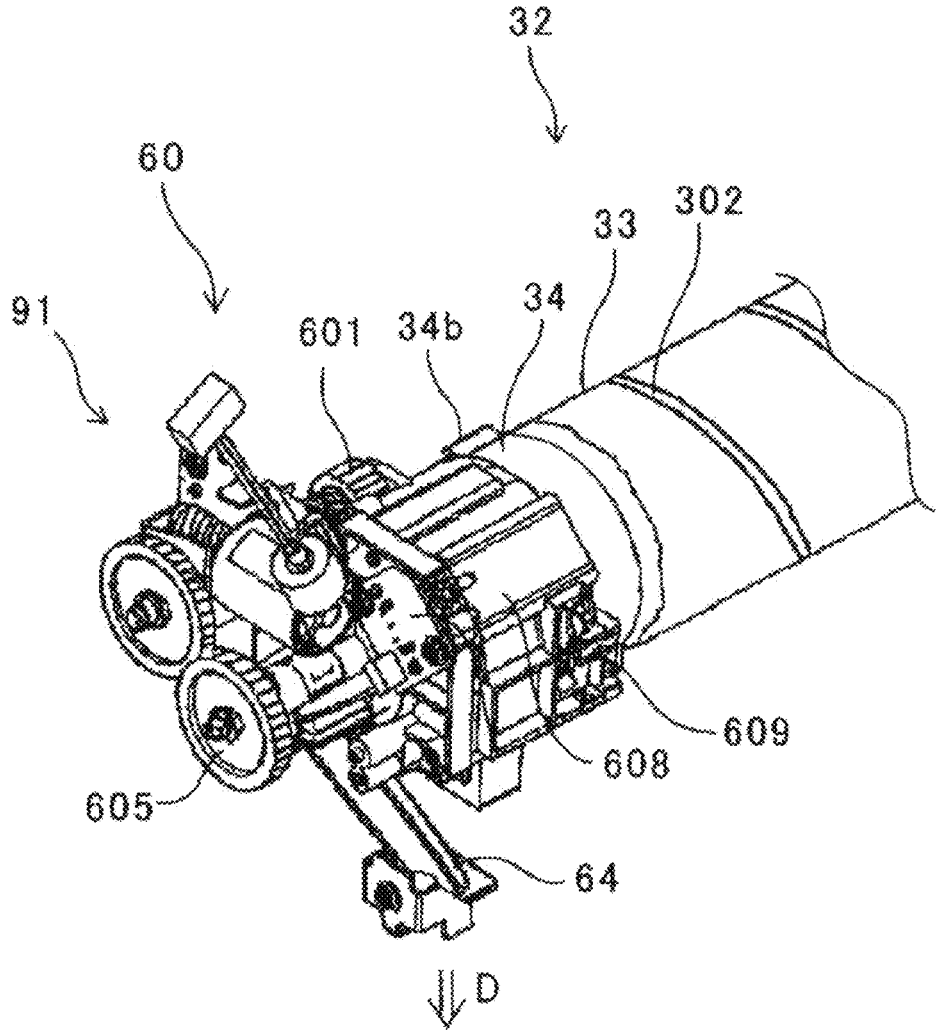
FIG. 8 is a perspective explanatory diagram of an example of a toner conveying device mounted with a toner housing container and the toner housing container.

In the state that the container leading end side cover 34Y is mounted on the container cover receiving section 73, rotation driving is input to the container gear 301Y (FIG. 10) provided on the container body 33Y from the container rotation driving unit 91Y constituted by a driving motor, a driving gear, etc. through a container driving gear 601Y as shown in FIG. 8. As a result, the container body 33Y is driven to rotate in the direction of the arrow A in FIG. 4. The rotation of the container body 33Y causes rotation of also a spiral projection 302Y (rotary conveying portion) formed in a spiral form on the internal circumferential surface of the container body 33Y, to thereby convey the toner housed in the container body 33Y along the longer direction of the container body from one end (i.e., the gripping portion 303 side) located at the left-hand side of FIG. 4 to the other end (i.e., the container opening portion 33*a* side) located at the right-hand side. As a result, the toner is supplied into the conveying nozzle 611Y from the container leading end side cover 34Y provided at the other end 33. In other words, the rotation of the spiral projection 302Y causes the toner to be supplied into the conveying nozzle 611Y inserted into a nozzle receiving port 331Y.

A conveying screw 614Y is provided in the conveying nozzle 611Y.

The conveying screw 614Y rotates upon input of rotation driving into a conveying screw gear 605Y from the container rotation driving unit 91Y, and conveys the toner supplied into the conveying nozzle 611Y. The conveying direction downstream end of the conveying nozzle 611Y is connected to the toner fall-down conveying path 64Y. The toner conveyed by the conveying screw 614Y falls through the toner fall-down conveying path 64Y by its own weight and is replenished into the developing device 50Y (the second developer receptacle 54Y).

When the toner housing containers 32 (Y, M, C, and K) have expired (i.e., when the containers have become empty with almost all of the housed toner consumed), they are replaced with new ones respectively.

The toner housing container 32 is provided with the gripping portion 303 at a longer-direction one end thereof that is opposite to the container leading end side cover 34. For the replacement, the replacement personnel can remove the mounted toner housing container 32 by gripping the gripping portion 303 and withdrawing the container.

The toner replenishing device 60Y controls the amount of toner to be supplied into the developing device 50Y based on the rotation speed of the conveying screw 614Y. Hence, the toner having passed through the conveying nozzle 611Y is directly conveyed into the developing device 50Y through the toner fall-down conveying path 64Y with the amount of supply into the developing device 50 uncontrolled. Even the toner replenishing device 60Y, of which conveying nozzle 611Y is inserted into the toner housing container 32Y as in the present embodiment, may be provided with a first toner reservoir such as a toner hopper.

The toner replenishing device 60Y of the present embodiment is configured to convey the toner supplied into the conveying nozzle 611Y by the conveying screw 614Y. However, the conveying member for conveying the toner supplied into the conveying nozzle 611Y is not limited to a screw member. For example, a mechanism for imparting a conveying force by means of a member other than a screw member may also be employed, such as a mechanism for generating a negative pressure at the opening of the conveying nozzle 611Y by means of a well-known powder pump.

Next, the toner housing containers 32 (Y, M, C, and K) and the toner replenishing devices 60 (Y, M, C, and K) of the present embodiment will be explained in greater detail. As described above, the toner housing containers 32 (Y, M, C, and K) and the toner replenishing devices 60 (Y, M, C, and K) have substantially the same configuration, except for using different colors of toners. Hence, the following explanation will be given by omitting the suffixes Y, M, C, and K representing the colors of the toners.

Figure 7:
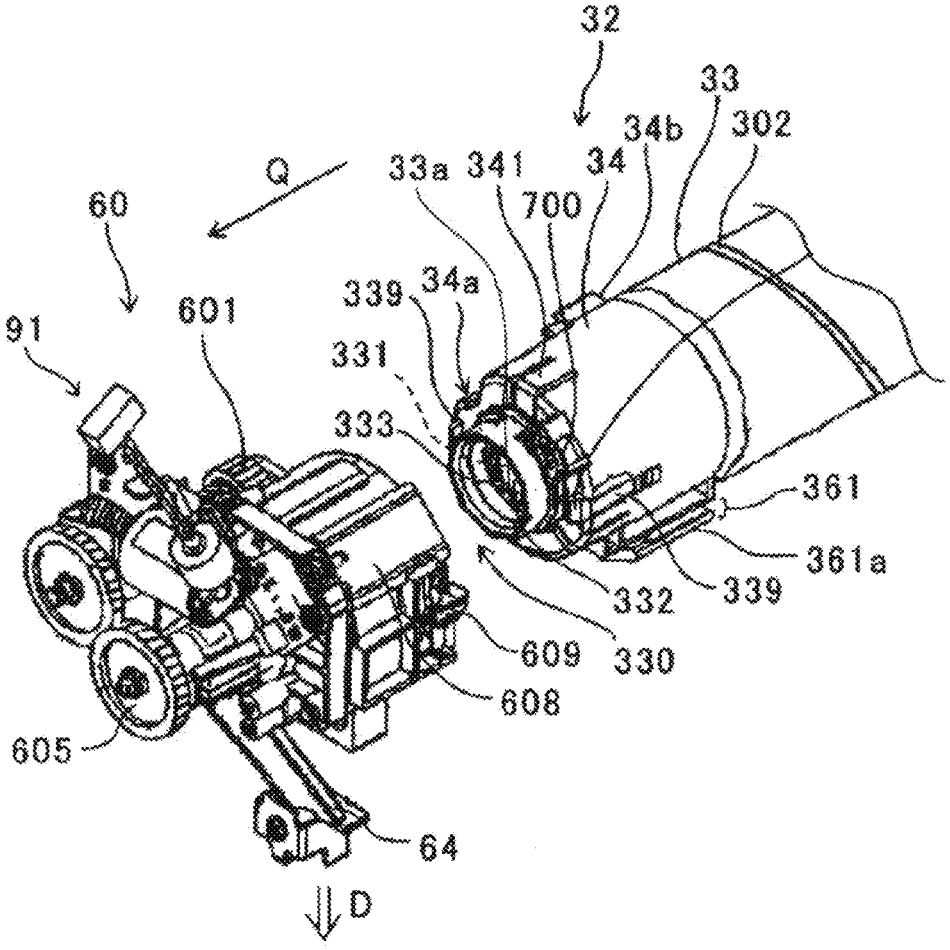
FIG. 7 is a perspective explanatory diagram of an example of a toner conveying device before mounted with a toner housing container and the toner housing container.

FIG. 6 is a perspective diagram explaining the toner housing container 32. FIG. 7 is a perspective diagram explaining the toner replenishing device 60 before mounted with the toner housing container 32 and the leading end of the toner housing container 32. FIG. 8 is a perspective diagram explaining the toner replenishing device 60 mounted with the toner housing container 32, and the container leading end of the toner housing container 32.

Figure 9:
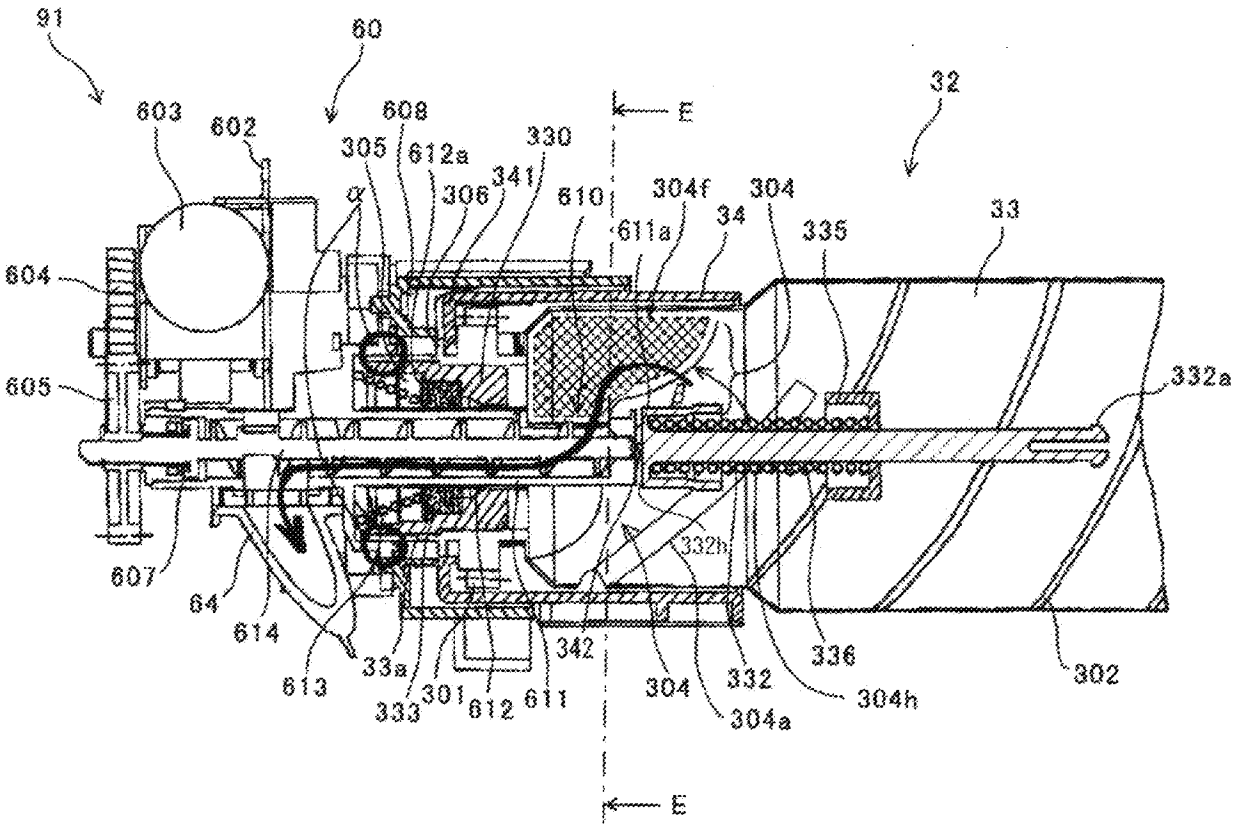
FIG. 9 is a cross-sectional explanatory diagram of an example of a toner conveying device mounted with a toner housing container and the toner housing container.

FIG. 1 is a cross-sectional diagram explaining the toner replenishing device 60 before mounted with the toner housing container 32 and the container leading end of the toner housing container 32. FIG. 9 is a cross-sectional diagram explaining the toner replenishing device 60 mounted with the toner housing container 32 and the container leading end of the toner housing container 32.

The toner replenishing device 60 includes the conveying nozzle 611 in which the conveying screw 614 is provided, and a nozzle shutter 612. The nozzle shutter 612 closes a nozzle opening 610 formed in the conveying nozzle 611 while in a non-mounted state (the state of FIG. 1 and FIG. 7) before mounted with the toner housing container 32, and opens the nozzle opening 610 while in a mounted state (the state of FIG. 8 and FIG. 9) after mounted with the toner housing container 32. On the other hand, a nozzle receiving port 331 as a pipe insertion port into which the conveying nozzle 611 is inserted while in the mounted state is formed in the center of the leading end surface of the toner housing container 32, and there is provided a container shutter 332 as an opening/closing member for closing the nozzle receiving port 331 while in the non-mounted state.

First, the toner housing container 32 will be explained.

Figure 10:
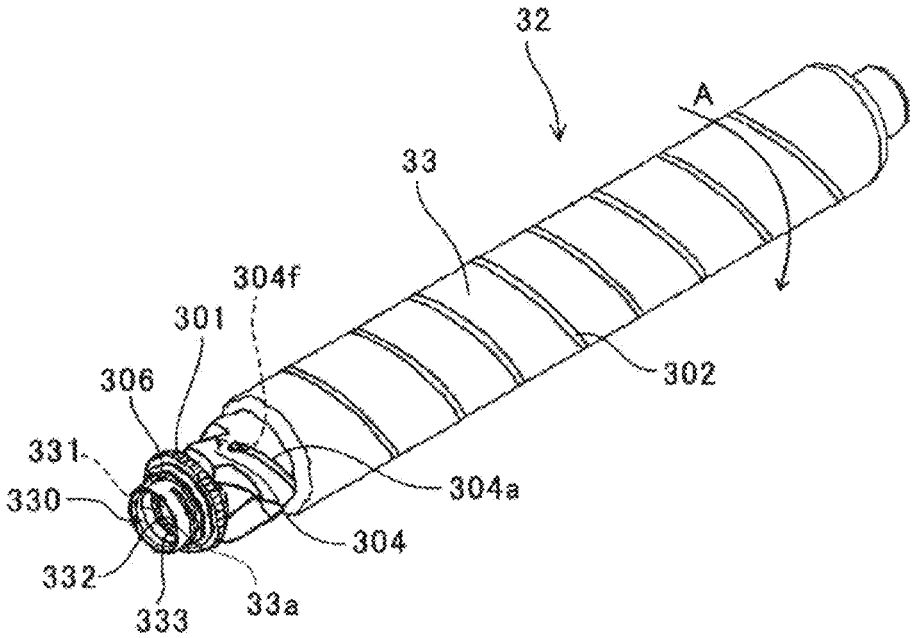
FIG. 10 is a perspective explanatory diagram of an example toner housing container in a state that a cover at the leading end is removed.

As described above, the toner housing container 32 is mainly constituted by the container body 33 and the container leading end side cover 34. FIG. 10 is a perspective diagram explaining a state of the toner housing container 32 from which the container leading end side cover 34 is removed from the state of FIG. 6. Note that the toner housing container 32 of the present invention is not limited to one that is mainly constituted by the container body 33 and the container leading end side cover 34. For example, when omitting the functions of the container leading end side cover 34 such as the slide guides 361 and the ID tag 700, the toner housing container may be used in the state of FIG. 10 in which there is no container leading end side cover 34. Further, the toner housing container can be free from the container leading end side cover by having such functions as the slide guides 361 and the ID tag 700 on the toner housing container.

Figure 11:
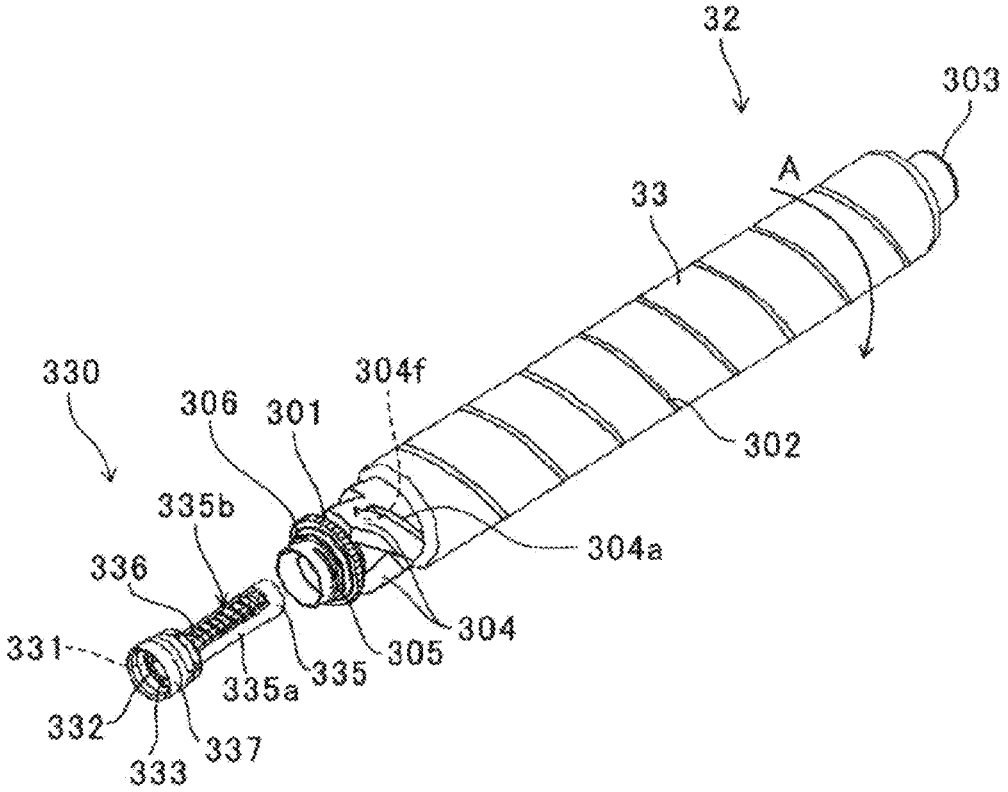
FIG. 11 is a perspective explanatory diagram of an example toner housing container in a state that a nozzle receiving member is removed from a container body.
Figure 12:
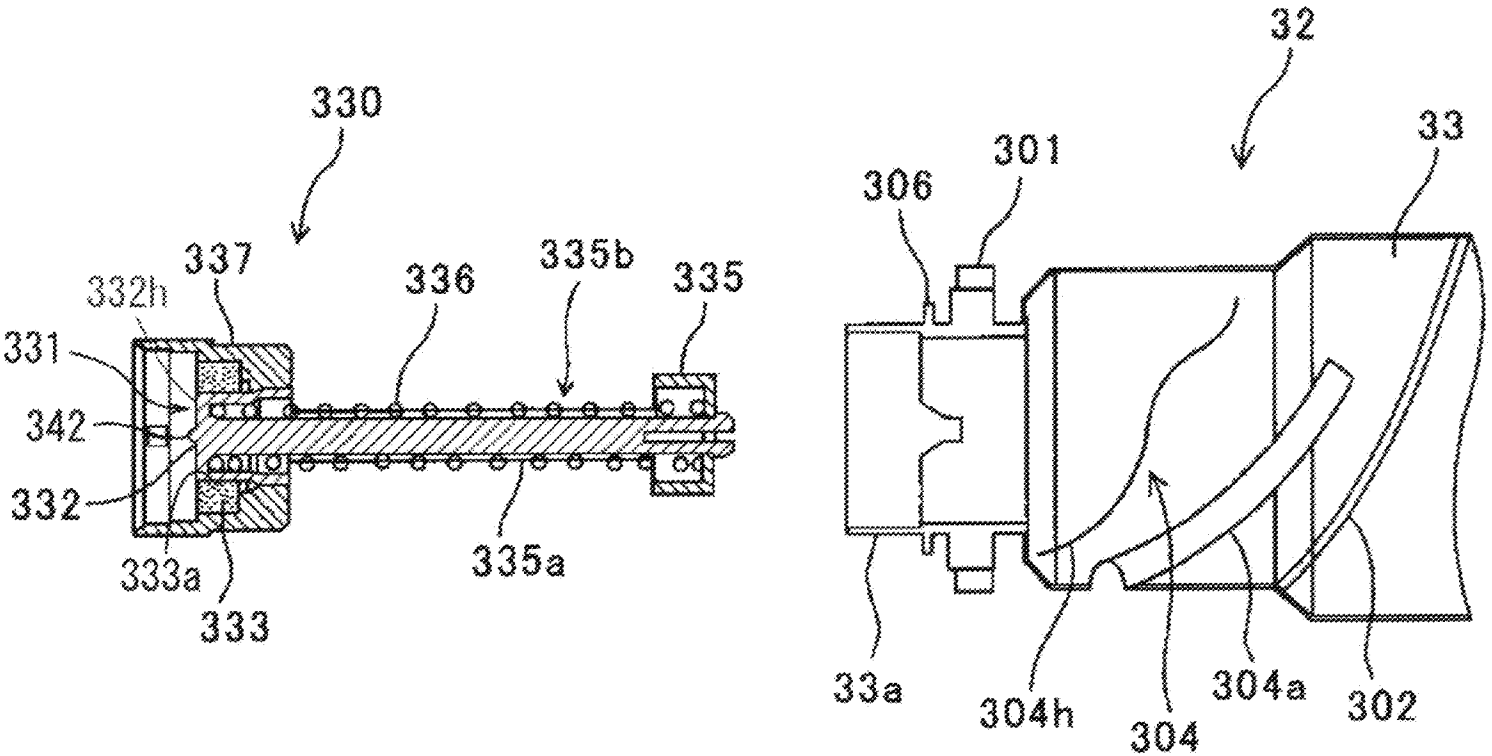
FIG. 12 is a cross-sectional explanatory diagram of an example toner housing container in a state that a nozzle receiving member is removed from a container body.
Figure 13:
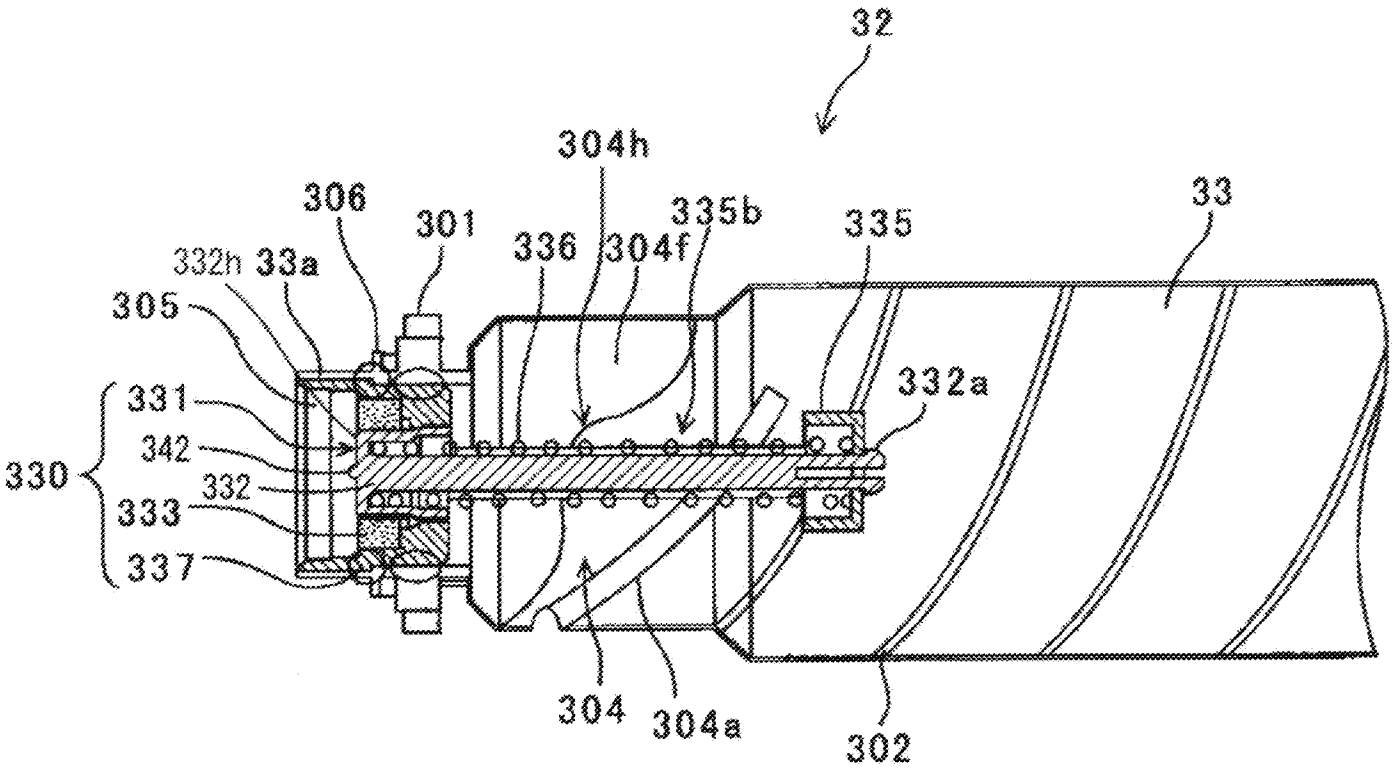
FIG. 13 is a cross-sectional explanatory diagram of an example toner housing container in a state that the nozzle receiving member is mounted on the container body from the state of FIG. 12.

FIG. 11 is a perspective diagram explaining a state of the toner housing container 32 from which a nozzle receiving member 330 as a pipe insertion member is removed from the container body 33 from the state of FIG. 10. FIG. 12 is a cross-sectional diagram explaining the state of the toner housing container 32 from which the nozzle receiving member 330 is removed from the container body 33. FIG. 13 is a cross-sectional diagram explaining a state of the toner housing container 32 mounted with the nozzle receiving member 330 on the container body 33 from the state of FIG. 12 (a state of the toner housing container 32 from which the container leading end side cover 34 is removed as in FIG. 10).

As shown in FIG. 10 and FIG. 11, the container body 33 is approximately cylindrical, and configured to rotate about the center axis of the cylinder as the rotation axis. Hereinafter, a direction parallel with this rotation axis will be referred to as "rotation axis direction", and a side in the rotation axis direction at which the nozzle receiving port 331 of the toner housing container 32 is formed (i.e., a side at which the container leading end side cover 34 is provided) will be referred to as "container leading end side". A side at which the gripping portion 303 of the toner housing container 32 is provided (i.e., a side opposite to the container leading end side) will be referred to as "container rear end side".

The aforementioned longer direction of the toner housing container 32 is the rotation axis direction. When the toner housing container 32 is mounted on the toner replenishing device 60, the rotation axis direction is a horizontal direction. A portion of the container body 33 that is on the container rear end side from the container gear 301 has an external diameter greater than the container leading end side, and the spiral projection 302 is formed on the internal circumferential surface of this portion. When the container body 33 rotates in the direction of the arrow A in the drawing, a conveying force to move from the rotation axis direction one end side (the container rear end side) to the other end side (the container leading end side) is imparted to the toner in the container body 33 by the effect of the spiral projection 302. That is, the spiral projection as a conveying portion is provided inside the container body.

Figure 31:
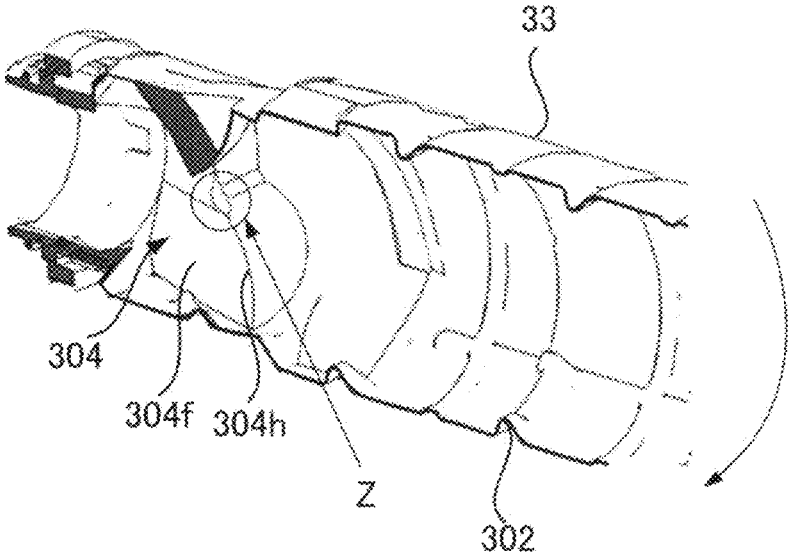
FIG. 31 is a perspective cross-sectional diagram showing a configuration of a toner housing container of the present invention.

An uplifting portion 304 is formed on the internal wall of the container body 33 at the container leading end side. When the toner is conveyed to the container leading end side by the spiral projection 302 along with rotation of the container body 33 in the direction of the arrow A of FIG. 10 and FIG. 11, the uplifting portion 304 uplifts the conveyed toner upward by means of the rotation of the container body 33. The uplifting portion 304 is constituted by bosses **304*h* and uplifting wall surfaces 304*f* as shown in FIG. 13 and FIG. 31**.

The boss **304*h* is a portion (rising portion) that rises inward in the container body 33 toward the center of rotation of the container body 33 while forming a spiral like a ridge line of a mountain. The uplifting wall surface 304*f* is a wall surface that connects the boss 304*h* with the internal circumferential wall of the container body 33 and that is on the container-rotation-direction downstream side of the boss 304*h***.

When the toner comes into an internal space facing the uplifting portion 304 by the conveying force of the spiral projection 302 while the uplifting wall surface **304*f* is located at the lower side, the uplifting wall surface 304*f* uplifts the toner upward along with rotation of the container body 33. This enables the toner to be uplifted above the inserted conveying nozzle 611**. That is, the toner is uplifted from the lower side to the upper side.

When the rotation advances further, the toner uplifted by the uplifting wall surface **304*f*** slips off from the uplifting wall surface due to the gravity force, or collapses and falls down.

The conveying nozzle 611, which is a later-described conveying pipe on the apparatus body, is present at where the toner slips off to.

Therefore, the toner is moved into a nozzle opening of the conveying pipe.

Figure 30:
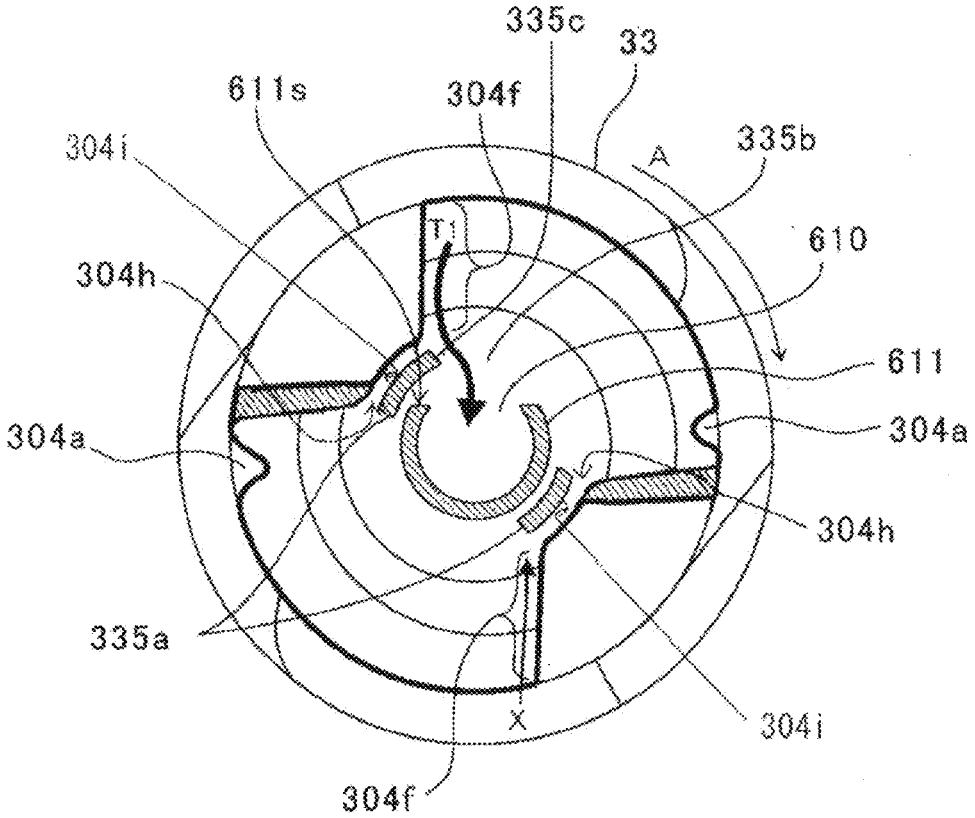
FIG. 30 is a cross-sectional diagram of FIG. 9 taken along a line E-E.

FIG. 30 is a cross-sectional diagram taken along a line E-E of FIG. 9. As shown in FIG. 30, a boss **304*h* is shaped like a gentle mountain as influenced by the container body 33** being formed by blow molding.

In FIG. 9, etc., a boss **304*h* is expressed with a curve for the convenience of distinguishing the uplifting portion 304. An uplifting wall surface 304*f* is a region expressed with grating as in FIG. 9, and so as to be in a point symmetry with respect to the rotation axis of the container body 33 as shown in FIG. 30, there are a pair of inclined surfaces constituting uplifting wall surfaces 304*f* connecting the bosses 304*h* with the internal circumferential surface of the container body 33**.

The boss **304*h* is provided so as to protrude from the container internal wall surface from which it rises toward the opposite internal wall surface facing this internal wall surface, and so as to extend continuously in the direction toward the opening portion. In the region represented by the cross-section taken along the line E-E of FIG. 9, an internal wall surface on the container-rotation-direction upstream side of the boss 304*h* appears as a thick wall as in FIG. 30, since the direction along the line E-E for sectioning FIG. 9 to obtain the cross-section and the extending direction of this internal wall surface are roughly the same. The boss 304*h*** is located at this seemingly thick portion.

Figure 32:
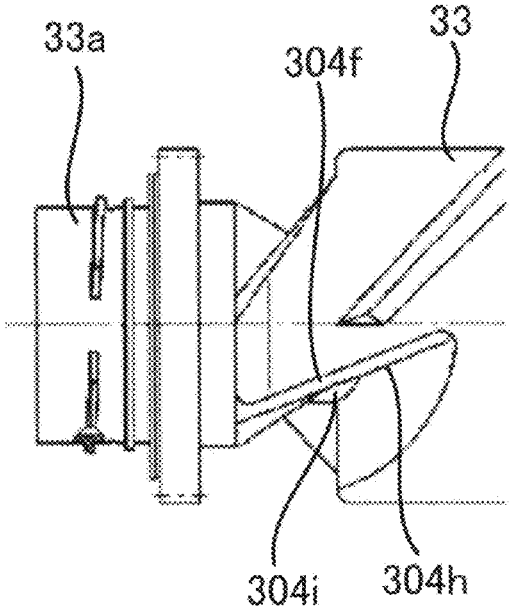
FIG. 32 is a side elevation showing a configuration of a toner housing container of the present invention.

Because of a further necessity of conveying the toner in the direction toward the container opening portion **33*a*, the uplifting wall surface 304*f* is inclined so as to be farther from the longer direction axial line (i.e., the dashed-dotted line in FIG. 32) of the container body 33 as the uplifting wall surface extends more from the boss 304*h* toward the container opening portion 33*a* as shown in FIG. 32**. With this configuration, when the uplifting wall surface uplifts the toner by rotating, the uplifting wall surface inclines toward the opening portion (i.e., a direction extending from the boss to the opening portion becomes not horizontal but oblique downward; to elaborate, the uplifting wall surface inclines outward in the radial direction of the container from the longer-direction axial line). This makes it easier for the toner to be conveyed in the direction toward the container opening portion.

The container gear 301 is formed at a more container leading end side of the container body 33 than the uplifting portion 304. The container leading end side cover 34 is provided with a gear exposing opening 34*a* from which a portion (at a deeper side of FIG. 6) of the container gear 301 is exposed when the container leading end side cover is mounted on the container body 33. When the toner housing container 32 is mounted on the toner replenishing device 60, the container gear 301 exposed from the gear exposing opening 34*a* engages with the container driving gear 601 of the toner replenishing device 60.

The container opening portion 33*a* having a cylindrical shape is formed at a more container leading end side of the container body 33 than the container gear 301. By press-fitting a receiving member fixing portion 337 of the nozzle receiving member 330 into the container opening portion 33*a*, it is possible to fix the nozzle receiving member 330 into the container body 33. The method for fixing the nozzle receiving member 330 is not limited to press fitting, but may be fixing with an adhesive and fixing by screwing.

The toner housing container 32 is configured such that a toner is filled into the container body 33 thereof from the opening of the container opening portion 33*a*, and after this, the nozzle receiving member 330 is fixed into the container opening portion 33*a* of the container body 33.

A cover claw hooking portion 306 is formed at the container gear 301 side end of the container opening portion 33*a* of the container body 33.

The container leading end side cover 34 is mounted on the toner housing container 32 (container body 33) being in the state shown in FIG. 10, from the container leading end side (the lower-left side of FIG. 10). As a result, the container body 33 extends through the container leading end side cover 34 in the rotation axis direction, and a cover claw 341 provided on the top portion of the container leading end side cover 34 is hooked in the cover claw hooking portion 306. The cover claw hooking portion 306 is formed so as to extend round the external circumferential surface of the container opening portion 33*a*. By the cover claw 341 being hooked, the container body 33 and the container leading end side cover 34 can be mounted on each other rotatably relative to each other.

The container body 33 is formed by biaxial stretching blow molding process. This biaxial stretching blow molding process is typically a two-stage process including a pre-form molding step and a stretching blow molding step. In the pre-form molding step, a resin is injection-molded into a pre-form having a test tube shape. By this injection molding, the container opening portion 33*a*, the cover claw hooking portion 306, and the container gear 301 are formed at the mouth portion of the test tube shape. In the stretching blow molding step, the pre-form that has been cooled after the pre-form molding step and released from the molding die is heated and softened, and after this, blow-molded and stretched.

The portions of the container body 33 that are on the container rear end side of the container gear 301 are molded in the stretching blow molding step. That is, the uplifting portion 304, the portion where the spiral projection 302 is formed, and the gripping portion 303 are molded in the stretching blow molding step.

The portions of the container body 33 that are on the container leading end side of the container gear 301, such as the container gear 301, the container opening portion 33*a*, the cover claw hooking portion 306, etc. remain as their shapes on the pre-form obtained by the injection molding, which ensures them a molding precision. On the other hand, the uplifting portion 304, the portion where the spiral projection 302 is formed, and the gripping portion 303 are stretched and molded in the stretching blow molding step after injection-molded, which results in a poorer molding precision than the portions obtained by the pre-form molding.

Next, the nozzle receiving member 330 fixed into the container body 33 will be explained.

Figure 14:
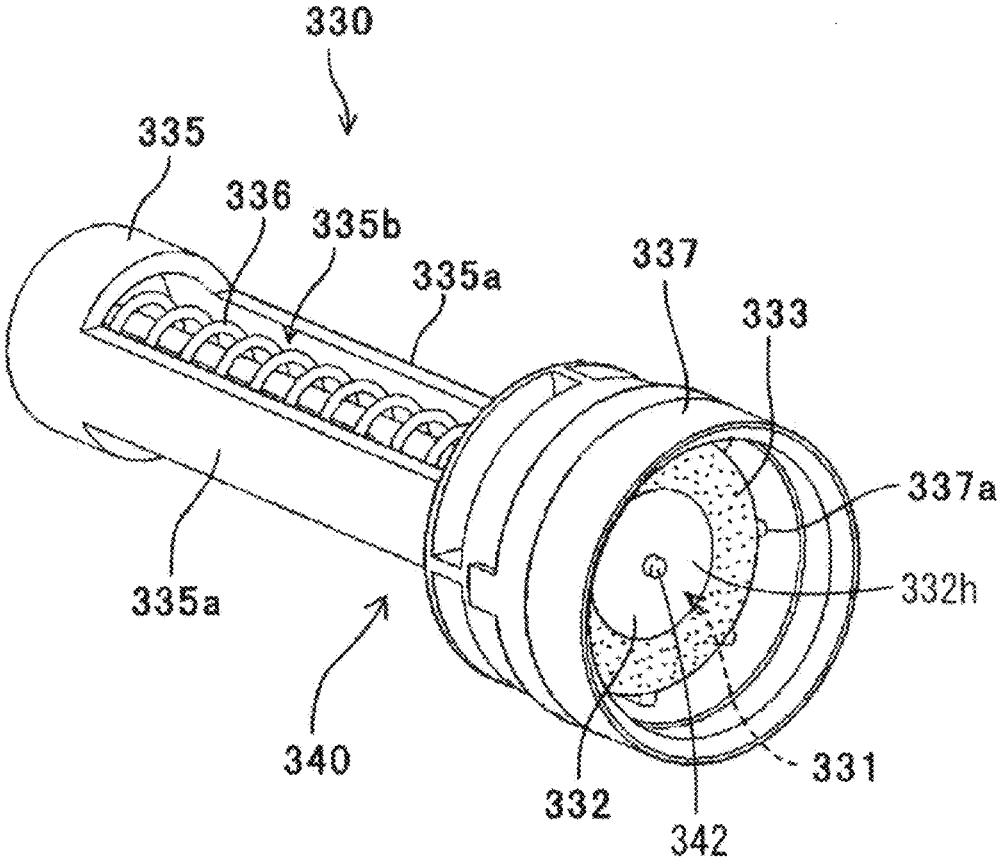
FIG. 14 is a perspective explanatory diagram of an example nozzle receiving member seen from a container leading end side.
Figure 15:
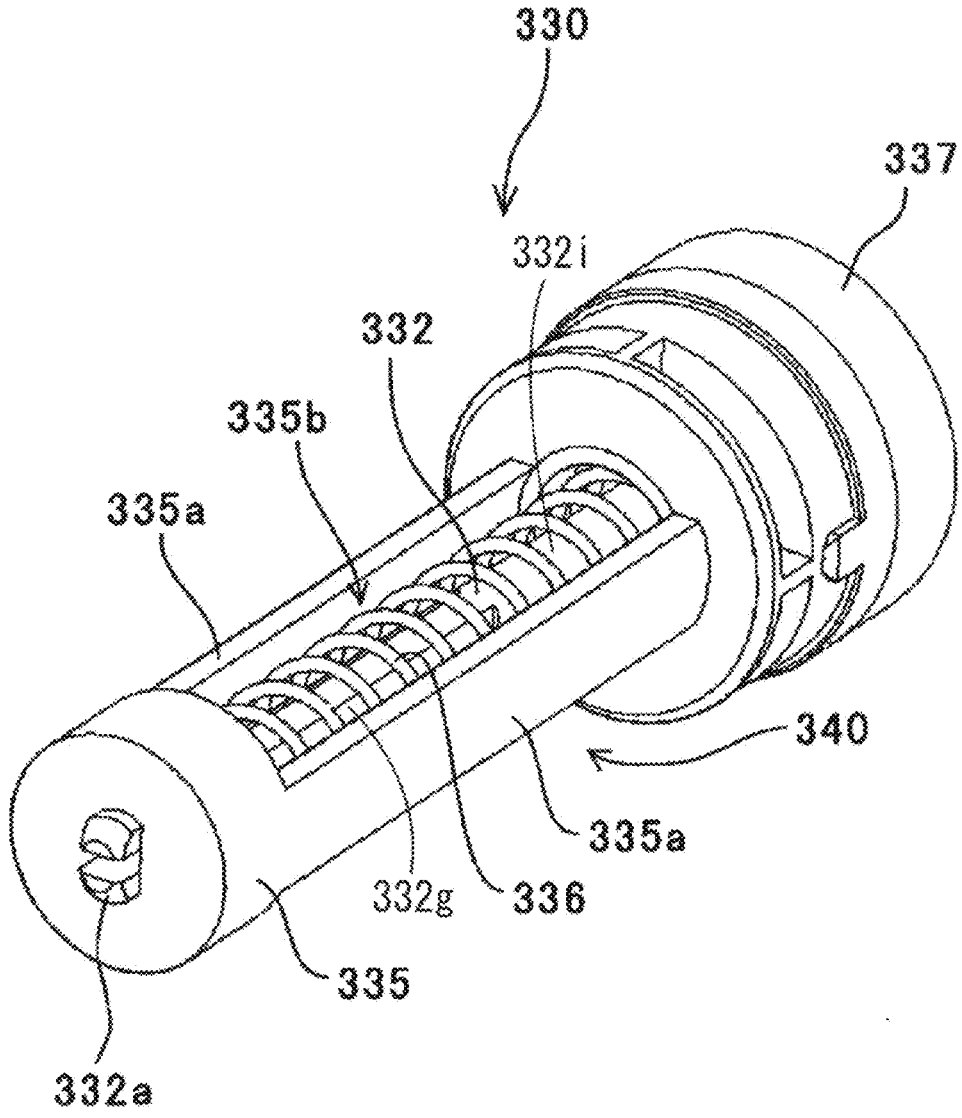
FIG. 15 is a perspective explanatory diagram of an example nozzle receiving member seen from a container rear end side.
Figure 16:
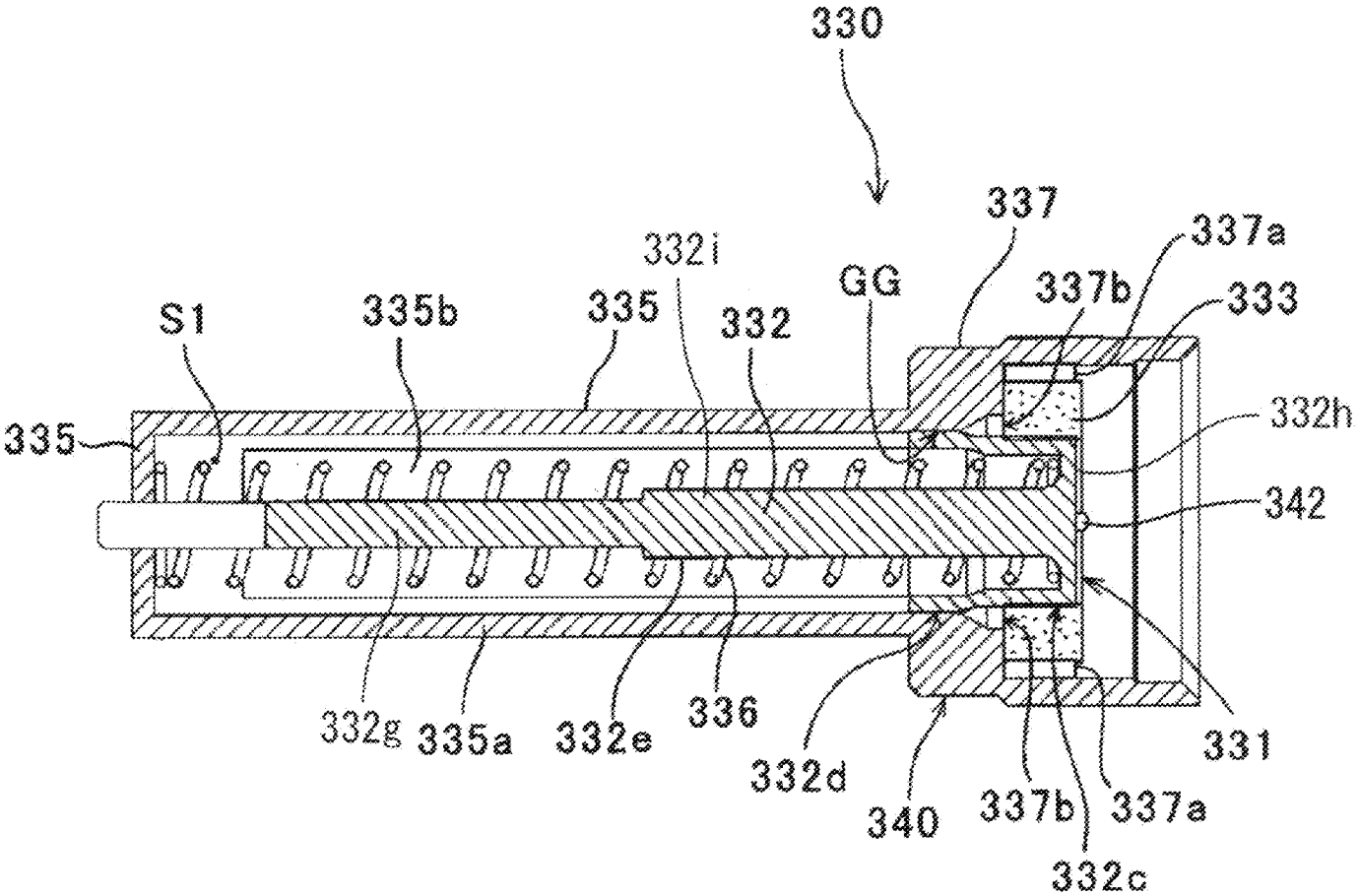
FIG. 16 is a cross-sectional diagram of an example nozzle receiving member in the state shown in FIG. 13.
Figure 17:
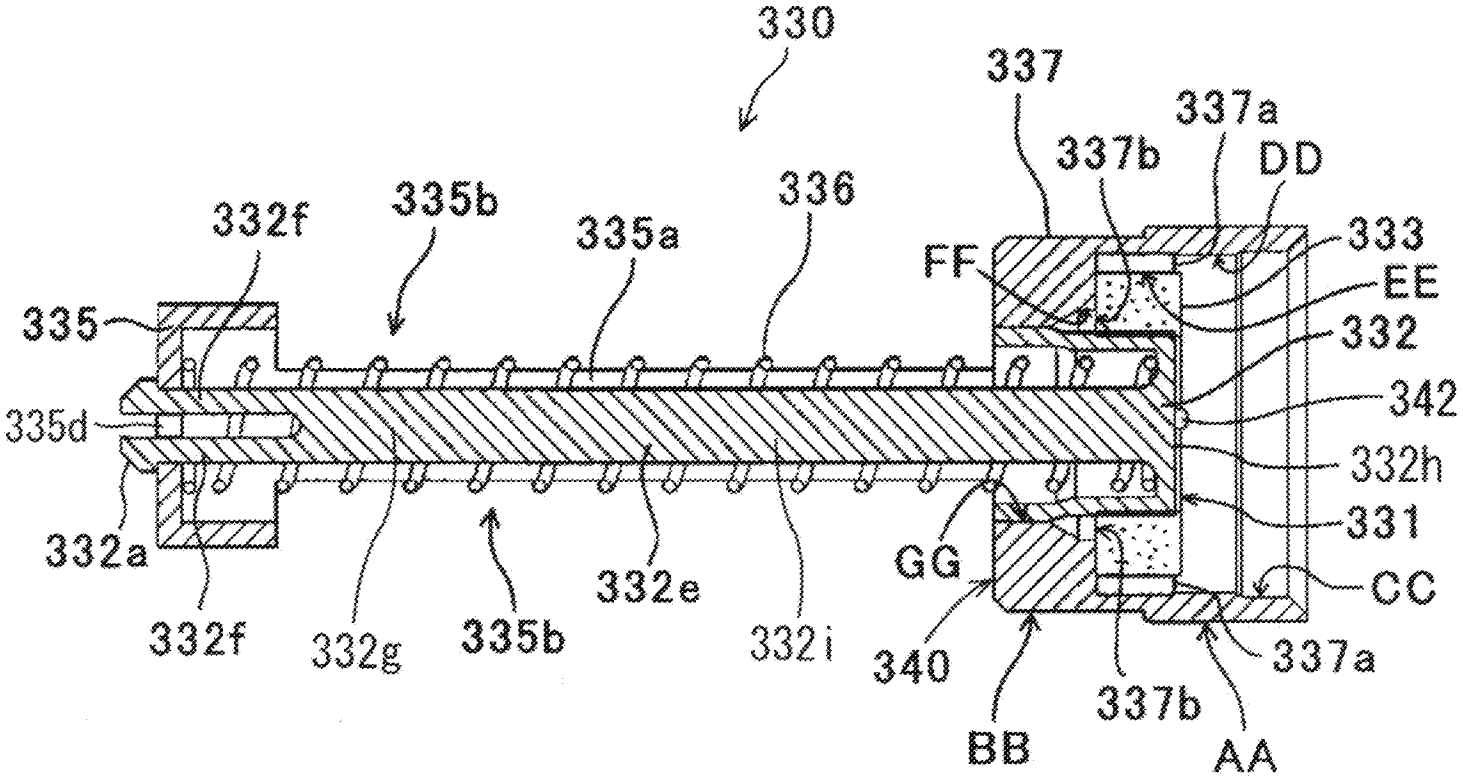
FIG. 17 is a cross-sectional diagram of an example nozzle receiving member in the state shown in FIG. 13.
Figure 18:
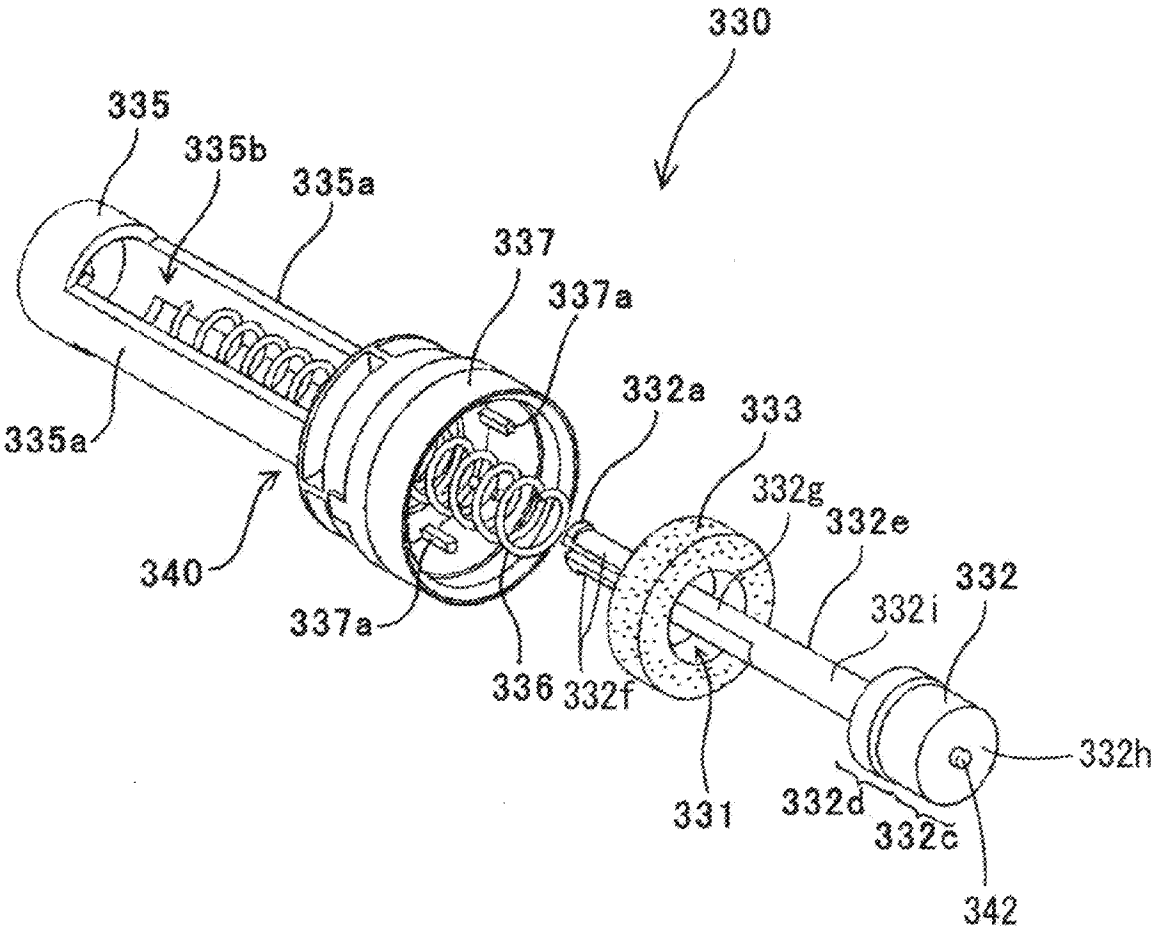
FIG. 18 is an exploded perspective diagram of an example nozzle receiving member.

FIG. 14 is a perspective diagram explaining the nozzle receiving member 330 seen from the container leading end side. FIG. 15 is a perspective diagram explaining the nozzle receiving member 330 seen from the container rear end side. FIG. 16 is a top cross-sectional diagram of the nozzle receiving member 330 in the state of FIG. 13 seen from the top. FIG. 17 is a lateral cross-sectional diagram of the nozzle receiving member 330 in the state of FIG. 13 seen from a lateral side (a deeper side of FIG. 13). FIG. 18 is an exploded perspective diagram of the nozzle receiving member 330.

The nozzle receiving member 330 is constituted by a container shutter support member 340 as a support member, a container shutter 332, a container seal 333 as a sealing member, a container shutter spring 336 as a biasing member, and a receiving member fixing portion 337.

The container shutter support member 340 is constituted by a shutter rear end support portion 335 as a rear end portion, shutter side surface support portions 335*a* (protruding portions) as a side surface portions having a flat plate shape, shutter support opening portions 335*b* as side surface opening portions, and the receiving member fixing portion 337.

The container shutter spring 336 is constituted by a coil spring.

A shutter side surface support portion 335*a* (protruding portion) serving as a protruding portion, and a shutter support opening portion 335*b*, which are provided on the container shutter support member 340, are provided side by side with each other in the rotation direction of the toner housing container. Two shutter side surface support portions 335*a* (protruding portions) facing each other form part of a cylindrical shape.

The cylindrical shape is largely cut out at the positions of the shutter support opening portions 335*b* (two positions). With this configuration, a circular-columnar space S1 (FIG. 16) is formed in the cylindrical shape, and the container shutter 332 can be guided to move through this space in the inserting direction of the conveying nozzle 661 i.e., so as to move to an opening position to open the nozzle receiving port 331 and to move to a closing position to close the nozzle receiving port 331.

To sum up, the container body includes the protruding portions that protrude from the container body interior side of the container opening portion toward the container rear end side.

The nozzle receiving member 330 fixed into the container body 33 rotates together with the container body 33 when the container body 33 rotates. At this time, the shutter side surface support portions 335*a* (protruding portions) of the nozzle receiving member 330 rotate around the conveying nozzle 611 of the toner replenishing device 60. Therefore, the shutter side surface support portions 335*a* (protruding portions) and the shutter support opening portions 335*b* that are rotating alternately pass the region immediately above the nozzle opening 610 formed at the top portion of the conveying nozzle 611. Therefore, even if a toner deposition occurred above the nozzle opening 610 for an instant, the shutter side surface support portion 335*a* (protruding portion) would go across and collapse the toner deposition. This would prevent aggregation of toner deposition while in an idle state, and hence prevent a toner conveying failure upon resume. On the other hand, at the timing at which the shutter side surface support portions 335*a* (protruding portions) are located on the lateral sides of the conveying nozzle 611, and the shutter support opening portion 335*b* faces the nozzle opening 610, the toner will pass through the shutter support opening portion 335*b* as indicated by an arrow 13 in FIG. 9. Hence, the toner in the container body 33 will be supplied into the conveying nozzle 611.

The container shutter 332 is constituted by a leading end cylindrical portion 332*c* as a closing portion, a sliding portion 332*d*, a guide rod 332*e*, and shutter slip-off preventing claws 332*a*. The leading end cylindrical portion 332*c* is a portion that is on the container leading end side and hermetically contacts a cylindrical opening (the nozzle receiving port 331) of the container seal 333. The sliding portion 332*d* is a cylindrical portion that is on a more container rear end side than the leading end cylindrical portion 332*c*, has a greater external diameter than the leading end cylindrical portion 332*c*, and slides on the internal circumferential surfaces of the pair of shutter side surface support portions 335*a* (protruding portions).

The guide rod 332*e* is a rod member that rises from the cylinder interior of the leading end cylindrical portion 332*c* toward the container rear end side, and is a rod portion that, by being inserted into the coil of the container shutter spring 336, restricts the container shutter spring 336 so as not to allow the spring to buckle.

A guide rod sliding portion 332*g* is a pair of planer surfaces formed on both sides of the center axis of the guide rod 332*e* from a middle portion of the circular-columnar guide rod 332*e*. The container rear end side of the guide rod sliding portion 332*g* branches into two and forms a pair of cantilevers 332*f*.

The shutter slip-off preventing claws 332*a* are a pair of claws that are provided at an end of the guide rod 332*e* opposite from the base end thereof from which the guide rod rises, and at the end of the cantilevers 332*f*, and prevent the container shutter 332 from slipping off from the container shutter support member 340.

As shown in FIG. 16 and FIG. 17, the leading end side end of the container shutter spring 336 abuts on the internal wall surface of the leading end cylindrical portion 332*c*, and the rear end side end of the container shutter spring 336 abuts on the wall surface of the shutter rear end support portion 335. At this time, the container shutter spring 336 is compressed. Therefore, the container shutter 332 receives a biasing force in a direction to be away from the shutter rear end support portion 335 (the rightward direction in FIG. 16 and FIG. 17: a direction toward the container leading end). However, the shutter slip-off preventing claws 332*a* formed on the container rear end side end of the container shutter 332 hook on the external wall surface of the shutter rear end support portion 335. This prevents the container shutter 332 from being moved in the direction to be away from the shutter rear end support portion 335 by more than the state shown in FIG. 16 and FIG. 17.

Positioning is effected by this hooking of the shutter slip-off preventing claws 332*a* on the shutter rear end support portion 335, and by the biasing force of the container shutter spring 336. Specifically, the leading end cylindrical portion 332*c* and the container seal 333, which exert the toner leakage preventing function of the container shutter 332, are positioned with respect to the container shutter support member 340 in the axial direction. They are positioned so as to hermetically contact each other, to thereby make it possible to prevent leakage of the toner.

The receiving member fixing portion 337 has a tubular shape, of which diameters on the external circumferential surface and the internal circumferential surface decrease stepwise toward the container rear end side. The diameters gradually decrease from the container leading end side to the container rear end side. As shown in FIG. 17, the external circumferential surface thereof has two external diameter portions (external circumferential surfaces AA and BB from the container leading end), and the internal circumferential surface thereof has five internal diameter portions (internal circumferential surfaces CC, DD, EE, FF, and GG from the container leading end). The boundary between the external circumferential surface AA and the external circumferential surface BB of the external circumference is a taper surface. The boundary between the fourth internal diameter portion FF and the fifth internal diameter portion GG of the internal circumferential surface is also a taper surface.

The internal diameter portion FF of the internal circumferential surface and the taper surface connecting with this portion correspond to a seal member roll-in preventing space 337*b* described later, and the edge lines of these surfaces correspond to the sides of a pentagonal cross-section described later.

As shown in FIG. 16 to FIG. 18, the pair of shutter side surface support portions 335*a* (protruding portions) facing each other and having a form of a piece obtained by cutting a cylinder in the axial direction thereof protrude from the receiving member fixing portion 337 toward the container rear end side. Ends of the two shutter side surface support portions 335*a* (protruding portions) on the container rear end side connect with the shutter rear end support portion 335 having a cup shape provided with a circular hole in the center of the bottom thereof. By facing each other, the two shutter side surface support portions 335*a* (protruding portions) internally have a circular-columnar space S1 that is recognized with their cylindrical internal wall surfaces and imaginary cylindrical surfaces extended from these surfaces. The cylindrical shape defining the receiving member fixing portion 337 has an internal diameter that is the same as the circular-columnar space S1, and has the fifth internal diameter portion GG counted from the leading end as the internal circumferential surface thereof. The sliding portion 332*d* of the container shutter 332 slides in this circular-columnar space S1 and on the cylindrical internal circumferential surface GG. The third internal circumferential surface EE of the receiving member fixing portion 337 is a circumferential surface of an imaginary circle that passes longer-direction tops of nozzle shutter striking ribs 337*a* arranged at 45[°] intervals equiangularly. The cylindrical (circular-tubular) container seal 333, of which cross-section (i.e., cross-section in the cross-sectional diagrams of FIG. 16 and FIG. 17) is a quadrangle, is provided to conform to this internal circumferential surface EE. The container seal 333 is fixed on a vertical surface that connects the third internal circumferential surface EE with the fourth internal circumferential surface FF with an adhesive, a double-face tape, or the like. The exposed surface of the container seal 333, which is on the opposite side (the right-hand side in FIG. 16 and FIG. 17) from this adhesive surface, constitutes the inner bottom of a cylindrical opening of the cylindrical receiving member fixing portion 337 (or of the container opening portion).

As shown in FIG. 16 and FIG. 17, a seal member roll-in preventing space 337*b* (a tucking preventing space) is formed so as to correspond to the internal circumferential surface FF of the receiving member fixing portion 337 and the taper surface extending from this surface. The seal member roll-in preventing space 337*b* is a ring-shaped sealed space enclosed by three different members. That is, it is a ring-shaped space enclosed by the internal circumferential surface (the fourth internal circumferential surface FF and the taper surface extending from this) of the receiving member fixing portion 337, the vertical surface of the container seal 33 at which it is adhesively fixed, and the external circumferential surface of the container shutter 332 from the leading end cylindrical portion 332*c* to the sliding portion 332*d*. The cross-section (i.e., the cross-section in the cross-sectional diagram of FIG. 16 and FIG. 17) of this ring-shaped space is a pentagonal shape. The angle formed between the internal circumferential surface of the receiving member fixing portion 337 and the end surface of the container seal 333, and the angle formed between the external circumferential surface of the container shutter 332 and the end surface of the container seal 333 are both 90[°].

The function of the seal member roll-in preventing space 337*b* will be described. When the container shutter 332 is moved from a state of closing the nozzle receiving port 331 toward the container rear end, the internal circumferential surface of the container seal 333 slides relative to the leading end cylindrical portion 332*c* of the container shutter 332.

Hence, the internal circumferential surface of the container seal 333 is dragged by the container shutter 332 and elastically deformed so as to move toward the container rear end.

At this time, if there is no seal member roll-in preventing space 337*b*, and the vertical surface (the adhesive surface of the container seal 333) connecting with the third internal circumferential surface connects with the fifth internal circumferential surface GG orthogonally, there is a risk of the following state. Specifically, the elastically deformed portion of the container seal 333 is tucked in and rolled in between the internal circumferential surface of the receiving member fixing portion 337 sliding relative to the container shutter 332 and the external circumferential surface of the container shutter 332. If the container seal 333 is rolled in between the sliding portions of the receiving member fixing portion 337 and container shutter 332, i.e., between the internal circumferential surface GG and the leading end cylindrical portion 332*c*, the container shutter 332 is locked to the receiving member fixing portion 337 and cannot open or close the nozzle receiving port 331.

Compared with this, the nozzle receiving member 330 of the present embodiment has the seal member roll-in preventing space 337*b* formed at the internal circumference thereof. The internal diameters of the seal member roll-in preventing space 337*b* (i.e., the internal diameters of the internal circumferential surface EE and of the taper surface extending from this surface) are smaller than the external diameter of the container seal 333. Therefore, the container seal 333 as a whole would not enter the seal member roll-in preventing space 337*b*.

Further, there is a limit to a range of the container seal 333 that may be dragged by the container shutter 332 and elastically deformed, and the container seal will return by its own elasticity before reaching the internal circumferential surface GG and getting rolled in. With this effect, it is possible to prevent making it impossible to perform opening or closing of the nozzle receiving port 331 due to the container shutter 332 being locked to the receiving member fixing portion 337.

As shown in FIG. 16 to FIG. 18, a plurality of nozzle shutter striking ribs 337*a* are formed on the internal circumferential surface of the receiving member fixing portion 337 adjoining the external circumference of the container seal 333 such that the ribs extend radially.

As shown in FIG. 16 and FIG. 17, when the container seal 333 is fixed on the receiving member fixing portion 337, a vertical surface of the container seal 333 on the container leading end side slightly sticks out from the container leading end side end of the nozzle shutter striking ribs 337*a* in the rotational axis direction.

When the toner housing container 32 is mounted on the toner replenishing device 60 as shown in FIG. 9, a nozzle shutter flange 612*a* of the nozzle shutter 612 of the toner replenishing device 60 is biased by a nozzle shutter spring 613 and crushes the stuck-out portion of the container seal 333. The nozzle shutter flange 612*a* goes further inward, strikes on the container leading end side end of the nozzle shutter striking ribs 337*a*, and covers the leading end side end surface of the container seal 33 to thereby provide a shield from the outside of the container. This ensures hermetical seal around the conveying nozzle 611 in the nozzle receiving port 331 while in the mounted state, and can prevent toner leakage.

The rotational axis direction position of the nozzle shutter 612 relative to the toner housing container 32 is determined by the nozzle shutter striking ribs 337*a* being struck by such a surface of the nozzle shutter flange 612*a* biased by the nozzle shutter spring 613 as is opposite to a nozzle shutter spring receiving surface 612*f* thereof. As a result, a rotational axis direction positional relationship among the container leading end side end surface of the container seal 333, the container leading end side end surface of a leading end opening 305 (a later-described internal space of the cylindrical receiving member fixing portion 337 provided in the container opening portion 33*a*), and the nozzle shutter 612 is determined.

Figure 19A:
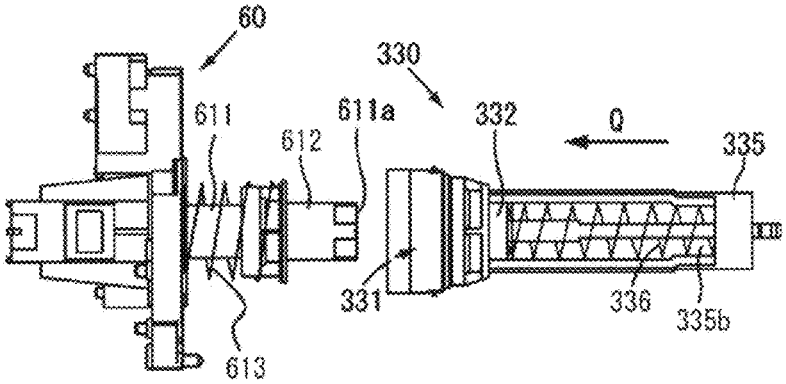
FIG. 19A is a top plan view of an example for explaining a state of an opening/closing member and a conveying pipe being mounted on each other.
Figure 19B:
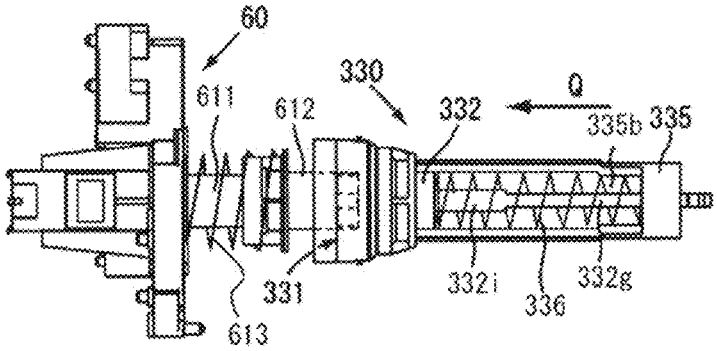
FIG. 19B is a top plan view of an example for explaining a state of an opening/closing member and a conveying pipe being mounted on each other.
Figure 19C:
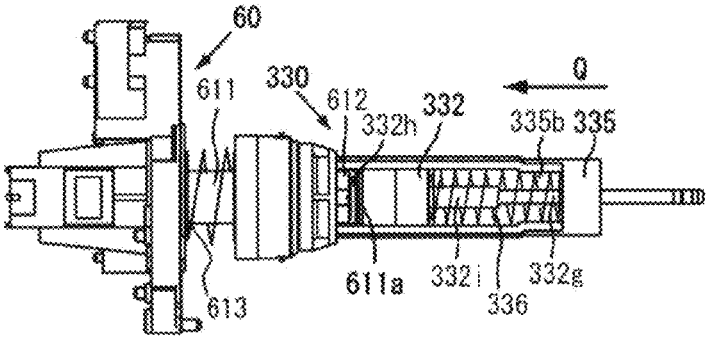
FIG. 19C is a top plan view of an example for explaining a state of an opening/closing member and a conveying pipe being mounted on each other.
Figure 19D:
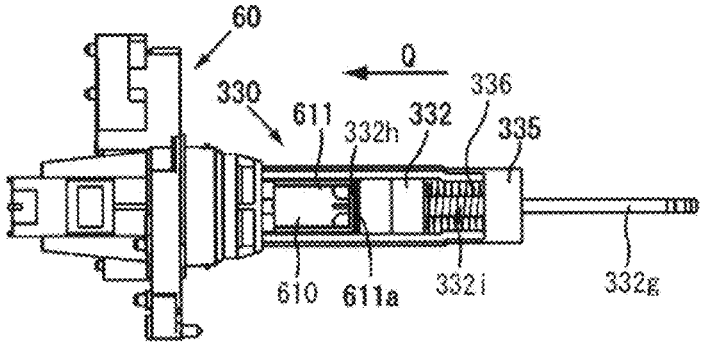
FIG. 19D is a top plan view of an example for explaining a state of an opening/closing member and a conveying pipe being mounted on each other.

Next, the operation of the container shutter 332 and the conveying nozzle 611 will be explained with reference to FIG. 1, FIG. 9, and FIG. 19A to FIG. 19D. Before the toner housing container 32 is mounted on the toner replenishing device 60, the container shutter 332 is biased by the container shutter spring 336 to a closing position of closing the nozzle receiving port 331 as shown in FIG. 1. FIG. 19A shows the appearance of the container shutter 332 and the conveying nozzle 611 in this state. When the toner housing container 32 is mounted on the toner replenishing device 60, the conveying nozzle 611 is inserted into the nozzle receiving port 331 as shown in FIG. 19B. When the toner housing container 32 is pushed further into the toner replenishing device 60, an end surface 332*h* of the leading end cylindrical portion 332*c*, which is the end surface of the container shutter 332 (hereinafter referred to as "container shutter end surface 332*h*"), and an end surface 611*a* of the conveying nozzle 611 located at a side from which the nozzle is inserted (hereinafter referred to as conveying nozzle end surface 611*a*") contact each other. When the toner housing container 32 is pushed further from this state, the container shutter 332 is thrust down as shown in FIG. 19C, and the conveying nozzle 611 is inserted into the shutter rear end support portion 335 through the nozzle receiving port 331 as shown in FIG. 19D. As a result, the conveying nozzle 611 is inserted into the container body 33 and comes to the set position as shown in FIG. 9. At this time, the nozzle opening 610 is at a position coinciding with the shutter support opening portion 335*b* as shown in FIG. 19D.

After this, when the container body 33 rotates, the toner uplifted above the conveying nozzle 611 by the uplifting portion 304 falls into and is introduced into the conveying nozzle 611 from the nozzle opening 610.

The toner introduced into the conveying nozzle 611 is conveyed through the conveying nozzle 611 toward the toner fall-down conveying path 64 along with rotation of the conveying screw 614, and falls through the toner fall-down conveying path 64 to be supplied into the developing device 50.

Figure 33:
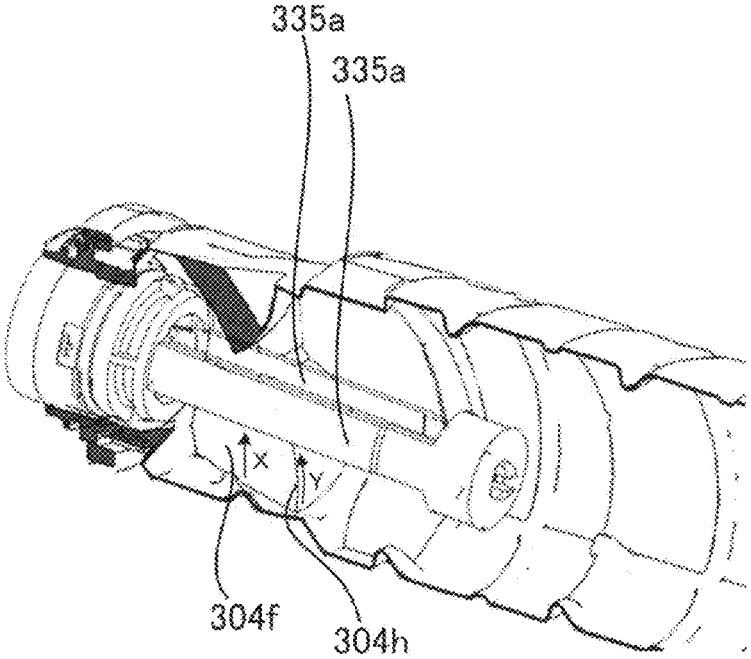
FIG. 33 is a perspective cross-sectional diagram showing a configuration of a toner housing container of the present invention.

In the region of the cross-section along the line E-E of FIG. 9 (which is the leading end side of the conveying nozzle 611 and a position of an end surface of a bearing of the conveying screw 614), the bosses 304*h* and the shutter side surface support portions 335*a* (protruding portions) are at positions facing each other. The uplifting wall surfaces 304*f* rise from the internal wall surface of the container so as to extend in the direction X of FIG. 30 (and the direction represented by the arrow X in FIG. 33), i.e., toward the shutter side surface support portions 335*a*. The bosses 304*h* rise in the direction represented by the arrow Y in FIG. 33, i.e., toward the shutter side surface support portions 335*a*.

Further, at the region where the shutter side surface support portion 335*a* and the boss face each other, the boss 304*h* curves outward in the radial direction of the container so as to conform to the contour of the shutter side surface support portion 335*a* (a curving portion 304*i*).

In other words, the boss dents from the internal side toward the external side in the radial direction.

This denting portion of the boss is referred to as curving portion 304*i*.

The curving portion 304*i* is gentler than other portions of the boss 304*h* and conforms to the shutter side surface support portion 335*a* also in the longer direction.

In FIG. 31, the portion in the enclosure indicated by a sign Z curves toward the deeper side of the drawing, and the curving portion 304*i* is formed at this portion.

Likewise, the uplifting wall surface 304*f* also faces the shutter side surface support portion 335*a*. When seen from the container rotation direction downstream side, there are the uplifting wall surface 304*f*, a rotation direction downstream side end surface 335*c* (a flat side surface) of the shutter side surface support portion 335*a* (protruding portion), and a rotation direction upstream side lateral edge portion 611*s* of the nozzle opening 610. When the conveying nozzle 611 is inserted, the shutter side surface support portions 335*a* as the protruding portions extend along the conveying nozzle 611.

Also by means of the uplifting portion 304 formed by the uplifting wall surfaces 304*f* of the container body 33 shown in FIG. 30 likewise by means of the uplifting effect explained earlier, the toner moves as indicated by an arrow T1 into the nozzle opening 610, which is an opening of the conveying nozzle 611 as a conveying pipe.

At this time, the external circumferential surface and rotation direction downstream side end surface 335*c* (flat side surface) of the shutter side surface support portion 335*a* (protruding portion) function as a toner pass-down portion for passing the toner from the uplifting portion 304 into the nozzle opening 610.

FIG. 30 also shows the flow of the toner in the container body 33 including the shutter side surface support portions 335*a* (protruding portions) functioning as the toner pass-down portion.

Along with the rotation of the container body 33 in the direction of the arrow A in the drawing, the toner uplifted by the uplifting wall surface 304*f* along the circumferential direction of the container body flows toward the direction of the nozzle opening 610 due to the gravity force (the arrow T1 in the drawing). In the configuration shown in FIG. 30, the shutter side surface support portions 335*a* (protruding portions) are arranged so as to fill the gaps between the conveying nozzle 611 and the bosses 304*h* (the bosses rising toward the center of rotation of the uplifting wall surfaces 3040. So as to realize this arrangement, the rotation direction downstream side end surface 335*c* (flat side surface) of the shutter side surface support portion 335*a* (protruding portion) and the boss 304*h* of the uplifting portion 304 are arranged in this order as seen from the downstream side in the direction of rotation of the container body 33.

The presence of the curving portion 304*i* of the boss 304*h* enables the boss 304*h* and the uplifting wall surface 304*f* to conform even more to the shutter side surface support portion 335*a* to thereby make the shutter side surface support portion 335*a* effectively function in passing the toner from the uplifting wall surface into the nozzle opening.

It is better to make the shutter side surface support portion 335*a* (protruding portion) and the boss 304*h* closely contact each other. However, to save the manufacturing costs, the boss 304*h*, the uplifting wall surface 304*f*, and the curving portion 304*i* are often manufactured with blow molding, which cannot be as dimensionally precise as injection molding. With blow molding, it is difficult to form a completely close contact with the shutter side surface support portion, and it is preferable to manufacture them with a slight gap in terms of mass productivity. In the present embodiment, the distance between the curving portion and the shutter side surface support portion facing the curving portion is from about 0.3 mm to 1 mm.

To sum up, the present embodiment includes the following useful features:

suppressing scatter, etc. of the toner with the configuration of inserting the nozzle on the apparatus body into the container; and improving the toner replenishing efficiency with the utilization of the shutter side surface support portion as a bridge to pass the toner from the uplifting wall surface into the nozzle.

In the normal state of the toner housing container 32 filled with the toner, when the toner housing container 32 is inserted into the image forming apparatus, the container shutter 332 is pushed by the conveying nozzle 611 of the apparatus body to thereby open the opening and allow the conveying nozzle 611 to be inserted on this momentum.

However, there may be cases when the toner housing container 32 is inserted so as to have the container shutter 332 pushed by the conveying nozzle 611, but the nozzle receiving port 331 is not opened because the gap between the shutter side surface support portions 335*a* is clogged with the toner to thereby prohibit the conveying nozzle 611 from being inserted.

This occurs because the toner density around the nozzle receiving member 330 is high, and the toner in the moving region of the container shutter 332 (between the shutter side surface support portions 335*a*) cannot move and inhibits the move of the container shutter 332 when the container shutter 332 tries to retract into the container body 33.

Hence, the present inventors have conducted earnest studies by focusing on the bulk density of the toner, and found it possible to prevent the trouble of being unable to open the container shutter (shutter member), by adjusting the toner housed in the toner housing container to have a bulk density of 0.399 g/cm$^3$ or less as a bulk density thereof when the toner housing container is shaken up and down 10 times under the conditions of a temperature of 25° C. and a humidity of 50% RH and put such that the container opening portion faces downward.

The bulk density of the toner can be calculated from, for example, the mass of sufficiently fluidized toner in the toner housing container and the volume of the toner occupied in the toner housing container.

When the toner housing container 32 is in the set position shown in FIG. 19D, the container shutter end surface 332*h* is pushed by the conveying nozzle end surface 611*a* within the region of the nozzle opening 610. At this time, the nozzle opening 610, and the conveying nozzle end surface 611*a* and the container shutter end surface 332*h* as well are located below the uplifting portion 304. Therefore, the toner uplifted above the conveying nozzle 611 falls into the nozzle opening 610, and into between the container shutter end surface 332*h* and the conveying nozzle end surface 611*a* as well. Furthermore, the fallen toner may float up and deposit between the container shutter 332 and the container shutter support member 340.

Here, if it is assumed that the container shutter end surface 332*h* and the conveying nozzle end surface 611*a* are flat surfaces, the container shutter end surface 332*h* and the conveying nozzle end surface 611*a* contact each other by surface slide, and they are heavily loaded as a result. It is difficult for them to have an ideally perfect interfacial slide due to errors in assembly and variations in parts, and they have a slight gap between them. Therefore, the toner may enter this gap, and be frictioned along with the surface slide.

Further, assume a case where the toner floating up in the toner housing container deposits between the container shutter 332 and the container shutter support member 340. In the state that the toner housing container 32 is mounted on the toner replenishing device 60, a braking force is applied to the container shutter because the leading end cylindrical portion 332*c* of the container shutter 332 is pushed onto the conveying nozzle end surface 611*a* by the container shutter spring 336. Consequently, it is considered that the container shutter 332 does not rotate in conjunction with the container shutter support member 340 that is fixed on the container body 33 and is rotating synchronously with the spiral projection 302. In this case, it is predicted that the toner between the container shutter 332 and the container shutter support member 340 may be frictioned by the container shutter 332.

In this case, the toner that is frictioned and applied a load as a result may form an aggregate that is larger than the particle diameter of a toner that is not applied a load. If the aggregate is conveyed into the developing device 50 through the toner replenishing device 60, abnormal images such as undesired black spots may be produced. This phenomenon of forming an aggregate is more often the case with, particularly, a low melting point toner that can form an image at a low fixing temperature, among toners.

Hence, in the present invention, it is preferable to provide an aggregation suppressing unit configured to suppress aggregation of a toner that may occur along with rotation of the container body 33, as will be explained below.

As the aggregation suppressing unit, the container shutter 332 is let to rotate in conjunction with the container shutter support member 340 even when the leading end cylindrical portion 332*c* of the container shutter 332 is pushed onto the conveying nozzle 611 by being pushed in the longer direction thereof by the container shutter spring 336 and is applied a braking force as the result of being pushed. This preventing effect reduces the sliding load to be applied to the toner between the container shutter 332 and the container shutter support member 340. As a conjunctive rotation, a rotation of the container shutter 332 about the axis of the guide rod 332*e* is assumed. A state that the container shutter 332 rotates in conjunction with the container shutter support member 340 means a state that both of them rotate simultaneously, in other words, a state that the container shutter 332 does not rotate relative to the container shutter support member 340. As the region between the container shutter 332 and the container shutter support member 340, the region between the external circumferential surface of the sliding portion 332*d* and the internal circumferential surface of the shutter support opening portion 335*b*, and the region between the guide rod sliding portion 332*g* and a rear end opening 335*d* are assumed.

The sliding load to the toner is much larger in a rotation operation about the axis than in an opening/closing operation of the container shutter 332 in the axial direction, because an opening/closing operation occurs only when the toner housing container 32 is mounted or demounted, whereas a rotation operation occurs every time a replenishing operation is performed.

Figure 20A:
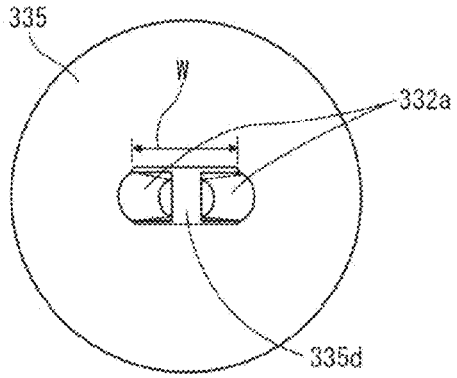
FIG. 20A is an enlarged diagram showing a relationship among a rear end opening, shutter slip-off preventing claws, and a planar guide seen from a container rear end side in one embodiment.
Figure 20B:
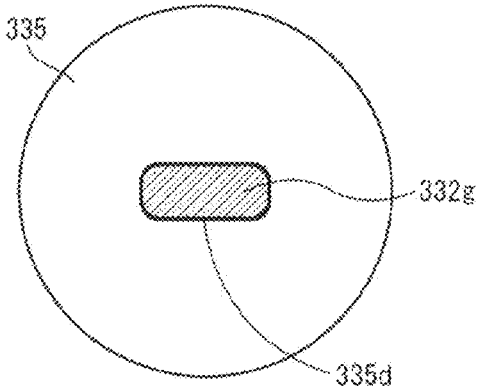
FIG. 20B is an enlarged diagram showing a relationship among a rear end opening, shutter slip-off preventing claws, and a planar guide seen from a container rear end side in one embodiment.

FIG. 20A is a plan view showing a relationship between a rear end opening 335*d* as a through-hole in the center of the opening/closing member rear end support portion and the shutter slip-off preventing claws 332*a* seen from the left-hand side of FIG. 17 (from the container rear end side). FIG. 20B is a cross-sectional diagram of the guide rod sliding portion 332*g* showing an engaging relationship between the rear end opening 335*d* and the guide rod sliding portion 332*g* in the state of FIG. 19C.

The guide rod 332*e* is constituted by a cylindrical portion 332*i*, the guide rod sliding portion 332*g*, the cantilevers 332*f*, and the shutter slip-off preventing claws 332*a*. As shown in FIG. 17, the guide rod 332*e* of the container shutter 332 is divided into two at the container rear end side thereof to thereby form the pair of cantilevers 332*f*. The shutter slip-off preventing claws 332*a* are provided on the external circumferential surfaces of the cantilevers respectively. As shown in FIG. 17 and FIG. 20A, the shutter slip-off preventing claws 332*a* protrude more outward than the external edges of the longer-direction length W of the rear end opening 335*d*. The rear end opening 335*d* has a function of letting the cantilevers 332*f* and the guide rod sliding portion 332*g* slide relative to the rear end opening 335*d* to guide the container shutter 332 to move. As shown in FIG. 20B, the guide rod sliding portion 332*g* has flat surfaces facing the top and bottom sides of the rear end opening 335*d*, and has curving surfaces conforming to the left and right sides of the rear end opening 335*d*. The cylindrical portion 332*i* forms a cylindrical shape, of which width in the left-right direction in FIG. 20A and FIG. 20B is the same as that of the guide rod sliding portion 332*g*. The cantilevers 332*f* and the guide rod sliding portions 332*g* are engaged with the rear end opening 335*d* in such a relationship as not to be inhibited from moving when the container shutter 332 moves as shown in FIG. 19A to FIG. 19D. In this way, the rear end opening 335*d* has the cantilevers 332*f* and the guide rod sliding portion 332*g* inserted therethrough and guides the container shutter 332 to move, and regulates rotation of the container shutter 332 about the rotation axis as well.

When assembling the container shutter 332 on the container shutter support member 340, the guide rod 332*e* is inserted through the container shutter spring 336, and the pair of cantilevers 332*f* of the guide rod 332*e* are warped toward the axial center of the guide rod 332*e* to let the shutter slip-off preventing claws 332*a* pass through the rear end opening 335*d*. As a result, the guide rod 332*e* is assembled on the nozzle receiving member 330 as shown in FIG. 15 to FIG. 17. At this time, the container shutter 332 is pressured by the container shutter spring 336 in the direction to close the nozzle receiving port 331, and the container shutter is prevented from slipping off by the shutter slip-off preventing claws 332*a*. The guide rod 332*e* is preferably made of a resin such as polystyrene so that the cantilevers 332*f* may have elasticity to warp.

When the toner housing container 32 is set in the set position, the guide rod sliding portion 332*g* passes through the rear end opening 335*d*, and comes to a position at which the flat portions of the guide rod sliding portion 332*g* as a driving force receiving portion and the sides of the rear end opening 335*d* as a driving force transmitting portion face and contact each other as shown in FIG. 19D and FIG. 20B. At this position, the internal circumferential surfaces of the shutter side surface support portions 335*a* (protruding portions) face the external circumferential surfaces of the leading end cylindrical portion 332*c* and the sliding portion 332*d*.

Accordingly, even though the container shutter end surface 332*h* is pushed onto the conveying nozzle end surface 611*a* by being pushed by the container shutter spring 336, the container shutter 332 is fixed to the rotating container shutter support member 340 in the direction of rotation about the longer axis thereof (i.e., the center axis of the guide rod 332*e*, and at the same time, the axis of rotation of the container body 33), by means of the surface contact between the flat portions of the guide rod sliding portion 332*g* and the sides of the rear end opening 335*d*. As a result, a rotational force is transmitted to the guide rod 332*e* of the container shutter 332 from the container shutter support member 340 that is rotating. Because this rotational force is greater than the braking force described above, the container shutter 332 rotates along with the rotation of the container shutter support member 340. In other words, the container shutter 332 is in conjunction with the rotation of the container shutter support member 340 (at this time, both of them are restricted from relative rotation). That is, the guide rod sliding portion 332*g* and the rear end opening 335*d* function as a driving transmitting unit that transmits a rotational force from the container shutter support member 340 to the container shutter 332. At the same time, they can be described as the aggregation suppressing unit. This aggregation suppressing unit suppresses sliding friction of the toner between the container shutter 332 and the container shutter support member 340 in the direction of rotation about the axis of the guide rod 332*e*. This makes it possible to suppress toner aggregation between the container shutter 332 and the container shutter support member 340 along with the rotation of the container body 33.

The aggregation suppressing unit is not limited to the guide rod sliding portion 332*g*, but may be the cantilevers 332*f*. In this case, the length and position of the cantilevers 332*f* may be determined such that they are positioned at the rear end opening 335*d* when the toner housing container 32 is in the set position.

Another aggregation suppressing unit will be explained. First, the problem to be solved by this aggregation suppressing unit will be described. When the container shutter 332 rotates simultaneously with the toner housing container 32 (container body 33), the container shutter end surface 332*h* rotates relative to the conveying nozzle end surface 661*a*. The leading end cylindrical portion 332*c* of the container shutter 332 is pushed onto the conveying nozzle 611 in the longer direction thereof by being pushed by the container shutter spring 336. When this relative rotation occurs in this state, the container shutter end surface 332*h* applies an extremely heavy sliding load to the conveying nozzle end surface 661*a*, which may be the cause of occurrence of a toner aggregate.

Hence, there is proposed a second aggregation suppressing unit, which suppresses toner aggregation that may be caused along with rotation of the container shutter 332 as an opening/closing member, and which aims to suppress occurrence of a toner aggregate in a region different from the region in the embodiment described above. The aggregation suppressing unit described below reduces a sliding load on the toner in a region where the conveying nozzle end surface 611*a* and the facing leading end cylindrical portion 332*c* abut on each other.

As shown in FIG. 9 and FIG. 14, the container shutter end surface 332*h* includes an abutment part 342 that projects from the end surface 332*h* toward the facing end surface 611*a* of the conveying nozzle 611 (or outward from the container leading end) and abuts on the end surface 611*a* of the conveying nozzle 611 when the toner housing container is mounted on an image forming apparatus. The abutment part 342 is a projecting portion functioning as the aggregation suppressing unit (second aggregation suppressing unit) of the present embodiment. The external circumferential surface of the abutment part 342 has a shape that includes a circular circumferential surface concentric with the axis of rotation of the toner housing container 32 and reduces its diameter toward the conveying nozzle end surface 611*a* (e.g., a hemispherical shape), and the abutment part 342 is provided to have a point contact with the conveying nozzle end surface 611*a* at the top of the hemispherical shape as shown in FIG. 9. This allows rotation to occur in a state that the sliding load when the abutment part 342 abuts on the conveying nozzle end surface 611*a* is low. Hence, the contact area can be much less than when the container shutter end surface 332*h* and the conveying nozzle end surface 611*a* have flat surfaces. This makes it possible to reduce a sliding load to be applied to the toner between the container shutter end surface 332*h* and the conveying nozzle end surface 611*a* along with the rotation of the container body 33, and thereby to suppress aggregation of the toner.

The material of the abutment part 342 may be the same as the container shutter 332, e.g., polystyrene resin, when formed integrally with the container shutter 332. Since the container shutter 332 is a component assembled on the toner housing container 32, it is replaced together with the toner housing container 32. Therefore, on the premise that it may be replaced, the material of the abutment part 342 that is to rotate by keeping in contact with the conveying nozzle end surface 611*a* is, in terms of durability, preferably a material softer than the material of the conveying nozzle 611 (end surface 611*a*) that is set in the printer section 100 and is not to be replaced in principle.

As shown in FIG. 9 and FIG. 14, the abutment part 342 is arranged roughly in the center of the container shutter end surface 332*h*, so as to be present on the axis of rotation of the toner housing container 32, in other words, on the axis of rotation of the container shutter 332. With such an arrangement, the locus of rotation of the top of the abutment part 342 when the container shutter end surface 332*h* rotates relative to the conveying nozzle end surface 661*a* is ideally a point. Because components different from each other, namely, the toner housing container and an image forming apparatus, are mounted on each other, they cannot avoid being positionally misaligned from each other within an allowable error, and there may also be variation due to mass production. Even in consideration of these factors, it is possible to make the locus of rotation infinitesimal. By doing so, it is possible to save the contact area between the container shutter end surface 332*h* and the conveying nozzle end surface 611*a*, and to suppress aggregation of the toner due to a sliding load.

Figure 21:
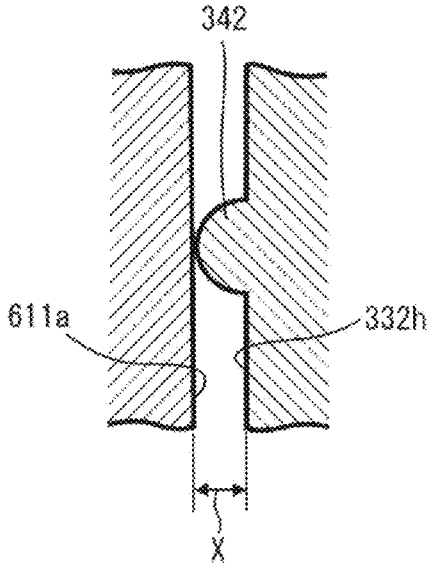
FIG. 21 is an enlarged cross-sectional diagram showing a state of an opening/closing member and a conveying pipe abutting on each other in another embodiment.

Next, an interfacial gap between the container shutter end surface 332*h* and the conveying nozzle end surface 611*a* formed by the abutment part 342 will be explained. As shown in FIG. 21, this gap is set by the amount X of projection of the abutment part 342 from the container shutter end surface 332*h* to the top thereof.

Figure 22:
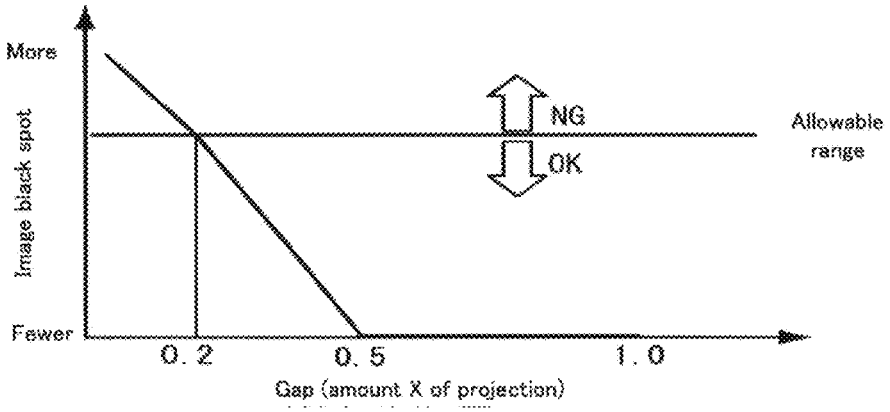
FIG. 22 is a diagram showing an expected relationship between an amount of projection of an aggregation suppressing unit and occurrence of black spots in an image in another embodiment.

The present inventors have studied the relationship between the amount X of projection and occurrence of black spots in the images, i.e., the relationship between a sliding area of the abutment region and occurrence of black spots in the images, and found the tendency shown in FIG. 22. In the present embodiment, the amount X of projection (the interfacial gap) is set to 1 mm. Hence, the toner that enters the interfacial gap receives a less sliding load, and easily falls out of the range of the surfaces and scarcely remains there, which makes it difficult for an aggregate to occur. In this way, the load to the toner is suppressed, because the sliding load when the toner enters the gap between the container shutter end surface 332*h* and the conveying nozzle end surface 611*a* is suppressed. Therefore, it is possible to minimize a load to be applied to the toner, and to thereby suppress occurrence of an aggregate and abnormal images.

As shown in FIG. 22, it is safe if the amount X of projection (interfacial gap) is 0.5 mm or greater. It is estimated that such a level of an aggregate that could be recognized on an output image would be likely to occur when the amount of projection is roughly 0.2 mm or less. Hence, the amount X of projection (interfacial gap) is preferably from about 0.5 mm to 1 mm.

Figure 23:
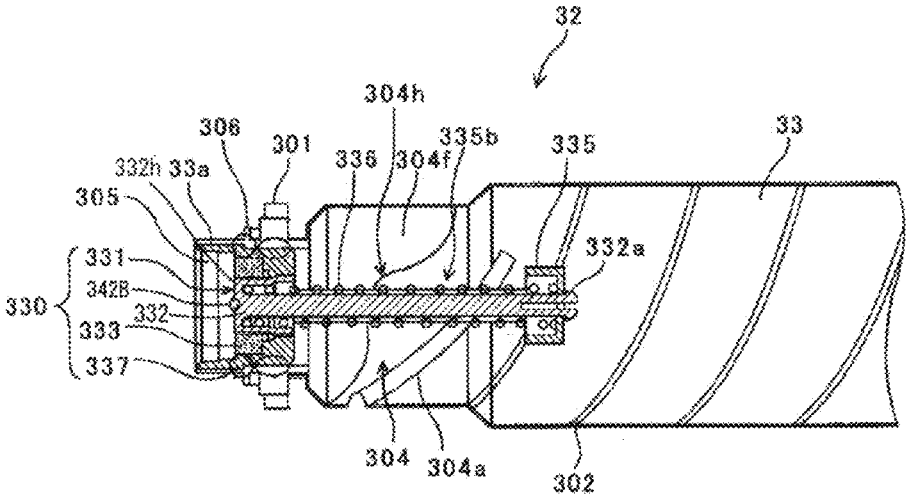
FIG. 23 is an enlarged diagram showing another configuration of an aggregation suppressing unit in another embodiment.

The aggregation suppressing unit is not limited to the one obtained by integrally molding the abutment part 342 and the container shutter 332 as shown in FIG. 21. For example, the aggregation suppressing unit may be separated from the container shutter 332 as shown in FIG. 23. Also in this case, the same effect as that described above can be obtained as long as the amount X of projection is secured. The aggregation suppressing unit shown in FIG. 23 includes an abutment part 342B, which is a sphere made of a resin and provided roughly in the center of the container shutter end surface 332*h* free to roll.

Also with this configuration, the sliding load to be applied to the toner that enters the interfacial gap between the container shutter end surface 332*h* and the conveying nozzle end surface 611*a* is suppressed. Therefore, it is less likely for an aggregate to occur. In this way, a load to the toner is suppressed, because the sliding load when the toner enters the interfacial gap between the container shutter end surface 332*h* and the conveying nozzle end surface 611*a* is suppressed. This makes it possible to minimize the load to the toner, and to thereby suppress occurrence of an aggregate and abnormal images.

Figure 24:
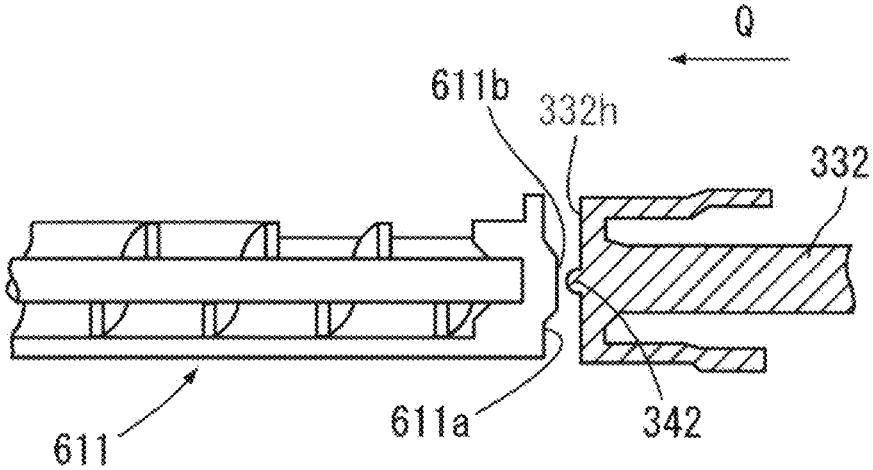
FIG. 24 is an enlarged diagram showing a modified example of an end surface of a conveying pipe.

The conveying nozzle end surface 611*a* is a flat planar end surface. However, as shown in FIG. 24, the end surface 611*a* may be formed such that only a portion 611*b* of the conveying nozzle end surface 611*a* that faces the abutment part 342 projects toward the abutment part 342.

Another aggregation suppressing unit will be explained.

The aggregation suppressing unit described above is provided between the container shutter end surface 332*h* and the conveying nozzle end surface 611*a*, and is therefore particularly effective for suppressing generation of a toner aggregate. However, it is predicted that when the toner housing container 32 is demounted from the toner replenishing device 60, the toner deposited between the surfaces may fall into the image forming apparatus or onto the floor to thereby contaminate them.

Hence, the present aggregation suppressing unit includes a seal member 350 that is provided on a non-abutment region R of the container shutter end surface 332*h* that is not to abut on the conveying nozzle end surface 611*a*. This makes it possible to prevent the toner from remaining in the interfacial gap between the container shutter end surface 332*h* and the conveying nozzle end surface 611*a*.

Figure 25:
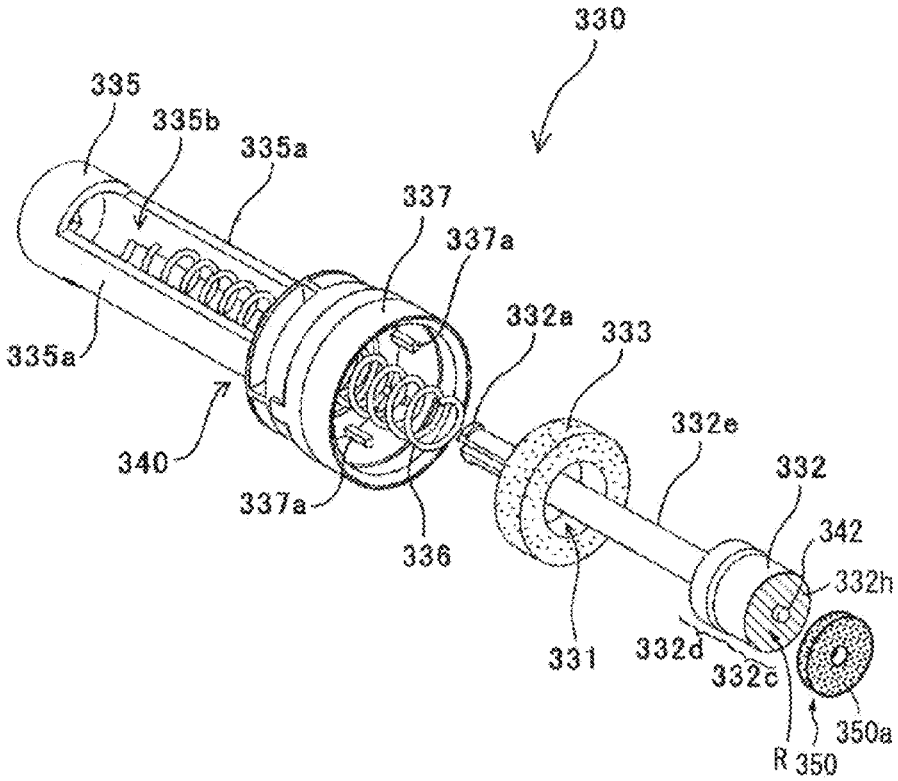
FIG. 25 is an enlarged perspective diagram showing a configuration of main portions in another embodiment.
Figure 26:
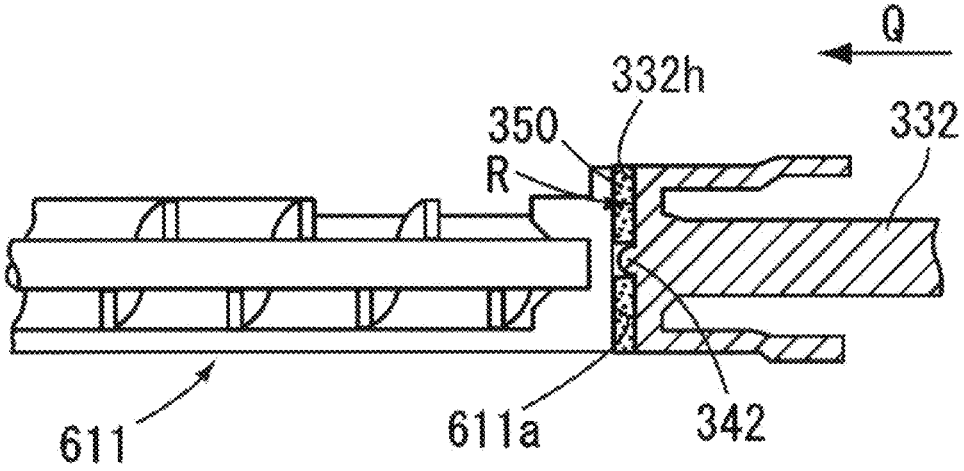
FIG. 26 is an enlarged cross-sectional diagram showing a state of an opening/closing member and a conveying pipe abutting on each other in another embodiment.
Figure 27:
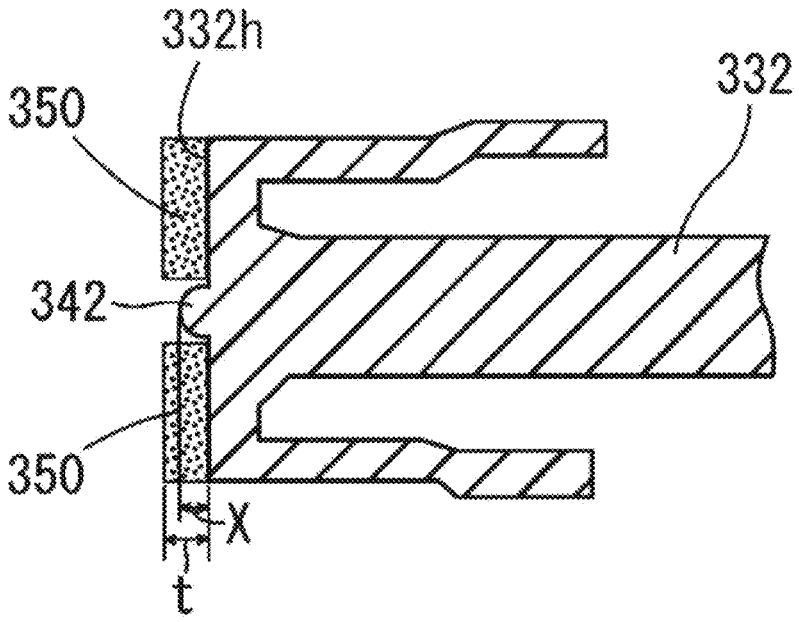
FIG. 27 is an enlarged cross-sectional diagram explaining a configuration of a seal member provided at an end surface of an opening/closing member and an aggregation suppressing unit in another embodiment.

The seal member 350 is made of an elastic material such as polyurethane foam. As shown in FIG. 25 and FIG. 26, the seal member 350 is formed in an annular shape so as to be located on the external side of the abutment part 342. The seal member 350 is configured to compress by from 0.1 mm to 0.5 mm in the direction of the thickness of the seal member 350, when the container shutter 332 comes to the opening position of opening the nozzle receiving port 331 along with the conveying nozzle 611 being inserted into the toner housing container 32. Specifically, when the amount X of projection of the abutment part 342 is 1 mm as shown in FIG. 27, the thickness t of the seal member 350 is set to from 1.1 mm to 1.5 mm. The seal member 350 is designed to collapse and thereby allow the conveying nozzle end surface 611*a* and the abutment part 342 to abut on each other when a facing surface 350*a* of the seal member 350 and the conveying nozzle end surface 611*a* contact each other.

Providing the seal member 350 in this way makes it difficult for the toner to enter the interfacial gap, because the facing surface 350*a* of the seal member 350 contacts the conveying nozzle end surface 611*a* before the conveying nozzle end surface 611*a* and the abutment part 342 abut on each other, as shown in FIG. 26. This makes it possible to suppress the interior of the image forming apparatus or the floor from being contaminated by toner that would otherwise fall there when the toner housing container 32 is demounted from the toner replenishing device 60.

Figure 29:
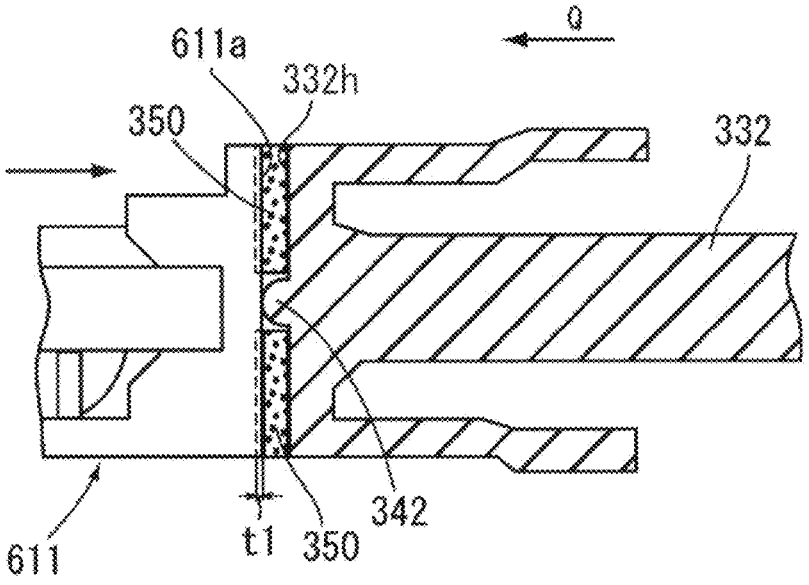
FIG. 29 is an enlarged cross-sectional diagram explaining an amount of collapse of a sealing member in another embodiment.

As shown in FIG. 29, the amount of collapse t1 of the seal member 350 is set to about from 0.1 mm to 0.5 mm. When the amount of collapse was set to, for example, 1 mm or greater, it was observed that a large sliding load occurred to thereby make it likely for a toner aggregate to occur between the facing surface 350*a* of the seal member 350 and the conveying nozzle end surface 611*a*. Therefore, the amount of collapse t1 is preferably 0.5 mm or less. In the present embodiment, the amount of collapse t1 is set to 0.2 mm. By minimizing the amount of compression of the seal member 350 in this way, it is possible to suppress the rotation load of the toner housing container 32 (container body 33). A toner that has deposited on the surface of the seal member 350 does receive a slight compression force. However, this toner is not sandwiched between the stiff materials, i.e., the container shutter end surface 332*h* and the end surface 611*a* of the conveying nozzle 611, but is pushed onto the end surface 611*a* of the conveying nozzle 611 by the flexible seal member 350. Therefore, it is estimated that the flexibility of the seal would absorb the pushing force to thereby reduce the sliding load to the toner.

By providing the seal member 350, it is possible to suppress the toner from entering the interfacial gap, which makes it possible to suppress occurrence of an aggregate due to the rotation of the container body 33 more securely.

Figure 28:
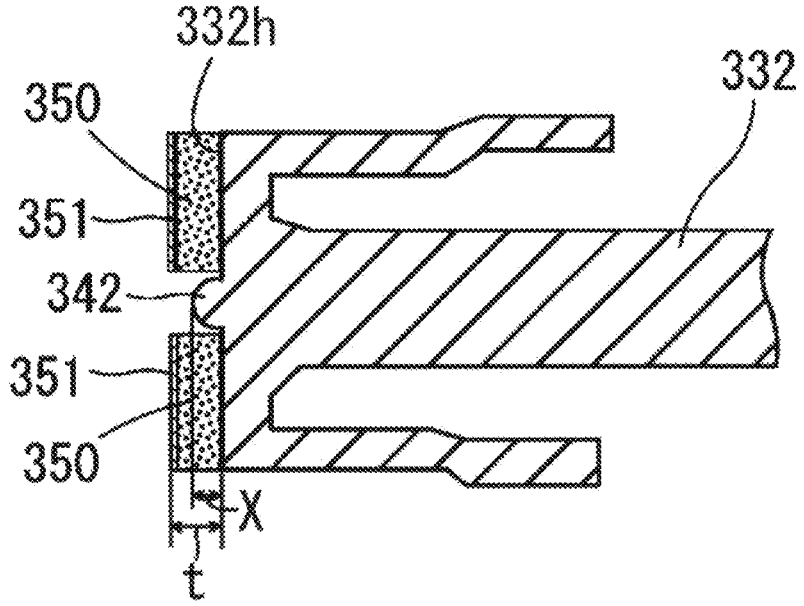
FIG. 28 is an enlarged cross-sectional diagram showing a configuration of a seal member in another embodiment.

As shown in FIG. 26, the facing surface 350*a* of the seal member 350 rotates simultaneously with the container shutter 332 while compressively contacting the conveying nozzle end surface 611*a*. Hence, a sheet material 351 made of a high molecular polyethylene sheet or a polyethylene terephthalate (PET) material may be bonded to the facing surface 350*a* of the seal member 350 as shown in FIG. 28, to thereby form the surface facing the conveying nozzle end surface 611*a* as a lowly frictional surface. By being formed as a lowly frictional surface, the facing surface 350*a* to face the conveying nozzle end surface 611*a* can suppress a load to be applied to the toner due to sliding relative to the conveying nozzle end surface 611*a*.

Figure 34:
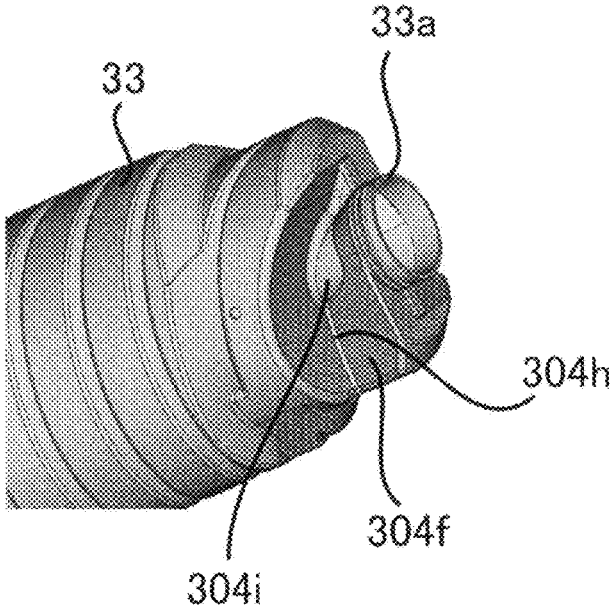
FIG. 34 is a perspective diagram showing another mode of a toner housing container of the present invention.
Figure 35:
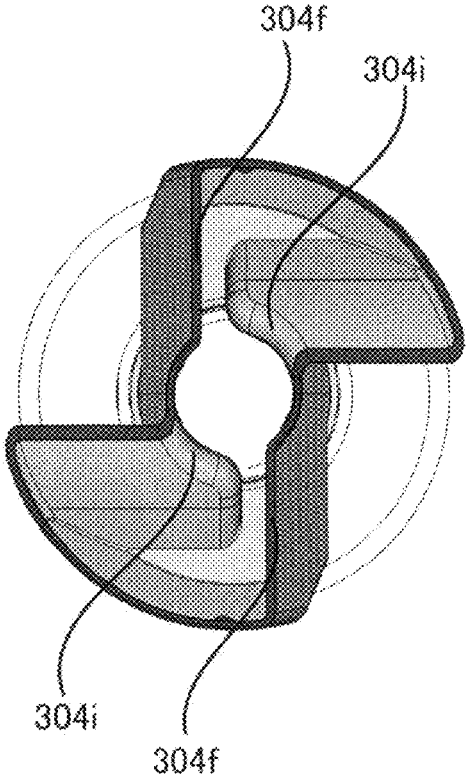
FIG. 35 is a cross-sectional diagram showing another mode of a toner housing container of the present invention.

FIG. 34 and FIG. 35 show a toner housing container, in which the container body includes a large circumference portion that adjoins the uplifting portion 304, and the curving portions 304*i* are larger than those shown in FIG. 30. Such a configuration is also possible. In FIG. 35, the container opening portion 33*a* exists at the deeper side of the drawing sheet.

Figure 36A:
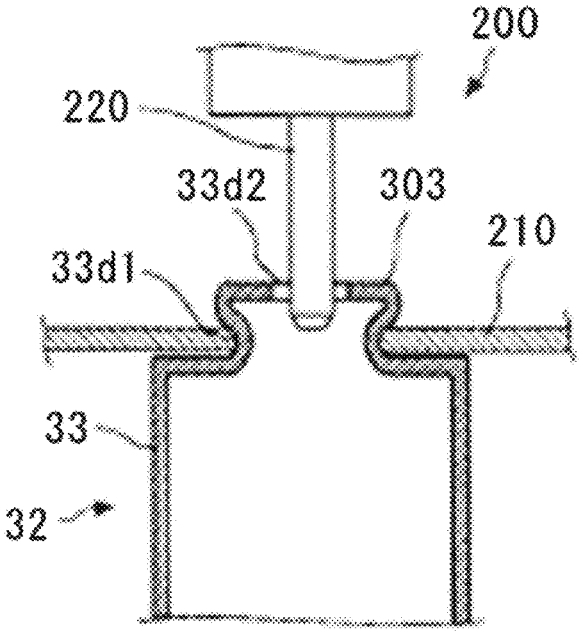
FIG. 36A is a diagram explaining an example manufacturing process for filling a toner housing container with a toner.

Next, an example manufacturing step of filling the toner housing container 32 with a toner will be explained with reference to FIG. 36A and FIG. 36B.

First, a hole **33*d*2 (through-hole) to lead into the container body 33 is formed at the gripping portion 303 of an empty toner housing container 32** (a machining step).

After this, a cleaning nozzle is inserted from the hole **33*d*2 to clean the interior of the container body 33**.

After this, the toner housing container 32 in which the hole **33*d*2 is formed is set on a filling machine 200 as shown in FIG. 36**A.

Specifically, a constricted portion **33*d*1 of the gripping portion 303 as a hooking portion is engaged with a support portion 210 of the filling machine 200, and the toner housing container 32 is suspended such that the gripping portion 303** comes to the top.

Then, a nozzle 220 of the filling machine 200 is inserted into the hole **33*d*2 of the toner housing container 32, and the filling machine 200 fills the toner housing container 32** with the toner (a filling step).

Figure 36B:
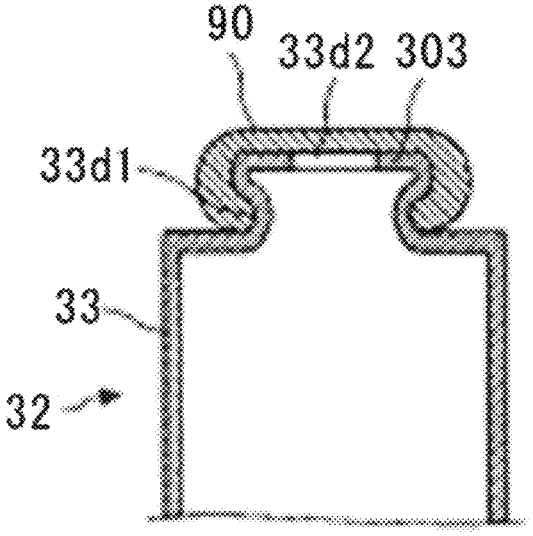
FIG. 36B is a diagram explaining an example manufacturing process for filling a toner housing container with a toner.

Then, with reference to FIG. 36B, when filling of the toner is completed, the hole **32*d*2** is sealed with a sealing cap or the like as a sealing member.

This ensures sealedness of the toner housing container 32 after filled with the toner.

In the present embodiment, a cap 90 to be placed over the gripping portion 303 is used as the sealing member. However, a plug to be inserted into the hole **33*d*2 may be used as a sealing member, or a seal member such as polyurethane foam to be placed over the hole 33*d*2** for cover may be used as a sealing member. That is, the toner housing container of the present embodiment is completed as a toner housing container having a hole opened in the container body and having this hole sealed with a sealing member.

As described above, in the present embodiment, when filling the toner housing container 32 with a toner, it is unnecessary to disassemble the nozzle receiving member 330 from the container body 33 to fill the toner housing container 32 with the toner.

This improves the work efficiency in the manufacturing process.

<Toner>

Next, the toner to be housed in the toner housing container of the present invention will be explained.

The bulk density of the toner when the toner housing container is shaken up and down 10 times under conditions of a temperature of 25° C. and a humidity of 50% RH, and put such that the container opening portion faces downward is 0.399 g/cm$^3$ or less.

For example, the toner contains toner base particles containing a binder resin and a colorant, and an external additive, and further contains other components according to necessity. The toner may be charged positively or negatively and is not particularly limited in this regard.

<<External Additive>>

The external additive is not particularly limited and may be appropriately selected according to the purpose. Examples thereof include silica particles, hydrophobized silica particles, metal salt of fatty acid (e.g., zinc stearate and aluminum stearate), metal oxide particles (e.g., titania, alumina, tin oxide, and antimony oxide) or a hydrophobized product thereof, and fluoropolymer. Among these, hydrophobized silica particles, titania particles, and hydrophobized titania particles are preferable.

Examples of the hydrophobized silica particles include: R-972, R-974, RX-200, RY-200, R-202, R-805, R-812, RX-50, NAX-50, NX-90G, R-8200, and RX-300 (all manufactured by Nippon Aerosil Co., Ltd.); H2000/4, H2000T, H05TM, H13TM, H20TM, and H30TM (all manufactured by Clariant K.K.); X-24-9163A (manufactured by Shin-Etsu Chemical Co., Ltd.); and UFP-30 and UFP-35 (both manufactured by Denki Kagaku Kogyo Kabushiki Kaisha).

Examples of the titania particles include: P-25 (manufactured by Nippon Aerosil Co., Ltd.); STT-30 and STT-65C-S (both manufactured by Titan Kogyo, Ltd.); TAF-140 (manufactured by Fuji Titanium Industry Co., Ltd.); and MT-150W, MT-500B, MT-600B, and MT-150A (all manufactured by Tayca Corp.).

Examples of the hydrophobized titania particles include: T-805 (manufactured by Nippon Aerosil Co., Ltd.); STT-30A and STT-65S-S (both manufactured by Titan Kogyo, Ltd.); TAF-500T and TAF-1500T (both manufactured by Fuji Titanium Industry Co., Ltd.); JMT-150IB, JMT-150ANO, JMT-150AO, MTY-02, MT-100S, and MT-100T (all manufactured by Tayca Corp.); and IT-S (manufactured by Ishihara Sangyo Kaisha Ltd.).

Particle diameter and shape of the external additive are not particularly limited and may be appropriately selected according to the purpose.

Flowability of the toner can be controlled based on the shape and particle diameter of the external additive.

For example, in terms of particle diameter, an external additive having a larger particle diameter imparts a poorer flowability to the toner, because it is more easily immobilized on the toner base particles when mixed therewith, than an external additive having a smaller particle diameter. Conversely, an external additive having a smaller particle diameter imparts a better flowability to the toner, because it is not immobilized on the toner base particles but tends to remain flowable.

In terms of shape, an external additive having a shape closer to a true circle is more flowable and imparts a better flowability to the toner. Titanium oxide used as an external additive is acicular, whereas a spherical product and an atypically-shaped product are known as silica external additives. Among these, spherical silica is the most flowable and imparts a good flowability to the toner. Silica having a small particle diameter imparts a particularly good flowability.

The content of the external additive in the toner is not particularly limited and may be appropriately selected according to the purpose.

It is possible to control the flowability of the toner by varying the content of the external additive in the toner relative to the toner base particles. Typically, it is possible to increase the flowability of the toner by increasing the amount of the external additive in the toner, because this increases the amount of the external additive to cover the surface of the toner base particles, whereas it is possible to reduce the flowability by reducing the amount thereof. Particularly, it is possible to control the flowability of the toner effectively, by increasing or reducing the amount of spherical silica having a small particle diameter.

On the other hand, when the rate of coverage of the toner base particles with the external additive is excessively high, the area over which the surface is covered with an inorganic substance is excessively large, which makes it difficult to fix the toner. Conversely, when the rate of coverage with the external additive is excessively low, the flowability of the toner is poor, which makes it impossible to replenish the toner or makes it likely for toner particles to aggregate and produce abnormal images.

<<Toner Base Particles>>

The toner base particles contain at least a binder resin and a colorant, and further contain a releasing agent, a charge controlling agent, etc. according to necessity.

—Binder Resin—

The binder resin is not particularly limited and may be appropriately selected according to the purpose. Examples thereof include polyester resin, silicone resin, styrene/acrylic resin, styrene resin, acrylic resin, epoxy resin, diene-based resin, phenol resin, terpene resin, coumarin resin, amideimide resin, butyral resin, urethane resin, and ethylene/vinyl acetate resin. One of these may be used alone, or two or more of these may be used in combination. Among these, polyester resin and a combination of polyester resin and any other of the above binder resins are preferable, because they have excellent low temperature fixability and can realize a smooth surface on the image, and because they have sufficient flexibility even when they have a low molecular weight.

—Polyester Resin—

The polyester resin is not particularly limited and may be appropriately selected according to the purpose. The polyester resin may be a modified polyester resin having any type of reactive functional group incorporated in the side chain of the polyester, or may be an unmodified polyester resin having no such group incorporated. One of these may be used alone or two or more of these may be used in combination.

The polyester resin may be a crystalline polyester rein or a non-crystalline polyester resin.

The modified polyester resin is not particularly limited and may be appropriately selected according to the purpose. Examples thereof include a resin obtained from an elongation reaction, a cross-linking reaction, or both thereof of an active hydrogen group-containing compound and polyester reactive with the active hydrogen group-containing compound (hereinafter, this polyester may be referred to as prepolymer). According to necessity, the elongation reaction, the cross-linking reaction, or both thereof may be terminated with a reaction terminator (e.g., a product obtained by blocking monoamine, such as diethyl amine, dibutyl amine, butyl amine, lauryl amine, and ketimine compound).

—Colorant—

The colorant is not particularly limited and may be appropriately selected according to the purpose. Examples thereof include black pigment, yellow pigment, magenta pigment, and cyan pigment. Among these, it is preferable to add any of yellow pigment, magenta pigment, and cyan pigment.

The black pigment is used for, for example, a black toner. Examples of the black pigment include carbon black, copper oxide, manganese dioxide, aniline black, active charcoal, non-magnetic ferrite, magnetite, nigrosine dye, and iron black.

The yellow pigment is used for, for example, a yellow toner. Examples of the yellow pigment include: C.I. Pigment Yellow 74, 93, 97, 109, 128, 151, 154, 155, 166, 168, 180, and 185; naphtol yellow S; Hansa yellow (10G, 5G, and G); cadmium yellow, yellow iron oxide; yellow ocher; chrome yellow; titanium yellow; and polyazo yellow.

The magenta pigment is used for, for example, a magenta toner. Examples of the magenta pigment include: quinacridone-based pigment; and monoazo pigment such as C.I. Pigment Red 48:2, 57:1, 58:2, 5, 31, 146, 147, 150, 176, 184, and 269. The monoazo pigment may be used in combination with the quinacridone-based pigment.

The cyan pigment is used for, for example, a cyan toner. Examples of the cyan pigment include Cu-phthalocyanine pigment, Zn-phthalocyanine pigment, and Al-phthalocyanine pigment.

The content of the colorant in the toner is not particularly limited and may be appropriately selected according to the purpose. However, it is preferably from 1 part by mass to 15 parts by mass, and more preferably from 3 parts by mass to 10 parts by mass, relative to 100 parts by mass of the toner.

The colorant may be used as a master batch in which it is combined with a resin. Such a resin is not particularly limited. However, in terms of compatibility with the binder resin, the resin is preferably the binder resin or a resin having a similar structure to the binder resin.

—Releasing Agent—

The releasing agent is not particularly limited and may be appropriately selected according to the purpose. Examples thereof include brazing material and wax.

Examples of the brazing material and wax include plant wax, mineral wax, and petroleum wax. Examples of the plant wax include carnauba wax, cotton wax, tallow, and rice wax. Examples of animal wax include bees wax and lanolin. Examples of the mineral wax include ozocerite and cersine. Examples of the petroleum wax include paraffin, microcrystalline, and petrolatum.

The melting point of the releasing agent is not particularly limited and may be appropriately selected according to the purpose. However, it is preferably from 50° C. to 120° C., and more preferably from 60° C. to 90° C. When the melting point is lower than 50° C., the wax may adversely affect the storage stability. When the melting point is higher than 120° C., cold offset may be likely to occur upon low temperature fixing. The melting point of the releasing agent is obtained by measuring a maximum endothermic peak with a differential scanning calorimeter (TG-DSC system, TAS-100 manufactured by Rigaku Corporation).

The releasing agent is preferably present in the toner base particles dispersedly. For this purpose, the releasing agent is preferably incompatible with the binder resin. A method for minutely dispersing the releasing agent in the toner base particles is not particularly limited and may be appropriately selected according to the purpose. Examples thereof include a method of dispersing the releasing agent by applying a kneading shear thereto when manufacturing a toner.

The dispersed state of the releasing agent can be confirmed by observing a thin film piece of the toner particles with a transmission electron microscope (TEM). The dispersion diameter of the releasing agent is preferably small. However, when it is excessively small, the releasing agent may not exude sufficiently in fixing. The releasing agent is present dispersedly when the releasing agent can be confirmed at a magnification of ×10,000. When the releasing agent cannot be confirmed at the magnification of ×10,000, the releasing agent is minutely dispersed successfully, but would not exude sufficiently in fixing.

The content of the releasing agent in the toner is not particularly limited and may be appropriately selected according to the purpose. However, it is preferably from 1% by mass to 20% by mass, and more preferably from 3% by mass to 10% by mass. When the content is less than 1% by mass, the releasability will be poor, resulting in poor hot offset resistance, which makes it necessary to take measures such as oil-coating fixing. When the content is greater than 20% by mass, a great amount of the releasing agent would be deposited on the surface of the toner base particles, which is not favorable because the releasing agent is soft and has poor stress resistance, which would lead to troubles such as degradation of heat resistant storage stability due to buried external additive, filming over the photoconductor, etc.

—Charge Controlling Agent—

To impart an appropriate chargeability to the toner, it is possible to add a charge controlling agent to the toner according to necessity.

The charge controlling agent may be any publicly-known charge controlling agent. When a colored material is used, the color tone may be different. Therefore, a colorless or nearly white material is preferable. Examples of such preferable materials include triphenylmethane dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. One of these may be used alone, or two or more of these may be used in combination.

The content of the charge controlling agent in the toner is not determined flatly, because it is determined based on the type of the binder resin and the toner producing method including a dispersing method. However, it is preferably from 0.01% by mass to 5% by mass, and more preferably from 0.02% by mass to 2% by mass relative to the binder resin. When the content is greater than 5% by mass, the toner becomes excessively chargeable, to thereby reduce the effect of the charge controlling agent and have a greater electrostatic force of attracting a developing roller, leading to degradation of flowability of the developer, or degradation of the image density. When the content is less than 0.01% by mass, charge rising property and charge buildup may be poor, which may influence toner images.

<<Toner Producing Method>>

The method for producing the toner is not particularly limited and may be appropriately selected according to the purpose. Examples thereof include pulverizing method and chemical method. Toner base particles can be obtained with these methods.

Examples of the chemical method include suspension polymerization method, emulsion polymerization aggregation method, seed polymerization method, dissolution suspension method, dissolution suspension polymerization method, and phase-transfer emulsification method, which produce a toner by using a monomer as a starting material, and aggregation method for aggregating resin particles obtained by these methods while they are dispersed in an aqueous medium, and granulating them to particles of a desired size by heating and melting., etc.

The dissolution suspension method is a method of dissolving a resin or a resin precursor in an organic solvent or the like and dispersing or emulsifying it in an aqueous medium.

The dissolution suspension polymerization method is a method of, according to the dissolution suspension method, emulsifying or dispersing in an aqueous medium containing fine resin particles, an oil phase composition containing a binder resin precursor containing a functional group reactive with an active hydrogen group (this binder resin precursor is referred to as reactive group-containing prepolymer), and reacting the reactive group-containing prepolymer with an active hydrogen group-containing compound in the aqueous medium.

The phase-transfer emulsification method is a method of adding water to a solution of a resin or a resin precursor and an appropriate emulsifying agent, to thereby transfer the phase.

These producing methods will be explained below in detail.

—Pulverizing Method—

The pulverizing method is a method of, for example, melt-kneading toner materials containing at least a colorant, a binder resin, and a releasing agent, and pulverizing and classifying the melt-kneaded product, to thereby produce toner base particles.

In the melt-kneading, the toner materials are mixed, and the obtained mixture is subjected to a melt kneader to be melt-kneaded. Examples of the melt kneader include a uniaxial or biaxial continuous kneader, and a batch type kneader using a roll mill.

In the pulverizing, the kneaded product obtained by the kneading is pulverized. In this pulverizing, it is preferable to pulverize the kneaded product coarsely first, and finely next. At this time, a method of pulverizing the kneaded product by making it collide on an impact board in a jet stream, a method of pulverizing the kneaded product by making the particles collide on themselves in a jet stream, and a method of pulverizing the kneaded product in a narrow gap between a mechanically rotating rotor and a stator are preferably used.

In the classifying, the pulverized product obtained by the pulverizing is classified and adjusted to particles of a predetermined particle diameter. The classifying can be performed by removing fine particles with a cyclone, a decanter, a centrifuge, or the like.

After the pulverizing and the classifying are completed, the pulverized product may be classified in an air stream with a centrifugal force or the like, to thereby produce toner base particles having a predetermined particle diameter.

—Dissolution Suspension Method—

The dissolution suspension method is a method of, for example, dispersing or emulsifying in an aqueous medium, an oil phase composition obtained by dissolving or dispersing in an organic solvent, a toner composition containing at least a binder resin or a binder resin precursor, a colorant, and a releasing agent, to thereby produce toner base particles.

The organic solvent used for dissolving or dispersing the toner composition is preferably a volatile organic solvent having a boiling point of lower than 100° C., because such an organic solvent will be easily removed afterwards.

In the dissolution suspension method, it is possible to use an emulsifying agent or a dispersant according to necessity, when dispersing or emulsifying the oil phase composition in an aqueous medium.

—Dissolution Suspension Polymerization Method—

In the dissolution suspension polymerization method, it is preferable to obtain toner base particles by, according to the dissolution suspension method, dispersing or emulsifying in an aqueous medium containing fine resin particles, an oil phase composition containing at least a binder resin, a binder resin precursor containing a functional group reactive with an active hydrogen group (this binder resin precursor is referred to as reactive group-containing prepolymer), a colorant, and a releasing agent, and reacting an active hydrogen group-containing compound contained in the oil phase composition, the aqueous medium, or both thereof, with the reactive group-containing prepolymer, to thereby granulate the materials.

It is possible to produce the fine resin particles by a publicly-known polymerization method. It is preferable to obtain the fine resin particles in the form of an aqueous dispersion liquid of fine resin particles.

The volume average particle diameter of the fine resin particles is preferably from 10 nm to 300 nm, and more preferably from 30 nm to 120 nm. When the volume average particle diameter of the fine resin particles is less than 10 nm and greater than 300 nm, the particle size distribution of the toner may be poor.

The solid content concentration of the oil phase composition is preferably from 40% by mass to 80% by mass. When the solid content concentration is excessively high, it is difficult to dissolve or disperse the oil phase composition or to handle the oil phase composition because of high viscosity thereof. When the solid content concentration is excessively low, the productivity of the toner may be poor.

Toner compositions other than the binder resin, such as the colorant and the releasing agent, and a master batch or the like thereof may be individually dissolved or dispersed in an organic solvent, and after this, mixed with the binder resin dissolved or dispersed liquid.

The aqueous medium may be water alone, but a solvent miscible with water may be used in combination with water. Examples of solvent miscible with water include alcohol (e.g., methanol, isopropanol, and ethylene glycol), dimethylformamide, tetrahydrofuran, cellosolves (e.g., methyl cellosolve), and lower ketones (e.g., acetone and methyl ethyl ketone).

The method of dispersion or emulsification in the aqueous medium is not particularly limited. Publicly-known equipment such as a low speed shearing system, a high speed shearing system, a friction system, a high pressure jet system, and an ultrasonic system can be employed. Among these, a high speed shearing system is preferable in terms of making the particle diameter small. When a high speed shearing disperser is used, the rotation speed is not particularly limited, but is typically from 1,000 rpm to 30,000 rpm, and preferably from 5,000 rpm to 20,000 rpm. The temperature during the dispersing is typically from 0° C. to 150° C. (under pressure), and preferably from 20° C. to 80° C.

The method for removing the organic solvent from the obtained emulsified dispersion is not particularly limited and may be appropriately selected according to the purpose. For example, it is possible to employ a method of gradually raising the temperature while stirring the whole system under normal pressure or reduced pressure to thereby evaporate and remove the organic solvent in the liquid drops completely.

The method for washing and drying the toner base particles dispersed in the aqueous medium may be a publicly-known technique. That is, a process of solid-liquid-separating them with a centrifuge, a filter press, or the like, dispersing the obtained toner cake again in ion-exchanged water of from normal temperature to about 40° C., adjusting their pH with acid or alkali according to necessity, and then solid-liquid-separating them again is repeated a few times, to thereby remove impurities, surfactant, and the like, and after this the resultant is dried with an air flow drier, a circulating drier, a reduced pressure drier, a vibro-fluidizing drier, or the like, to thereby obtain toner particles. Fine particle components included in the toner may be removed with centrifugation or the like, or the obtained toner may be adjusted to a desired particle size distribution with a publicly-known classifier according to necessity after the drying.

The toner base particles may be mixed with particles of the external additive, the charge controlling agent, etc. At this time, a mechanical impact may be applied to suppress the particles of the external additive, etc. from being detached from the surface of the toner base particles.

The method for applying the mechanical impact is not particularly limited and may be appropriately selected according to the purpose. Examples thereof include a method of applying a mechanical impact to the mixture with a blade rotating at a high speed, and a method of subjecting the mixture into a high speed air flow, and accelerating the air flow to thereby make the particles collide on themselves or on an appropriate impact board.

The equipment used for the method is not particularly limited and may be appropriately selected according to the purpose. Examples thereof include ANGMILL (manufactured by Hosokawa Micron Corporation), an apparatus made by modifying I-TYPE MILL (manufactured by Nippon Pneumatic Mfg. Co., Ltd.) to reduce the pulverizing air pressure, a hybridization system (manufactured by Nara Machinery Co., Ltd.), a kryptron system (manufactured by Kawasaki Heavy Industries, Ltd.) and an automatic mortar.

EXAMPLES

Examples of the present invention will be explained below. The present invention is not limited to the Examples below by any means. "Part" represents "part by mass" unless otherwise expressly specified. "%" represents "% by mass" unless otherwise expressly specified.

Production Example 1

Production of Crystalline Polyester Resin 1

A reaction tank equipped with a cooling pipe, a stirrer, and a nitrogen introducing pipe was charged with sebacic acid (202 parts) (1.00 mol), 1,6-hexanediol (154 parts) (1.30 mol), and tetrabutoxy titanate as a condensation catalyst (0.5 parts), and they were reacted under nitrogen stream at 180° C. for 8 hours while distilling away water to be produced. Next, while raising the temperature gradually to 220° C., they were reacted under nitrogen stream for 4 hours while distilling away water to be produced and 1,6-hexanediol, and further reacted at reduced pressure of from 5 mmHg to 20 mmHg until Mw reached about 15,000, to thereby obtain [Crystalline Polyester Resin 1]. The obtained [Crystalline Polyester Resin 1] had Mw of 14,000, and a melting point of 66° C.

Production Example 2

Production of Non-Crystalline Polyester Resin 1 (Unmodified Polyester Resin)

A reaction tank equipped with a cooling pipe, a stirrer, and a nitrogen introducing pipe was charged with bisphenol A-EO 2 mol adduct (222 parts), bisphenol A-PO 2 mol adduct (129 parts), terephthalic acid (150 parts), adipic acid (15 parts), and tetrabutoxy titanate (0.5 parts), and they were reacted under nitrogen stream at 230° C. at normal pressure for 8 hours while distilling away water to be produced. Next, they were reacted at reduced pressure of from 5 mmHg to 20 mmHg, and cooled to 180° C. when the acid value became 2 mgKOH/g. Trimellitic anhydride (35 parts) was added thereto, and they were reacted at normal pressure for 3 hours, to thereby obtain [Non-Crystalline Polyester Resin 1]. The obtained [Non-Crystalline Polyester Resin 1] had Mw of 6,000 and Tg of 54° C.

Production Example 3

Production of Polyester Prepolymer

A reaction tank equipped with a cooling pipe, a stirrer, and a nitrogen introducing pipe was charged with bisphenol A-EO 2 mol adduct (720 parts), bisphenol A-PO 2 mol adduct (90 parts), terephthalic acid (290 parts), and tetrabutoxy titanate (1 part), and they were reacted under nitrogen stream at 230° C. at normal pressure for 8 hours while distilling away water to be produced. Next, they were reacted at reduced pressure of from 10 mmHg to 15 mmHg for 7 hours, to thereby obtain [Intermediate Polyester 1]. [Intermediate Polyester 1] had Mn of 3,200 and Mw of 9,300.

Next, a reaction tank equipped with a cooling pipe, a stirrer, and a nitrogen introducing pipe was charged with the obtained [Intermediate Polyester 1] (400 parts), isophorone diisocyanate (95 parts), and ethyl acetate (500 parts), and they were reacted under nitrogen stream at 80° C. for 8 hours, to thereby obtain a 50% ethyl acetate solution of [Polyester Prepolymer 1] having an isocyanate group at a terminal. The content of free isocyanate in [Polyester Prepolymer 1] was 1.47% by mass.

Production Example 4

Production of Graft Polymer

A reaction vessel equipped with a stirring bar and a thermometer was charged with xylene (480 parts), and low molecular weight polyethylene (SANWAX LEL-400 manufactured by Sanyo Chemical Industries, Ltd.: softening point of 128° C.) (100 parts), and they were dissolved well. Then, after the reaction vessel was purged with nitrogen, a mixture solution of styrene (740 parts), acrylonitrile (100 parts), butyl acrylate (60 parts), di-t-butylperoxyhexahydroterephthalate (36 parts), and xylene (100 parts) was dropped down into the vessel at 170° C. for 3 hours, to promote polymerization. The resultant was retained at that temperature for 30 minutes. Next, the resultant was desolventized, to thereby synthesize [Graft Polymer]. The obtained [Graft Polymer] had Mw of 24,000 and Tg of 67° C.

Production Example 5

Production of Toner Base Particles 1

<Dissolution Suspension Polymerization Method>

—Preparation of Releasing Agent Dispersion Liquid 1—

A vessel equipped with a stirring bar and a thermometer was charged with paraffin wax (HNP-9 manufactured by Nippon Seiro Co., Ltd.: melting point of 75° C.) (50 parts), [Graft Polymer] (30 parts), and ethyl acetate (420 parts). While being stirred, the materials were warmed to 80° C., retained at 80° C. for 5 hours, then cooled to 30° C. in 1 hour, and subjected to dispersion with a beads mill (ULTRA VISCOMILL manufactured by Imex Co., Ltd.) at a liquid delivering speed of 1 kg/hr, at a disk peripheral velocity of 6 m/second, with zirconia beads having a diameter of 0.5 mm packed to 80% by volume, for 3 passes, to thereby obtain [Releasing Agent Dispersion Liquid 1].

—Preparation of Crystalline Polyester Resin Dispersion Liquid 1—

A vessel equipped with a stirring bar and a thermometer was charged with [Crystalline Polyester Resin 1] (100 parts) and ethyl acetate (400 parts). While being stirred, the materials were heated and dissolved at 75° C., then cooled to 10° C. or lower in 1 hour, and subjected to dispersion with a beads mill (ULTRA VISCOMILL manufactured by Imex Co., Ltd.) at a liquid delivering speed of 1 kg/hr, at a disk peripheral velocity of 6 m/second, with zirconia beads having a diameter of 0.5 mm packed to 80% by volume, for 5 hours, to thereby obtain [Crystalline Polyester Resin Dispersion Liquid 1].

—Production of Master Batch 1—

| | |
|---|---|
| Non-Crystalline Polyester Resin 1 | 100 parts |
| Carbon black (PRINTEX 35 manufactured by Degussa Corporation) (DBP oil absorption: 42 mL/100 g, pH: 9.5) | 100 parts |
| Ion-exchanged water | 50 parts |

The materials described above were mixed with a Henschel mixer (manufactured by Nippon Coke and Engineering. Co., Ltd.). The obtained mixture was kneaded with two rolls. The kneading was started from 90° C., and after this, the temperature was gradually lowered to 50° C. The obtained kneaded product was pulverized with a pulverizer (manufactured by Hosokawa Micron Corporation) to thereby produce [Master Batch 1].

—Production of Oil Phase 1—

A vessel equipped with a thermometer and a stirrer was charged with [Non-Crystalline Polyester Resin 1] (93 parts), [Crystalline Polyester Resin Dispersion Liquid 1] (68 parts), [Releasing Agent Dispersion Liquid 1] (75 parts), [Master Batch 1] (18 parts), and ethyl acetate (19 parts), and they were pre-dispersed with the stirrer. After this, they were stirred with a TK homomixer (manufactured by Primix Corporation) at a rotation speed of 5,000 rpm, to be dissolved and dispersed uniformly, to thereby obtain [Oil Phase 1].

—Production of Fine Resin Particle Water Dispersion—

A reaction vessel equipped with a stirring bar and a thermometer was charged with water (600 parts), styrene (120 parts), methacrylic acid (100 parts), butyl acrylate (45 parts), alkylallylsulfosuccinic acid sodium salt (ELEMINOL JS-2 manufactured by Sanyo Chemical Industries, Ltd.) (10 parts), and ammonium persulfate (1 part), and they were stirred at 400 rpm for 20 minutes, which resulted in a white emulsion. The emulsion was heated until the internal temperature of the system was raised to 75° C., and then reacted for 6 hours. A 1% ammonium persulfate aqueous solution (30 parts) was further added to the vessel, and the materials were aged at 75° C. for 6 hours, to thereby obtain [Fine Resin Particle Water Dispersion]. The volume average particle diameter of the particles contained in this [Fine Resin Particle Water Dispersion] was 60 nm, and the resin content had a weight average molecular weight of 140,000, and Tg of 73° C.

—Preparation of Aqueous Phase 1—

Water (990 parts), [Fine Resin Particle Water Dispersion] (83 parts), a 48.5% sodium dodecyldiphenyletherdisulfonate aqueous solution (ELEMINOL MON-7 manufactured by Sanyo Chemical Industries, Ltd.) (37 parts), and ethyl acetate (90 parts) were mixed and stirred, to thereby obtain [Aqueous Phase 1].

—Emulsification or Dispersion—

A 50% ethyl acetate solution of [Polyester Prepolymer 1] (45 parts), and a 50% ethyl acetate solution of isophorone diamine (3 parts) were added to [Oil Phase 1] (273 parts), and they were stirred with a TK homomixer (manufactured by Primix Corporation) at a rotation speed of 5,000 rpm to be dissolved and dispersed uniformly, to thereby obtain [Oil Phase 1']. Next, another vessel equipped with a stirrer and a thermometer was charged with [Aqueous Phase 1] (400 parts), and it was stirred with a TK homomixer (manufactured by Primix Corporation) at 13,000 rpm while adding thereto [Oil Phase 1'] to emulsify the materials for 1 minute, to thereby obtain [Emulsified Slurry 1].

—Desolventiztion~Washing~Drying—

A vessel equipped with a stirrer and a thermometer was charged with [Emulsified Slurry 1], and it was desolventized at 30° C. for 8 hours, to thereby obtain [Slurry 1]. The obtained [Slurry 1] was filtered at reduced pressure, and after this, subjected to the following washing process.

(1) Ion-exchanged water (100 parts) was added to the obtained filtration case, and they were mixed with a TK homomixer (at a rotation speed of 6,000 rpm for 5 minutes), and after this, filtered.

(2) A 10% sodium hydroxide aqueous solution (100 parts) was added to the filtration cake obtained in (1), and they were mixed with a TK homomixer (at a rotation speed of 6,000 rpm for 10 minutes), and after this, filtered at reduced pressure.

(3) 10% hydrochloric acid (100 parts) was added to the filtration cake obtained in (2), and they were mixed with a TK homomixer (at a rotation speed of 6,000 rpm for 5 minutes), and after this, filtered.

(4) An operation of adding ion-exchanged water (300 parts) to the filtration cake obtained in (3), mixing them with a TK homomixer (at a rotation speed of 6,000 rpm for 5 minutes), and after this, filtering them was repeated twice, to thereby obtain a filtration cake 1.

The obtained filtration cake 1 was dried with an air-circulating drier at 45° C. for 48 hours, and after this, sieved through a mesh having a mesh size of 75 μm, to thereby produce toner base particles 1. The particle diameter of the toner base particles 1 was measured, and the volume average particle diameter (Dv) thereof was 5.6 μm.

Production Example 6

Production of Toner 1

Predetermined external additives were added in a predetermined amount to the obtained [Toner Base Particles 1] (100 parts). Specifically, as a mixing order, silica (product name "X-24" manufactured by Shin-Etsu Chemical Co., Ltd.) (2.23 parts) was firstly added and mixed, titanium oxide (product name "JMT-150IB" manufactured by Tayca Corp.) (0.6 parts) was secondly added and mixed, and silica (product name "NX90G" manufactured by Nippon Aerosil Co., Ltd.) (1.50 parts) was thirdly added and mixed. After the mixing, the mixture was passed through a sieve with a mesh size of 500, to thereby obtain a toner 1.

Examples 1 and 2, and Comparative Examples 1 to 7

Toner Housing Container

The toner housing container shown in FIG. 10 (having a cross-section shown in FIG. 30 at the container opening portion) was used. The container body was filled with the toner produced in Production Example 6.

The container body of the toner housing container shown in FIG. 10 had a protruding portion that protruded from the container body interior side of the container opening portion toward one end of the container body. The container body also had a shutter member that was able to move between a closing position to close the container opening portion and an opening position to open the container opening portion.

The uplifting portion had an uplifting wall surface that extended from the internal wall surface of the container body toward the protruding portion, and a curving portion that curved so as to conform to the protruding portion.

The uplifting portion also had a rising portion that rose from the internal wall surface of the container body toward the protruding portion. The rising portion had the curving portion that curved so as to conform to the protruding portion.

The shutter member was to move from the closing position to the opening position by being pushed by a conveying pipe.

The protruding portion was provided such that when the toner housing container was mounted on a toner conveying device, the protruding portion may be present between the curving portion and a toner receiving port of the conveying pipe being inserted, and may extend along a region in which the shutter member was to move.

Further, in the toner housing container shown in FIG. 10, the protruding portion was a plate-shaped member, and provided such that a flat side surface of the plate-shaped member may be present between the curving portion and the toner receiving port of the toner conveying pipe being inserted.

Furthermore, in the toner housing container shown in FIG. 10, the protruding portion was a plate-shaped member, and provided such that a flat side surface of the plate-shaped member (i.e., the side surface thereof in the thickness direction) may be present between the curving portion and the toner receiving port of the toner conveying pipe being inserted.

Moreover, the toner housing container shown in FIG. 10 had two uplifting portions that each had the uplifting wall surface. The two uplifting portions were provided such that when the toner housing container was mounted on the toner conveying device, the protruding portion may be present between the curving portion of each uplifting portion and the toner receiving port of the conveying pipe being inserted.

In the toner housing container shown in FIG. 10, the uplifting portions were formed integrally with the container body, the protruding portion was fixed on the container body, and the uplifting portions were configured to uplift the toner from a lower side to an upper side along with rotation of the container body.

<Evaluation>

The toner housing container was filled with the toner 1 in a predetermined amount (410.58 g). The toner housing container was shaken up and down 10 times under conditions of a temperature of 25° C. and a humidity of 50% RH, to thereby fluidize the toner sufficiently.

Next, the toner housing container was put still with the nozzle receiving port thereof turned downward. The toner housing container was previously calibrated so as to allow for reading the volume (toner volume) of the toner occupied in the toner housing container when the nozzle receiving port was turned downward (which was a seeming volume of the toner, and was to decrease along with the elapse of the time of being put still due to escape of air contained between the toner particles).

When the volume became the desired level along with the container being put still (when the surface of the toner came down to the level of the desired scale mark), the toner housing container was gently set in the image forming apparatus body.

When setting the toner housing container in the image forming apparatus, it was confirmed whether the container shutter (shutter member) was able to move. A toner housing container was evaluated as "A" when the container shutter thereof was able to move to thereby allow the toner housing container to be set in the image forming apparatus. A toner housing container was evaluated as "B" when the container shutter thereof was not able to move to thereby not allow the toner housing container to be set in the image forming apparatus. The results are shown in Table 1.

The same evaluations were made by varying the time for which the toner housing container was to be put still to thereby vary the toner volume. The results are shown in Table 1.

Further, for the toner housing containers, of which container shutter was able to move (i.e., the toner housing containers that could be set (inserted) in the image forming apparatus), it was confirmed whether the toner housing containers were able to discharge the toner. Toner housing containers that were able to discharge the toner was evaluated as "A". The results are shown in Table 1.

TABLE 1

| | Toner volume [$cm^3$] | Amount of toner filled [g] | Bulk density of toner [$g/cm^3$] | Ability to be inserted (set) | Ability to discharge toner | Ratio of toner occupying toner volume |
|---|---|---|---|---|---|---|
| Comp. Ex. 1 | 764 | 410.58 | 0.537 | B | — | 44.8% |
| Comp. Ex. 2 | 898 | 410.58 | 0.457 | B | — | 38.1% |
| Comp. Ex. 3 | 965 | 410.58 | 0.425 | B | — | 35.5% |
| Comp. Ex. 4 | 999 | 410.58 | 0.411 | B | — | 34.2% |
| Comp. Ex. 5 | 1,012 | 410.58 | 0.406 | B | — | 33.8% |
| Comp. Ex. 6 | 1,019 | 410.58 | 0.403 | B | — | 33.6% |
| Comp. Ex. 7 | 1,025 | 410.58 | 0.401 | B | — | 33.4% |
| Ex. 1 | 1,028 | 410.58 | 0.399 | A | A | 33.3% |
| Ex. 2 | 1,050 | 410.58 | 0.391 | A | A | 32.6% |

The bulk density of the toner in the toner housing container was calculated from the toner volume ($cm^3$) and the amount of toner filled (g).

For example, when the toner volume was 764 $cm^3$, the bulk density of the toner was 410.58 g/764 $cm^3$=0.537 $g/cm^3$.

Based on the result of this calculation and the result of the evaluation of whether insertable or not shown in Table 1, it was confirmed that the container shutter (shutter member) could be opened without being hindered by the toner when the bulk density of the toner was 0.399 $g/cm^3$ or less.

That is, it can be considered that the container shutter (shutter member) of the toner housing container can be opened without being hindered by the toner, as long as the bulk density of the toner in the toner housing container when the toner housing container is shaken up and down 10 times under the conditions of a temperature of 25° C. and a humidity of 50% RH to fluidize the toner sufficiently is 0.399 $g/cm^3$ or less.

Hence, the toner housing container needs to be filled with the toner such that the bulk density of the toner when the toner housing container is shaken in a state keeping its highest toner content (i.e., when shipping, unconsumed state) to fluidize the toner sufficiently is 0.399 $g/cm^3$ or less.

It is considered that when the bulk density after fluidization is greater than the above value, no mater how well the toner housing container is shaken to fluidize the toner, the region around the shutter will be clogged with the toner to cause troubles in opening of the shutter.

Here, a possibility is conceivable that the density of the toner itself would influence the results above. However, because the true density of a toner is about 1.2 $g/cm^3$ when it is a non-magnetic toner, the bulk density mentioned above is applicable to a typical non-magnetic toner made of a resin.

The true density of the above toner 1 was measured with a dry automatic densimeter ACUPIC 1330 (manufactured by Shimadzu Corporation), and it was 1.2 $g/cm^3$.

The above content was investigated from another aspect.

The actual volume of the toner in the above experiment can be calculated as follows, based on the amount of the toner filled and the true density of the toner:

$$410.58\ (g)/1.2\ (g/cm^3)=342.15\ (cm^3).$$

Then, based on the toner volume, at what ratio the toner occupied the space defined by the toner volume (i.e., the ratio at which the toner occupies the cubic capacity) was calculated.

For example, when the toner volume was 764 $cm^3$, the ratio of the toner occupying that toner volume was 44.8%. This value was calculated for every toner volume, and the results were as shown in Table 1.

That is, it can be considered that as long as the ratio at which the toner occupies the space defined by the toner volume in the above toner housing container is 33.3% or less when the toner housing container is shaken up and down 10 times under the conditions of a temperature of 25° C. and a humidity of 50% RH to fluidize the toner sufficiently, the container shutter (shutter member) can be opened without being hindered by the toner. It can be considered that if the toner occupies the space more than this value, there will be no room to which the toner can evacuate, and as described above, there would exist immobile toner in the moving region of the container shutter (i.e., between the shutter side surface support portions) when opening the container shutter, which would hinder the container shutter from being opened.

The above result can also be obtained by dividing the bulk density obtained as in Table 1 by the true density. That is, since the bulk density is the mass (g) of the toner per unit volume ($cm^3$), it is possible to know what volume ($cm^3$) of toner is present per unit volume ($cm^3$), by dividing the bulk density by the true density.

That is, it is possible to obtain the bulk density, by obtaining the toner volume when the toner housing container is shaken up and down 10 times under conditions of a temperature of 25° C. and a humidity of 50% RH to fluidize the toner sufficiently (normally, the toner volume is equal to the cubic capacity of the toner housing container, because the toner housing container is normally filled with the toner to the full), and then obtaining the mass of the toner contained therein.

Then, by obtaining the true density of the toner and dividing the bulk density by the true density, it is possible to calculate how much of the internal space of the bottle is occupied by the fluidized toner.

The above results are considered to depend on how much of the space is occupied by the toner, i.e., at what density the container is filled with the toner, and it can be considered that the same results would be applicable regardless of the types of toners.

The aspects of the present invention are as follows, for example.

<1> A toner housing container, including:

a container body mountable on a toner conveying device and housing a toner to be supplied into the toner conveying device;

a conveying portion provided in the container body and configured to convey the toner from one end of the container body in a longer direction thereof to the other end thereof at which a container opening portion is provided;

a pipe receiving port provided at the container opening portion and capable of receiving a conveying pipe fixed to the toner conveying device; and an uplifting portion configured to uplift the toner conveyed by the conveying portion from a lower side of the container body to the upper side thereof and move the toner into a toner receiving port of the conveying pipe, wherein the container body includes a protruding portion protruding from a container body interior side of the container opening portion toward the one end, and a shutter member capable of moving between a closing position to close the container opening portion and an opening position to open the container opening portion, wherein the uplifting portion includes an uplifting wall surface extending from an internal wall surface of the container body toward the protruding portion, and a curving portion curving so as to conform to the protruding portion, wherein the shutter member moves from the closing position to the opening position by being pushed by the conveying pipe, wherein the protruding portion is provided such that when the toner housing container is mounted on the toner conveying device, the protruding portion is present between the curving portion and the toner receiving port of the conveying pipe being inserted, and extends along a region in which the shutter member moves, and wherein the toner has a bulk density of 0.399 g/cm$^3$ or less when the toner housing container is shaken up and down 10 times under conditions of a temperature of 25° C. and a humidity of 50% RH and put such that that the container opening portion faces downward.

<2> A toner housing container, including:

a container body mountable on a toner conveying device and housing a toner to be supplied into the toner conveying device;

a conveying portion provided in the container body and configured to convey the toner from one end of the container body in a longer direction thereof to the other end thereof at which a container opening portion is provided;

a pipe receiving port provided at the container opening portion and capable of receiving a conveying pipe fixed to the toner conveying device; and an uplifting portion configured to uplift the toner conveyed by the conveying portion from a lower side of the container body to an upper side thereof and move the toner into a toner receiving port of the conveying pipe, wherein the container body includes a protruding portion protruding from a container body interior side of the container opening portion toward the one end, and a shutter member capable of moving between a closing position to close the container opening portion and an opening position to open the container opening portion, wherein the uplifting portion includes a rising portion rising from an internal wall surface of the container body toward the protruding portion, wherein the rising portion includes a curving portion curving so as to conform to the protruding portion;

wherein the shutter member moves from the closing position to the opening position by being pushed by the conveying pipe, wherein the protruding portion is provided such that when the toner housing container is mounted on the toner conveying device, the protruding portion is present between the curving portion and the toner receiving port of the conveying pipe being inserted, and extends along a region in which the shutter member moves, and wherein the toner has a bulk density of 0.399 g/cm$^3$ or less when the toner housing container is shaken up and down 10 times under conditions of a temperature of 25° C. and a humidity of 50% RH and put such that the container opening portion faces downward.

<3> The toner housing container according to <1> or <2>, wherein the protruding portion is a plate-shaped member, and wherein a flat side surface of the plate-shaped member is provided so as to be present between the curving portion and the toner receiving port of the conveying pipe being inserted.

<4> The toner housing container according to any one of <1> to <3>, wherein the toner housing container includes two uplifting portions, and wherein when the toner housing container is mounted on the toner conveying device, the protruding portion is present between the curving portions of respective ones of the two uplifting portions and the toner receiving port of the conveying pipe being inserted.

<5> The toner housing container according to any one of <1> to <4>, wherein the uplifting portion and the protruding portion are fixed to the container body or formed integrally with the container body, and wherein the uplifting portion uplifts the toner from the lower side to the upper side by rotation of the container body.

<6> An image forming apparatus, including:

an image forming apparatus body in which the toner housing container according to any one of <1> to <5> is set demountably.

This application claims priority to Japanese application No. 2013-107060, filed on May 21, 2013 and incorporated herein by reference.

What is claimed is:

1. A container, comprising:

a container body mountable on a toner conveying device to house toner to be supplied into the toner conveying device;

a conveying portion in the container body and configured to convey the toner from one end of the container body in a longer direction thereof to the other end thereof at which a container opening portion is provided;

a pipe receiving port at the container opening portion to receive a conveying pipe fixed to the toner conveying device;

an uplifting portion to uplift the toner conveyed by the conveying portion from a lower side of the container body to an upper side thereof and to move the toner into a toner receiving port of the conveying pipe;

a shutter support around a central axis of the container body; and a shutter to move between a closing position to close the container opening portion and an opening portion to open the container opening portion, the shutter slidably supported by the shutter support, wherein the uplifting portion comprises an uplifting wall surface extending from an internal wall surface of the container body toward the shutter support, and a curving portion, connected to the uplifting wall surface, which curves around the shutter support, wherein the shutter moves from the closing position to the opening position by being pushed by the conveying pipe, and wherein the shutter support is disposed such that when the container is mounted on the toner conveying device, the shutter support is present between the curving portion and the toner receiving port of the conveying pipe, and extends along a region in which the shutter member moves.

2. The container according to claim 1, wherein the shutter support is a plate-shaped member, and wherein a flat side surface of the plate-shaped member is provided so as to be present between the curving portion and the toner receiving port of the conveying pipe.

3. The container according to claim 1, wherein the container comprises two uplifting portions, and wherein when the container is mounted on the toner conveying device, the shutter support is present between the curving portions of respective ones of the two uplifting portions and the toner receiving port of the conveying pipe.

4. The container according to claim 1, wherein the uplifting portion and the shutter support are fixed to the container body or formed integrally with the container body, and wherein the uplifting portion uplifts the toner from the lower side to the upper side by rotation of the container body.

5. An image forming apparatus, comprising:

an image forming apparatus body in which the container according to claim 1 is set demountably.

6. The container according to claim 1, wherein:

the toner has a bulk density of 0.399 g/cm3 or less after the container is shaken up and down 10 times under conditions of a temperature of 25° C. and a humidity of 50% RH and put such that the container opening portion faces downward.

7. The container according to claim 1, wherein:

a diameter of the container narrows at the uplifting portion.

8. The container according to claim 1, further comprising:

another wall connected to the curving portion.

9. A container, comprising:

a container body mountable on a toner conveying device and to house toner to be supplied into the toner conveying device;

a conveying portion in the container body and configured to convey the toner from one end of the container body in a longer direction thereof to the other end thereof at which a container opening portion is provided;

a pipe receiving port at the container opening portion to receive a conveying pipe fixed to the toner conveying device;

an uplifting portion to uplift the toner conveyed by the conveying portion from a lower side of the container body to an upper side thereof and move the toner into a toner receiving port of the conveying pipe;

a shutter support around a central axis of the container body; and a shutter to move between a closing position to close the container opening portion to an opening portion to open the container opening portion, the shutter slidably supported by the shutter support, wherein the uplifting portion comprises a rising portion rising from an internal wall surface of the container body toward the shutter support, wherein the rising portion comprises a curving portion curving so as to conform to the shutter support, wherein the shutter support is disposed such that when the container is mounted on the toner conveying device, the shutter support is present between the curving portion and the toner receiving port of the conveying pipe, and extends along a region in which the shutter member moves.

10. The container according to claim 9, wherein the shutter support is a plate-shaped member, and wherein a flat side surface of the plate-shaped member is provided so as to be present between the curving portion and the toner receiving port of the conveying pipe.

11. The container according to claim 9, wherein the container comprises two uplifting portions, and wherein when the container is mounted on the toner conveying device, the shutter support is present between the curving portions of respective ones of the two uplifting portions and the toner receiving port of the conveying pipe.

12. The container according to claim 9, wherein the uplifting portion and the shutter support are fixed to the container body or formed integrally with the container body, and wherein the uplifting portion uplifts the toner from the lower side to the upper side by rotation of the container body.

13. An image forming apparatus, comprising:

an image forming apparatus body in which the container according to claim 9 is set demountably.

14. The container according to claim 9, wherein:

the toner has a bulk density of 0.399 g/cm3 or less after the container is shaken up and down 10 times under conditions of a temperature of 25° C. and a humidity of 50% RH and put such that the container opening portion faces downward.

15. The container according to claim 9, wherein:

a diameter of the container narrows at the uplifting portion.

16. The container according to claim 9, further comprising:

another wall connected to the curving portion.

* * * * *